US006549736B2

(12) United States Patent
Miyabe et al.

(10) Patent No.: US 6,549,736 B2
(45) Date of Patent: Apr. 15, 2003

(54) PROCESS CARTRIDGE, ENGAGING MEMBER THEREFOR AND METHOD FOR MOUNTING DEVELOPING ROLLER AND MAGNET

(75) Inventors: Shigeo Miyabe, Numazu (JP); Hiroomi Matsuzaki, Mishima (JP); Akira Suzuki, Odawara (JP); Shinjiro Toba, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/764,403

(22) Filed: Jan. 19, 2001

(65) Prior Publication Data

US 2001/0026707 A1 Oct. 4, 2001

(30) Foreign Application Priority Data

Jan. 19, 2000 (JP) ..... 2000-014007
Nov. 17, 2000 (JP) ..... 2000-351653

(51) Int. Cl.[7] ..... G03G 21/16
(52) U.S. Cl. ..... 399/111; 399/267
(58) Field of Search ..... 399/111, 252, 399/267, 277, 119

(56) References Cited

U.S. PATENT DOCUMENTS

| | | | | |
|---|---|---|---|---|
| 5,331,373 | A | 7/1994 | Nomura et al. | |
| 5,452,056 | A | 9/1995 | Nomura et al. | |
| 5,463,446 | A | 10/1995 | Watanabe et al. | |
| 5,585,889 | A | 12/1996 | Shishido et al. | |
| 5,640,650 | A | 6/1997 | Watanabe et al. | 399/117 |
| 5,682,587 | A * | 10/1997 | Higeta et al. | 399/277 |
| 5,768,658 | A * | 6/1998 | Watanabe et al. | 399/111 |
| 5,768,669 | A * | 6/1998 | Yokoyama | 156/73.1 |
| 5,822,654 | A * | 10/1998 | Damji et al. | 399/111 |
| 5,839,028 | A | 11/1998 | Nomura et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,926,666 | A | 7/1999 | Miura et al. | 399/25 |
| 5,926,672 | A * | 7/1999 | Nishibata et al. | 399/111 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,011,941 | A | 1/2000 | Takashima et al. | 399/111 |
| 6,029,031 | A | 2/2000 | Yokomori et al. | 399/109 |
| 6,064,843 | A | 5/2000 | Isobe et al. | 399/111 |
| 6,072,968 | A | 6/2000 | Nomura | 399/113 |
| 6,097,906 | A | 8/2000 | Matsuzaki et al. | 399/90 |
| 6,128,452 | A | 10/2000 | Miyabe et al. | 399/90 |
| 6,144,815 | A | 11/2000 | Chadani et al. | 399/27 |
| 6,154,623 | A | 11/2000 | Suzuki et al. | 399/111 |
| 6,167,219 | A | 12/2000 | Miyamoto et al. | 399/90 |
| 6,173,140 | B1 | 1/2001 | Suzuki et al. | 399/113 |
| 6,173,145 | B1 | 1/2001 | Chadani et al. | 399/265 |
| 6,317,575 | B1 * | 11/2001 | Kumar et al. | 399/119 |

* cited by examiner

*Primary Examiner*—Robert Beatty
(74) *Attorney, Agent, or Firm*—Fitzpatrick, Cella, Harper & Scinto

(57) ABSTRACT

A process cartridge detachably mountable to a main assembly of an electrophotographic image forming apparatus, the process cartridge includes an electrophotographic photosensitive drum; a developing roller for developing an electrostatic latent image formed on the photosensitive drum; a magnet disposed inn the developing roller; a drum frame supporting the photosensitive drum; a developing device frame supporting the developing roller and the magnet; an engaging member mounted to one longitudinal end of the developing device frame in engagement with one end of the developing roller and with one end of the magnet, the engaging member is provided with a projected portion at an opposite end from the end where it is in engagement with one end of the developing roller and one end of the magnet; an elastic member urging the projected portion by its elastic force so as to urge the developing roller to the photosensitive drum.

19 Claims, 40 Drawing Sheets

PROCESS CARTRIDGE, ENGAGING MEMBER THEREFOR AND METHOD FOR MOUNTING DEVELOPING ROLLER AND MAGNET

FIELD OF THE INVENTION AND RELATED ART

The present invention relates to a process cartridge, process cartridge components for connecting, and holding together, the process cartridge components, and a process for assembling the process cartridge components.

Here, an electrophotographic image forming apparatus (hereinafter, "image forming apparatus") means an apparatus which forms an image on recording medium with the use of an electrophotographic image formation process. It includes, for example, an electrophotographic copying machine, an electrophotographic printer (for example, LED) printer, a laser beam printer, and the like), an electrophotographic facsimile apparatus, an electrophotographic word processor, and the like.

A process cartridge means a cartridge in which a charging means, a developing means or a cleaning means, and an electrophotographic photosensitive member are integrally placed, and which is removably mountable in the main assembly of an image forming apparatus. It also means a cartridge in which at least one processing means among a charging means, a developing means, and a cleaning means, and an electrophotographic photosensitive member, are integrally placed, and which is removably mountable in the main assembly of an image forming apparatus, and a cartridge in which at least a developing means, and an electrophotographic photosensitive member, are integrally placed, and which is removably mountable in the main assembly of an image forming apparatus.

Conventionally, an image forming apparatus for forming an image on recording medium with the use of an electrophotographic image formation process employs a process cartridge system. According to a process cartridge system, an electrophotographic photosensitive member, and a single or plural processing means, which act on an electrophotographic photosensitive member, are integrally placed in a cartridge which is removably mountable in the main assembly of an image forming apparatus. Also according to this process cartridge system, an image forming apparatus can be maintained by users themselves without relying on service personnel, and therefore, operational efficiency can be drastically improved. As a result, a process cartridge system is widely used in the field of the image forming apparatus.

In order to improve image quality, it is desired that a process cartridge is further improved in terms of the accuracy with which components related to image formation are positioned.

It is also desired that a process cartridge is further reduced in cost.

SUMMARY OF THE INVENTION

Thus, the primary object of the present invention is to provide a process cartridge, in which a development roller and a magnet are more accurately positioned compared to a conventional process cartridge, connecting members for more accurately positioning a development roller and a magnet, and a connecting method for more accurately positioning a development roller and a magnet.

Another object of the present invention is provide: an inexpensive process cartridge, the cost reduction for which is realized by connecting the corresponding ends of the development roller and magnet with the use of connecting members shared by the development roller and magnet; connecting members for connecting the development roller and magnet; and a method for connecting the development roller and magnet.

Another object of the present invention is to provide a process cartridge having a development means frame portion for supporting a development roller and a magnet, and a connecting member connected to one of longitudinal ends of the development roller and one of the longitudinal ends of the magnet, one the same side, as well as one of the longitudinal ends of the developing means frame portion, characterized in that the connecting member has; a projection projecting in the direction opposite to the side where the connecting member is connected one of the longitudinal ends of the development roller and one of the longitudinal ends of the magnet, on the same side; and an elastic member for pressing the projection in the direction to keep the development roller pressed upon a photosensitive drum.

Another object of the present invention is to provide a connecting member used for attaching a development roller to a developing means frame portion, comprising: a connecting portion for connecting one of the longitudinal ends of the development roller, and one of the longitudinal ends of the magnet, on the same side; a projection projecting from the side opposite to the side where the connecting member is located and a pressing portion located on the projection to be pressed by an elastic member.

Another object of the present invention is to provide a method for attaching a development roller and a magnet to a developing means frame portion, characterized in that a connecting member comprising: connecting portion for connecting one of the longitudinal ends of the development roller, and one of the longitudinal ends of the magnet, on the same side, a projection projecting from the side opposite to the side where the connecting member is located; and a pressing portion located on the projection to be pressed by an elastic member, is attached to the developing means frame portion after one of the longitudinal ends of the development roller, and one of the longitudinal ends of the magnet, on the same side, are connected to the connecting portion of the connecting member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to FIGS. 1–9, preferred embodiments of the present invention will be described. In this embodiment, the longitudinal direction means the direction which is perpendicular to the direction in which recording medium is conveyed, and parallel to the direction of the surface of the recording medium. The top and bottom sides of a process cartridge mean the top and bottom sides of a process cartridge which is properly placed in the main assembly of an image forming apparatus.

(Process Cartridge and Main Assembly of Image Forming Apparatus)

Figure 2:
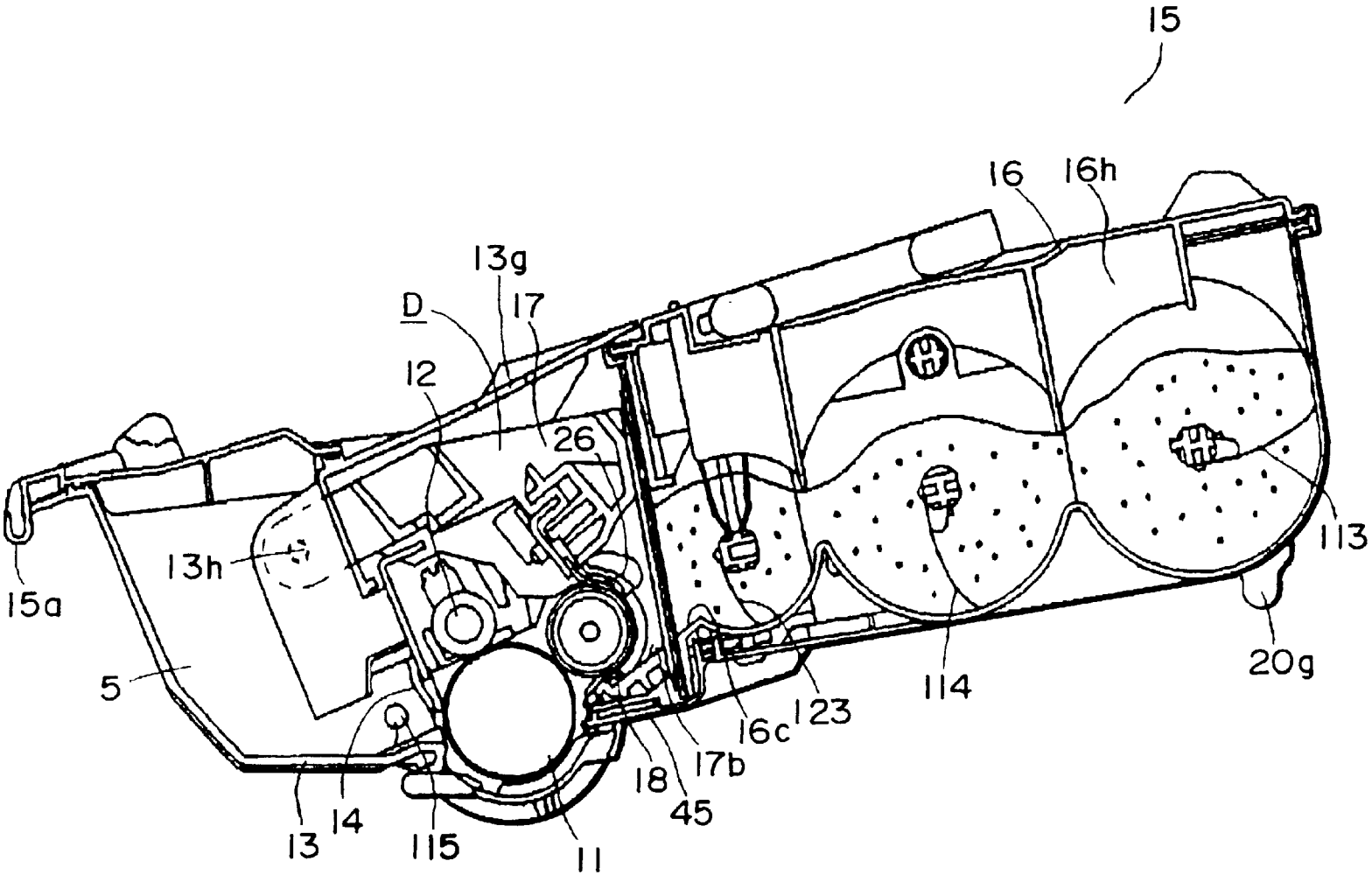
FIG. 2 is a vertical sectional view of a process cartridge.

FIG. 2 is a vertical sectional view of a typical process cartridge in accordance with the present invention, and FIG.

1 is a vertical sectional view of a typical image forming apparatus in accordance with the present invention. This process cartridge is provided with an electrophotographic photosensitive member, and a single or plural processing means which act on the electrophotographic photosensitive member. As for the processing means, there are, for example, a charging mean for charging the peripheral surface of the electrophotographic photosensitive member, a developing means for developing an electrostatic latent image formed on the electrophotographic photosensitive member, and a cleaning means for removing the developer remaining on the peripheral surface of the electrophotographic photosensitive member.

Referring to FIG. 2, the process cartridge 15 in this embodiment comprises an electrophotographic photosensitive drum 11, a charging member 12 as a charging means, a development roller 18 as a developing means, a development blade 26, and a cleaning member 14 as a cleaning means. It also comprises a housing in which the charging member 12, the development roller 18, the development blade 26, and the cleaning member 14 are integrally positioned in a manner to surround the peripheral surface of an electrophotographic photosensitive drum 11, so that they can be removably mounted into the main assembly 27 (hereinafter, apparatus main assembly) of an image forming apparatus. The charging member 12 in this embodiment is a charge roller which comprises a metallic core and a layer of rubber wrapped around the peripheral surface of the metallic core. The cleaning member 14 comprises a rubber blade placed in contact with the peripheral surface of the photosensitive drum 11 to scrape away the toner that remains on the peripheral surface of the photosensitive drum 11 after image transfer, and a metallic plate to which the rubber plate is fixed.

Figure 1:
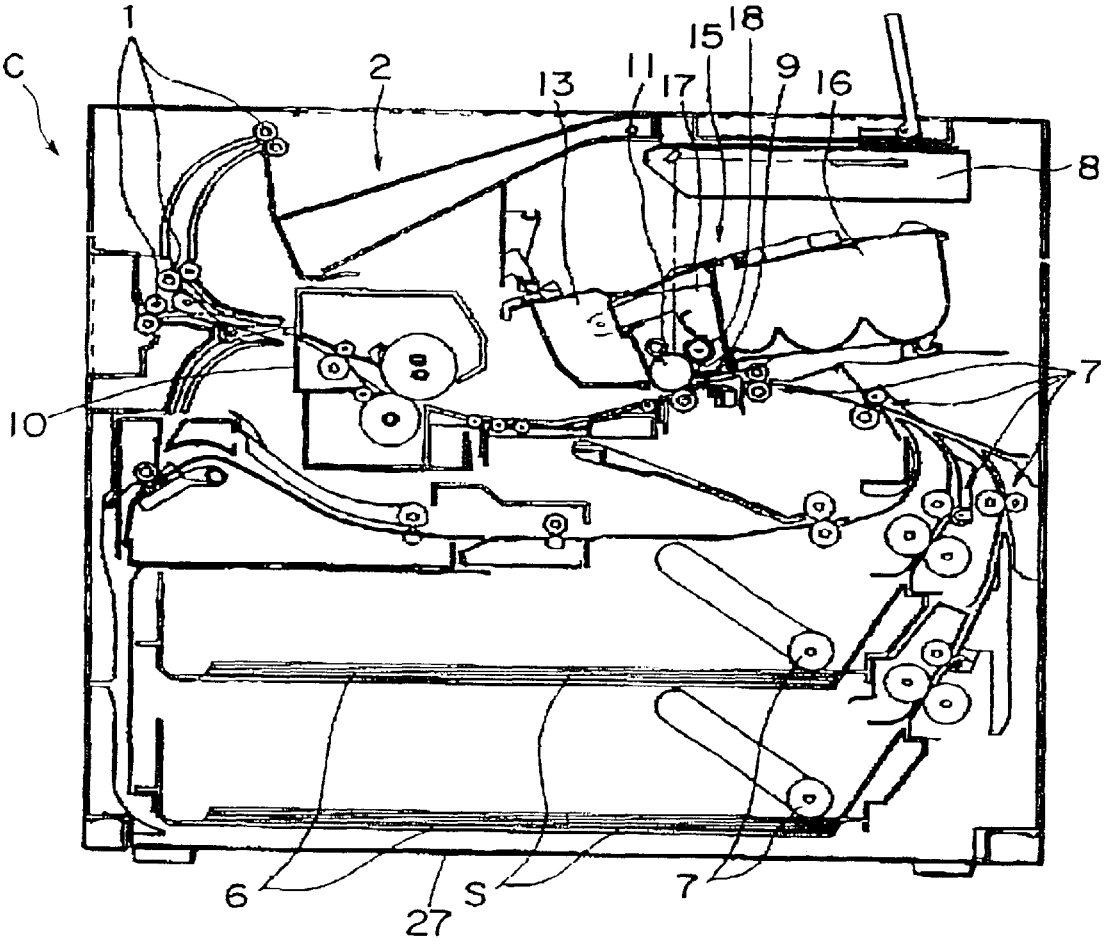
FIG. 1 is a vertical sectional view of an electrophotographic image forming apparatus.

The process cartridge 15 is mounted in an electrophotographic image forming apparatus C, such as the one illustrated in FIG. 1, for the purpose of an image forming operation. In an image forming operation, a sheet S is conveyed by a conveying roller 7, from a sheet cassette 6 placed in the bottom portion of the apparatus main assembly. In synchronism with this sheet conveyance, a latent image is formed on the peripheral surface of the photosensitive drum 11 by exposing the selected points on the peripheral surface of the photosensitive drum 11 to a beam of light projected from an exposing apparatus 8. Thereafter, toner is supplied to the peripheral surface of the photosensitive drum 11, in accordance with the pattern of the latent image, by applying development bias to the development roller 18, on the peripheral surface of which the toner stored in a toner container or a developer holer frame portion 16 has been coated in a thin layer, while triboelectrically charging the toner, by the development blade 26. As a result, a toner image is formed on the peripheral surface of the photosensitive drum 11. This toner image is transferred onto the sheet S as a recording medium, which is being conveyed, by applying bias voltage to transfer roller 9. Thereafter, the sheet S is conveyed to a fixing apparatus 10, in which the toner image is fixed to the sheet S. Then, the sheet S is discharged into a delivery portion 2 located at the top of the apparatus main assembly, by a sheet discharging roller 1.

Meanwhile, the toner which remained on the photosensitive drum 11 after the toner image transfer is removed by the cleaning member 14, and is moved rearward in a removed toner bin 5, by a removed toner conveying member 115.

(Structure of Process Cartridge Frame)

Figure 5:
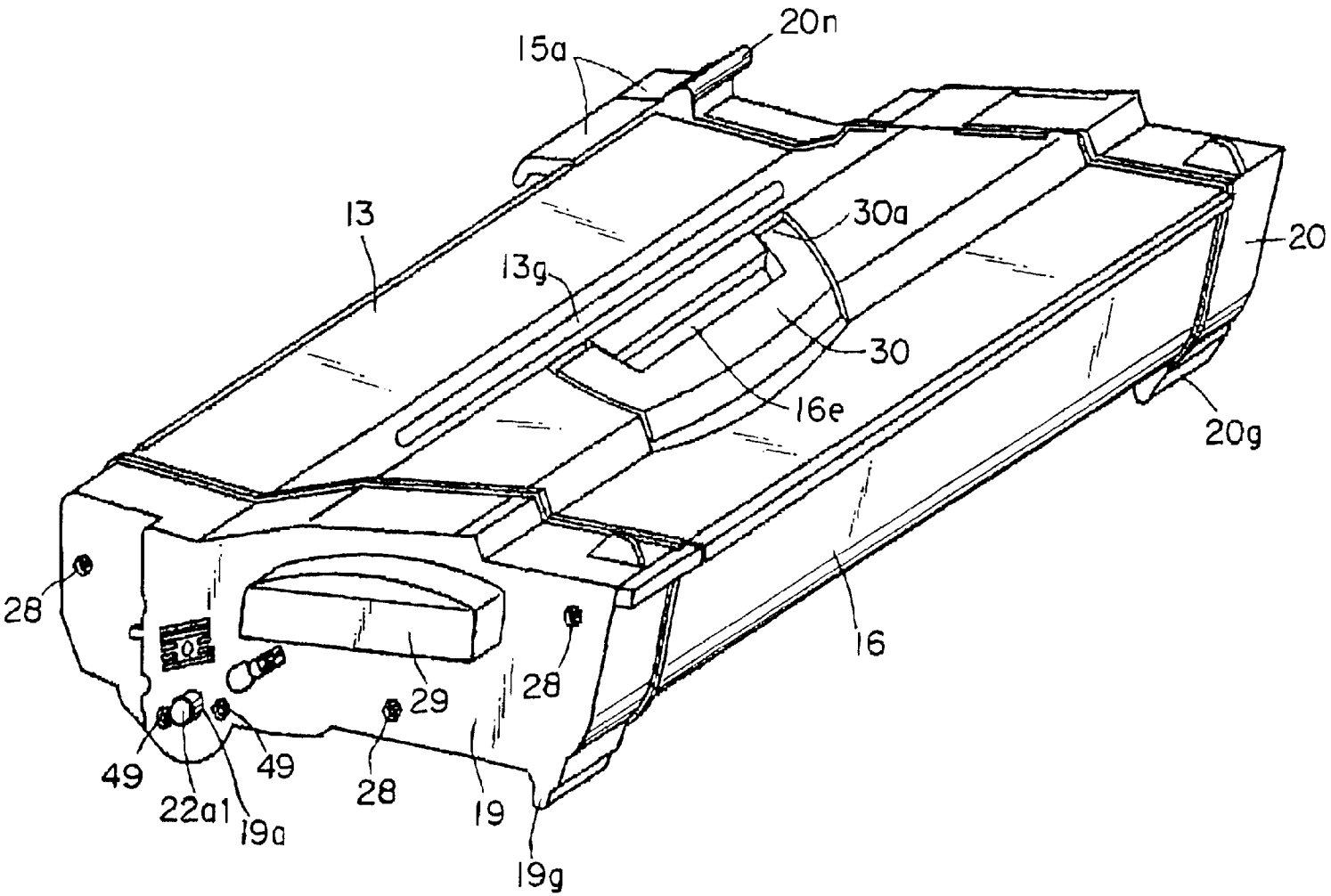
FIG. 5 is a perspective view of the process cartridge as seen from diagonally above the right side of the trailing side of the process cartridge, in terms of the direction in which the process cartridge is inserted into the main assembly of an image forming apparatus.
Figure 6:
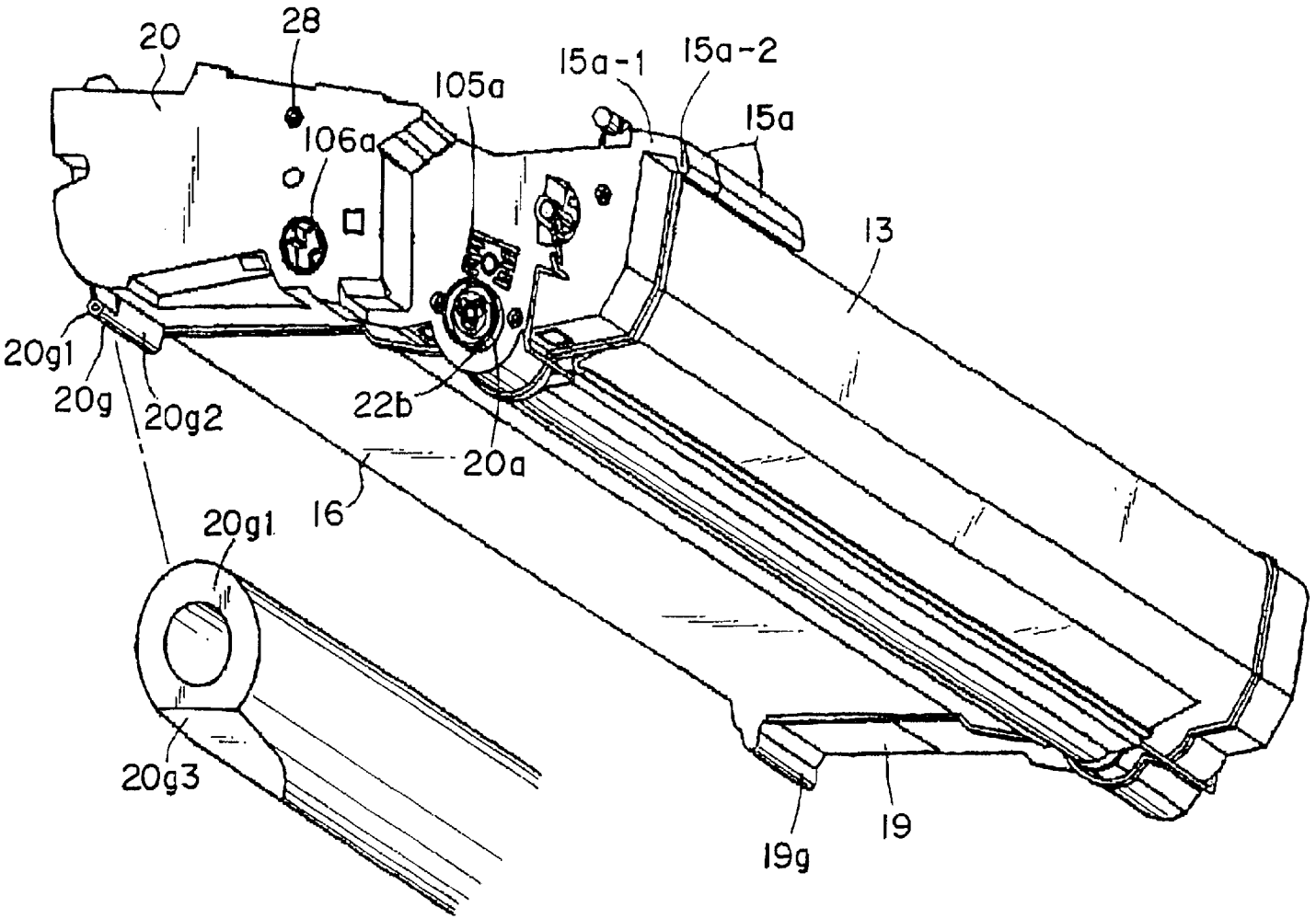
FIG. 6 is a perspective view of the process cartridge as seen from diagonally below the right side of the leading side, in terms of the direction in which the process cartridge is inserted into the main assembly of an image forming apparatus, of the process cartridge.
Figure 7:
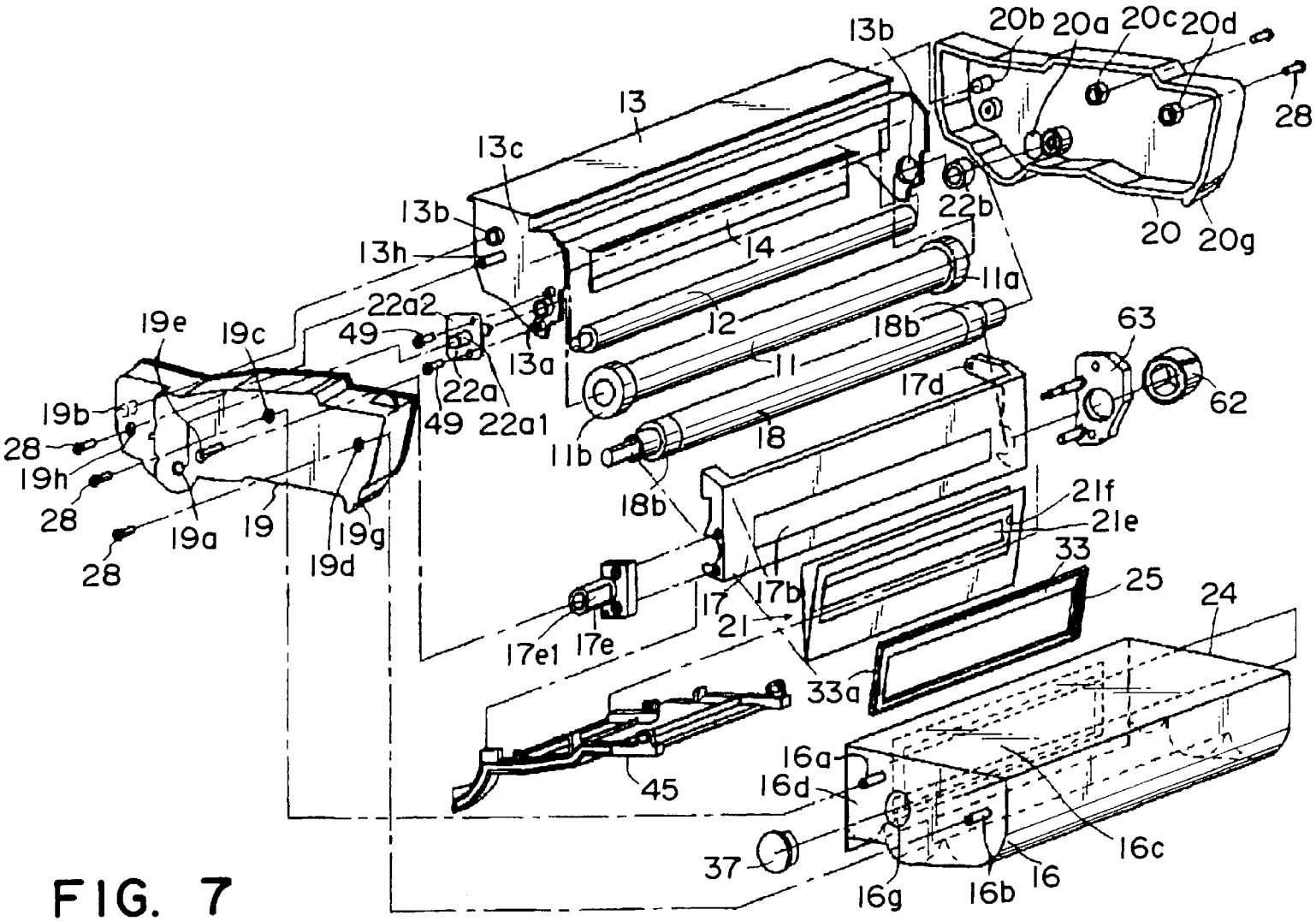
FIG. 7 is an exploded perspective view of the process cartridge.

FIGS. 3–9 are drawings for showing the structure of the process cartridge frame. FIG. 7 is a drawing of the process cartridge before its assembly. FIGS. 3–6 are drawings of the process cartridge after its assembly. The frame of the process cartridge 15 is made up of three frame portions; a cleaning means frame portion 13, a developing means frame portion 17, and a developer holding frame portion 16. The cleaning means frame portion integrally holds the photosensitive drum 11, charge member 12, and cleaning member 14. The developing means frame portion (which also may be referred to as development frame) integrally holds the development roller 18, and development blade (unillustrated in FIG. 7, but designated by a referential numeral 26 in FIG. 2). The developer holding frame portion 16 has a developer holding portion 16*h* for holding developer (hereinafter, "toner"). The developer holding frame portion 16 is provided with a bottom cover 45. Further, the process cartridge is provided with end covers 19 and 20. In order to keep these three frame portions connected, the end covers 19 and 20 are fixed to the opposing longitudinal ends of the cleaning means frame portion 13 and developer holding frame portion 16, to keep the cleaning means frame portion 13 and developer holding frame portion connected to each other, and the developing means frame 17 is attached to the cleaning means frame 13 Hereinafter, the frame portion which supports the photosensitive drum 11 may sometimes be referred to as a drum frame.

As described above, the process cartridge 15 has a bottom cover 45, which is located at a portion of the process cartridge 15, which will be below the development roller 18 as a developing member, and a development blade 26, after the mounting of the process cartridge 15 into the apparatus main assembly 27. The bottom cover 45 constitutes a portion of the external wall of the process cartridge 15. One of the longitudinal ends of the bottom cover 45 is connected to a rear end cover 19, and the other longitudinal end of the bottom cover 45 is connected to the front end cover 20.

Figure 3:
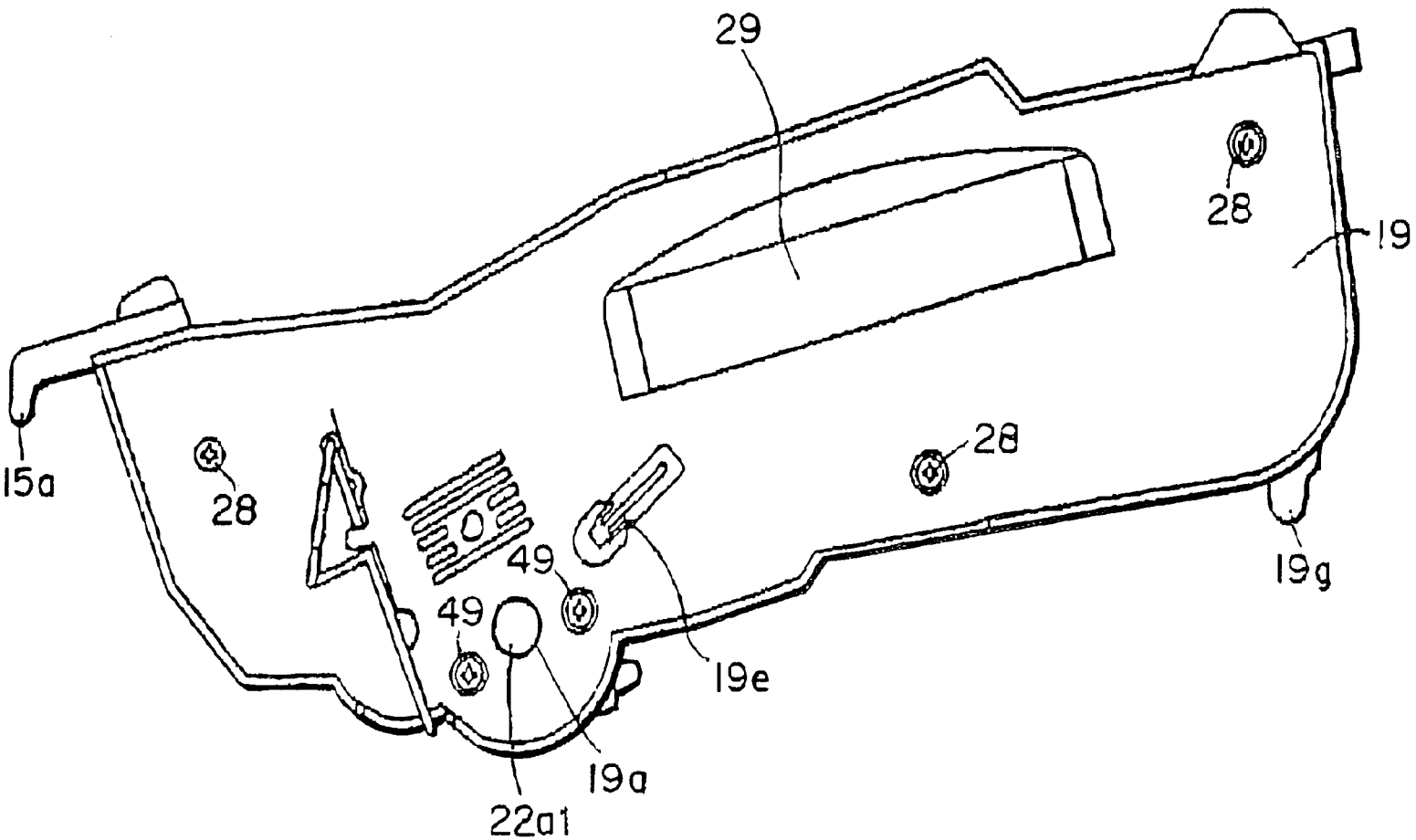
FIG. 3 is a front view of the process cartridge.

Referring to FIG. 3, the rear end cover 19 has a second handle 29, which is grasped by an operator when the process cartridge 15 is mounted into, or removed from, the apparatus main assembly 27, in a direction parallel to the longitudinal direction of the photosensitive drum 11. The provision of this second handle 29 makes it possible for the process cartridge 15 to be lowered into the designated cartridge position in the apparatus main assembly 27 after being approximately horizontally inserted all the way into the apparatus main assembly 27, or to be raised from the designated cartridge position so that it can be removed from the apparatus main assembly 27.

The rear end cover 19 has a hole 19*a*, through which a shaft portion or photosensitive drum supporting shaft 22*a*1, which doubles as the bearing for the photosensitive drum, projects outward of the rear end cover 19. The axial line of the hole 19*a* coincides with that of the shaft portion 22*a*1. The shaft portion 22*a*1 is a part of a load bearing member or photosensitive drum bearing 22*a,* which is supported by the cleaning means frame portion 13 to support one of the longitudinal ends of the photosensitive drum 11. The position of the shaft portion 22*a*1 relative to the apparatus main assembly 27 is becomes fixed as the process cartridge 15 is mounted into the apparatus main assembly 27. More specifically, as the process cartridge 15 is, first, approximately horizontally inserted all the way into the apparatus main assembly 27, and then is moved downward, the shaft portion 22*a*1 (positioning portion) settles into a positioning recess (which will be described later) of the apparatus main assembly 27. When the process cartridge 15 is inserted into, or pulled out of, the apparatus main assembly 27, the guide portions 19*g* and 20*g* of the process cartridge 15, which are also called the third guide 19*g* and second guide portion 20*g*, respectively are supported by the apparatus main assembly 27.

Referring to FIG. 5, the developer holding frame portion 16 has a first handle 30, which is located on the top surface of the developer holding frame portion 16. Incidentally, the top surface of the developer holding frame portion 16 is the surface of the developer holding frame portion 16, which will be the top surface of the developer holding frame portion 16 after the proper mounting of the process cartridge 15 in the apparatus main assembly 27. The first handle 30 is a handle which an operator grasps when the operator carries the process cartridge 15. This first handle 30 is structured to be retractable into a recess 16*e* in the top wall of the developer holding frame portion 16, being attached to the developer holding frame portion 16 by its base portions 30*a* with the use of a pair of pins (unillustrated), which are parallel to the longitudinal direction of the process cartridge 15, so that the first handle 30 can be kept stored in the recess 16*e*. When it is necessary to use the first handle 30, the first handle 30 is projected out of the recess 16*e* by being rotated about the pins.

Referring to FIGS. 2 and 5, the cleaning means frame portion 13 has an exposure opening 13*g*, which is the hole for allowing a light beam modulated with image formation information, to be projected onto the photosensitive drum 11 from the exposing apparatus 8 of the apparatus main assembly 27 after the mounting of the process cartridge 15 into the apparatus main assembly 27.

Figure 4:
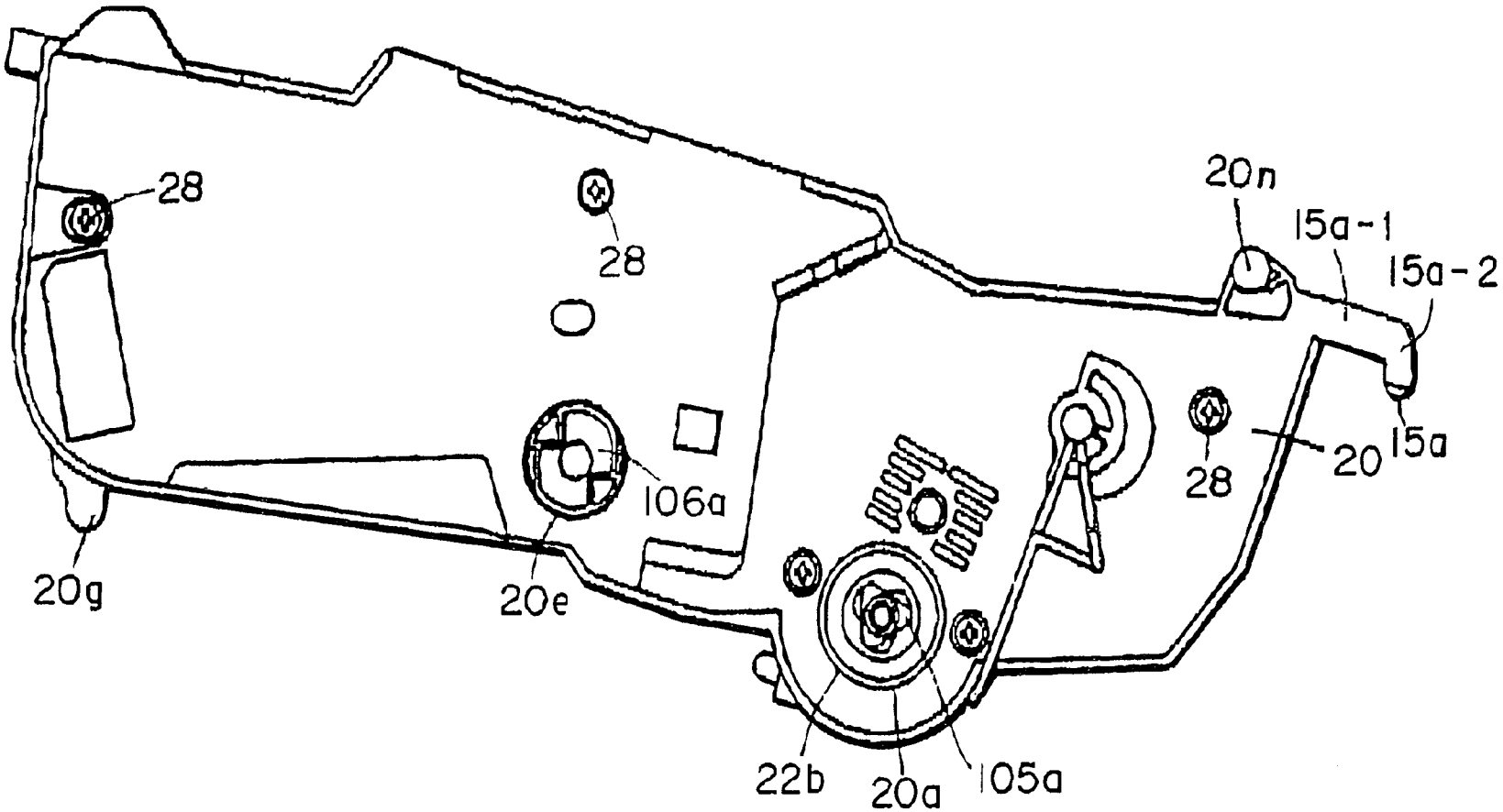
FIG. 4 is a rear view of the process cartridge.

Referring to FIGS. 4 and 7, the front end cover 20 has a first hole 20*a* and a second hole 20*e*. The first hole 20*a* is the hole in which a first coupling 105*a* of the process cartridge 15 is fitted. The first coupling 105*a* is a first portion which receives the photosensitive drum driving force from the apparatus main assembly 27 when the process cartridge 15 is in the apparatus main assembly 27. It is an integrally formed part of a flange 11*a* illustrated in FIG. 7. The flange 11*a* is fixed to one of the longitudinal ends of the photosensitive drum 11. Fitted in the second hole 20*e* is a second coupling 106*a*, which is a second portion which receives from the apparatus main assembly 27, the force for rotating stirring members 113, 114 and 123 (FIG. 2) when the process cartridge 15 is in the apparatus main assembly 27. The stirring members 113, 114 and 123 are members for sending the toner stored in the developer holding portion 16*h* of the developer holding frame portion 16, out of the developer holding portion 16*h*.

The details of the developing means frame portion 17 will be given later.

The end covers 19 and 20 are large enough to completely cover the correspondent longitudinal end surfaces of the process cartridge 15; the dimensions of the cross sections of the end covers 19 and 20, at a plane parallel to the main cross section (cross section at a plane perpendicular to the longitudinal direction of the photosensitive drum) of the process cartridge 15, match the dimension of the main cross section of the process cartridge 15. The end cover 19 is located at one of the longitudinal ends of the process cartridge 15, and the end cover 20 is located at the other. They extend across the entireties of the correspondent longitudinal end surfaces of the cleaning means frame portion 13 and developer holding frame portion 16, being fixed thereto to keep the cleaning means frame portion 13 and developer holding frame portion 16 integrally connected to each other.

Referring to FIG. 7, the end covers 19 and 20 are positioned so that the center lines of the holes 19*a* and 20*a* coincide with the axial line of the photosensitive drum 11 in the cleaning means frame portion 13. Also referring to FIG. 7, on the illustrated rear end cover 19 side, the load bearing member 22*a* is fitted in the hole 13*a* of the cleaning means frame portion 13, the bearing 22*a* is pressed into the hole 13*a*, and small screws 49 are screwed into the cleaning means frame portion 13 through the flange portion 22*a*2 of the load bearing member 22*a*. This load bearing member 22*a* is made up of the flange portion 22*a*2, and the shaft portion 22*a*1 which projects from the flange portion 22*a*2. The end portion of the shaft portion 22*a*1 is slid into the center hole of the flange 11*b* after being pressed through the hole 13*a*. The flange 11*b* is fixed to one of the longitudinal ends of the photosensitive drum 11; the flange 11*b* is fitted into one of the longitudinal ends of the photosensitive drum 11. Since the position of the rear end cover 19 relative to the cleaning means frame portion 13 is fixed with the use of the shaft portion 22*a*1 of the load bearing member 22*a*, which is located on the outward side of the load bearing member 22*a*, the position of the rear end cover 19 relative to the photosensitive drum 11 is accurately fixed. Further, a dowel-like positioning portion or projection 19*b* of the rear end cover 19, which is positioned as far away as possible from the photosensitive drum 11, is fitted in the positioning hole 13*b* provided in the side wall 13*c* of the cleaning means frame portion 13. With this arrangement, the position of the rear end cover 19 in terms of the rotational direction about the rotational axis of the photosensitive drum 11 is fixed. Then, the rear end cover 19 is fixed to the side wall 13*c*, that is, one of the longitudinal end walls, of the cleaning means frame portion 13.

The developer holding frame portion 16 has a pair of cylindrical positioning projections 16*a* and 16*b*, which project from the side wall 16*d*, that is, one of the longitudinal end walls, of the developer holding frame portion 16, in the longitudinal direction of the process cartridge 15. The positioning projections or portions 16*a* and 16*b* are fitted in the positioning portions or holes 19*c* and 19*d*, or the positioning holes 19*c* and 19*d*, of the rear end cover 19. With this arrangement, the position of the developer holding frame portion 16 relative to the rear end cover 19 is fixed. Then, the developer holding frame portion 16 and rear end cover 19 are fixed to each other. The position of the end cover 20, or the end cover on the other longitudinal end of the process cartridge 15, relative to the developer holding frame portion 16 and cleaning means frame portion 13 is also fixed, and then, is fixed to the developer holding frame portion 16 and cleaning means frame portion 13, in the same manner as the rear end cover 19. The position of the developing means frame portion 17 is fixed in the following manner. That is, a photosensitive drum bearing 22*b* is press-fitted into the hole 20*a* of the front end cover 20 in such a manner that a part of the bearing 22*b* projects from the outward surface of the front end cover 20. The bearing 22 (22*a* and 22*b*) also functions to fix the position of the process cartridge 15 relative to the apparatus main assembly 27. In other words, the bearing 22 is a member for fixing the position of the process cartridge 15, and is a cylindrical member.

(Method for Connecting, and Holding Together, Frame Portions)

The cartridge frame is mainly made up of the cleaning means frame portion 13, developer holding frame portion 16, developing means frame portion 17, and end covers 19 and 20.

Before the final assembly of the various portions of the cartridge frame, they are temporarily assembled. In this temporary assembly, the shaft portion 22*a*1 projecting from the cleaning means frame portion 13 is fitted into the hole

19*a* of the rear end cover 19, and the positioning portion 19*b* (cylindrical dowel-like projection) of the rear end cover 19 is fitted into the positioning hole 13*b* of the side wall of the cleaning means frame portion 13. Further, the positioning portions 16*a* and 16*b* of the side wall of the developer holding frame portion 16 are fitted into the positioning portions (holes) 19*c* and 19*d* of the rear end cover 19. Also on the front end cover side, the various portions of the front end cover 20, cleaning means frame portion 13, and developer holding frame portion 16, are engaged with their counterparts. As is evident from the above description, the aforementioned various portions of the cartridge frame can be temporarily assembled, and therefore, they are easier to handle before the final assembly, that is, before their permanent fixation relative to each other.

In the final assembly, the end cover 19 is fixed to the cleaning means frame portion 13, and the developer holding frame portion 16, by screwing the small screws 28 into the positioning portions 16*a* and 16*b* through the positioning portions 19*c* and 19*d*. Further, small screws 28 are screwed into the dowel-like projection 13*h* of the cleaning means frame portion 13 through the hole 19*h* of the rear end cover 19. Incidentally, the positioning portions 19*c* and 19*d*, and the hole 19*h*, are stepped holes, the outward sides of which are smaller in diameter. These smaller diameter sides of the holes are large enough in diameter to allow the small screws 28 to be put through them, but are smaller in diameter than the dowel-like positioning portions 16*a* and 16*b*. The way the cleaning means frame portion 13 and developer holding frame portion 16 are fixed to each other by the front end cover 20 is the same as the way the cleaning means frame portion 13 and developer holding frame portion 16 are fixed to each other by the rear end cover 19.

It should be noted here that as the means for fixing the end covers 19 and 20 to the cleaning means frame portion 13 and developer holding frame portion 16 to hold the cleaning means frame portion 13 and the developer holding frame portion 16 together, resin may be used. In such a case, the portions of the cleaning means frame portion 13 and the developer holding frame portion 16, and the portions of the end covers 19 and 20, by which the cleaning means frame portion 13 and the developer holding frame portion 16 and the end covers 19 and 20 are fixed to each other, are provided with resin flow paths during the formation of the cleaning means frame portion 13 and the developer holding frame portion 16, and the formation of the end covers 19 and 20. For the fixation, resin flows into these resin flow paths through the gate of a fixing jig, and then is solidified therein. The fixing jig is different from the jig used for the formation of the end covers 19 and 20, and is provided with a resin flow path which guides resin to the aforementioned resin flow paths. Also in such a case, the process cartridge 15 is placed in the above-described fixing jig after the temporary assembly of the process cartridge 15.

In order to deliver toner to the development roller 18 from he developer holding frame portion 16, the developer holding frame portion 16 and developing means frame portion 17 are provided with a toner outlet opening 16*c* (FIG. 2) and a toner inlet opening 17*b*, respectively. The developing means frame portion 17 and developer holding frame portion 16 are connected to each other, with the interposition of a flexible seal 21 (FIG. 7) as a sealing member between the two frame portions, in such a manner that the toner outlet opening 16*c* and toner inlet opening 17*b* align with each other. The position of the developer holding frame portion 16 is fixed relative to the end covers 19 and 20, and the position of the developing means frame portion 17 is fixed relative to the cleaning means frame portion 13. Therefore, a certain amount of gap should be provided between the developing means frame portion 17 and developer holding frame portion 16 to compensate for their dimensional errors. When mounting the process cartridge 15 into the apparatus main assembly 27, the process cartridge 15 is inserted into the apparatus main assembly 27, with the cleaning means frame portion side of the process cartridge 15 placed in contact with the cartridge guiding portions of the cartridge mounting space in the apparatus main assembly 27.

With the provision of the above described structure, the load generated by the toner falls on the end covers 19 and 20, being prevented from falling on the development roller 18 supported by the developing means frame portion 17. Therefore, even when a cartridge 15 with an increased developer capacity realized by increasing the volume of the developer holding portion 16*h* is employed, the increased load from the larger amount of developer does not fall on the photosensitive drum 11, making it possible to produce high quality images in spite of the employment of the cartridge 15 with an increased capacity.

(Method for Attaching Flexible Seal to Developing Means Frame Portion and Developer Holding Frame Portion)

In this embodiment, the interface between the developing apparatus D and developer holding frame portion 16 is sealed. More specifically, the flexible seal 21, as a sealing member folded in the form of a section of bellows is pasted to the developing apparatus D and developer holding frame portion 16. The flexible seal 21 is attached to the developer holding frame portion 16 with the interposition of a seal backing plate or member 33 as a member for backing the flexible seal 21. Although the thickness of the flexible seal 21 in this embodiment is no more than 1 mm, it may be more than 1 mm provided that material which does not reduce the flexibility of the bellows-like portion of the, flexible member 21 is selected as the material for the flexible seal 21.

Figure 10:
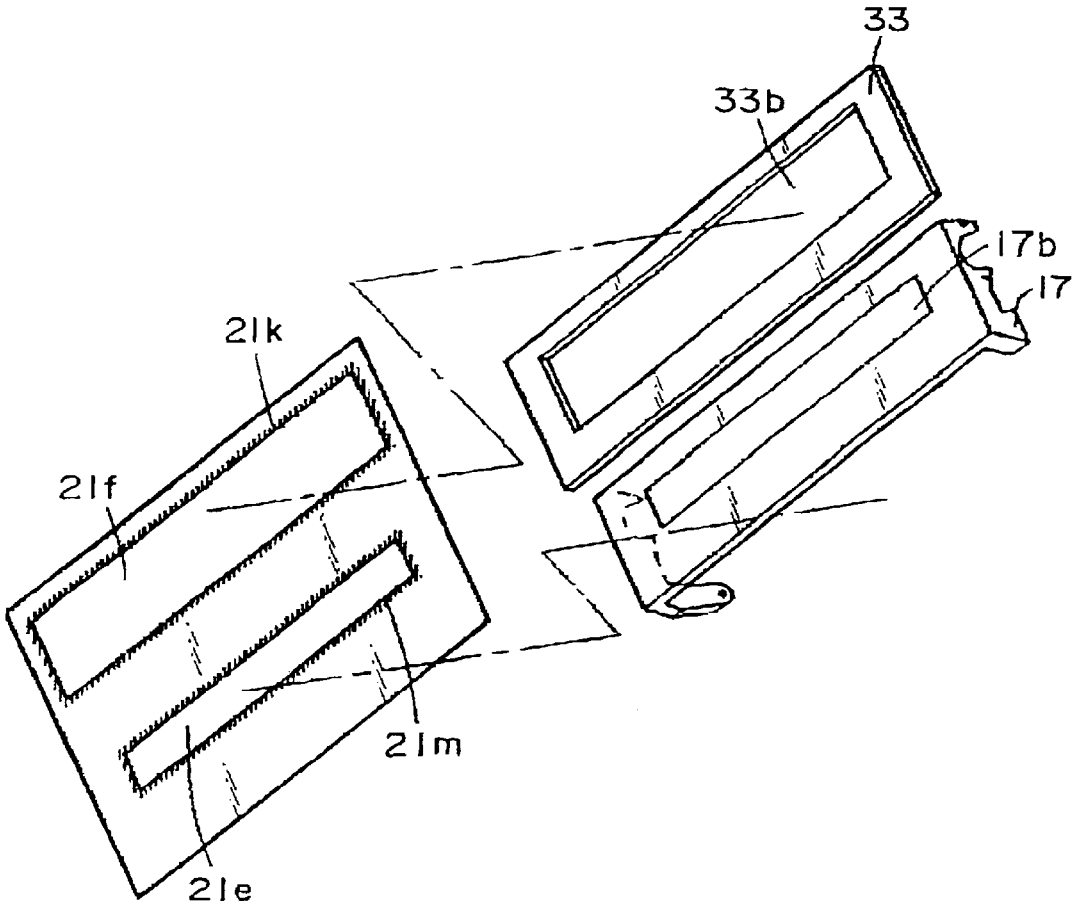
FIG. 10 is a perspective view of a flexible seal for sealing between the toner container and developing means frame.
Figure 11:
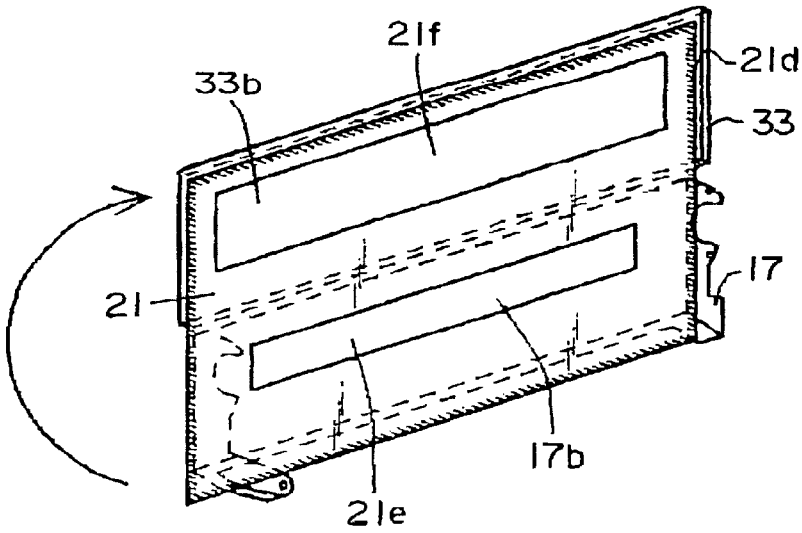
FIG. 11 is a perspective view of the flexible seal for sealing between the toner container and developing means frame.

Next, referring to FIGS. 10 and 11, a method for attaching the flexible seal 21 will be shown. Referring to FIG. 10, the flexible seal 21 has first and second openings 21*e* and 21*f*, the sizes of which match, or slightly exceed, the size of the opening 33*b* of the seal backing plate 33, and the size of the developer inlet opening 17*b* of the developing means frame portion 17.

The flexible seal 21 is attached to the seal backing plate 33 and developing means frame portion 17, by first and second adhesive margins 21*k* and 21*m*, that is, the surrounding edges (hatched portions in FIG. 10) of the opening 33*b* and developer inlet opening 17*b*, respectively. As a result, the first opening 21*e* of the flexible seal 21 is aligned with the developer inlet opening 17*b* of the developing means frame portion 17, forming a through hole, and the second opening 21*f* of the flexible seal 21 is aligned with the opening 33*b* of the seal backing member 33, forming a through hole, as shown in FIG. 11.

In the case of this embodiment, the flexible member 21 is attached to the developer holding frame portion 16, developing means frame portion 17, and seal backing member 33 with the use of thermal welding such as a heat sealing method or an impulse sealing method. However, ultrasonic welding, adhesive. adhesive tape, and the like may be used.

Next, referring to FIG. 11, after being pasted to the developing means frame portion 17 and seal backing member 33, the flexible seal 21 is folded over in the direction indicated by an arrow mark so that the developer inlet opening 17*b* and the opening 33*b* face each other, with the interposition of flexible seal 21, forming a bellows-like portion (pouch-like portion). As a result, one of the two halves of the peripheral edge 21*d* (hatched portion) of the flexible seal 21, which are divided at the folding line, is pressed upon the other half, and airtightly adhered thereto. Also in this case of adhering the two halves of flexible seal 21 together, the aforementioned thermal welding method such as ulrasonic welding, adhesive, or adhesive tape may be used.

Next, the seal backing member 33 is attached to the developer holding frame portion 16. In this process, a portion of the seal backing member 33 is not welded or adhered, in order to allow the passage of a developer seal.

Referring to FIG. 7, in this embodiment, the seal backing member 33 is welded or adhered to the developer holding frame portion 16 by a portion 33*a*, but not by the portions of the seal backing member 33, along which a toner sealing member 25 presses upon the developer seal 24. More specifically, the portion 33*a* is the peripheral edge portion of the seal backing member 33, which includes two long peripheral edges and one of the two short edges, of the seal backing member 33.

With the provision of the above described structural arrangement, in other words, since the flexible seal 21 as a sealing member is folded in the form of a pouch or bellows, even if the gap between the mutually facing surfaces of the developer holding frame portion 16 and developing means frame portion 17 varies, the resistance effected by the variation remains very small. Further, the placement of the flexible seal 21 between the seal backing plate 33 and developing means frame portion 17 allows the seal backing plate 33 to be attached in a manner to cover the developer seal 24, which in turn allows the toner sealing member 25 to be attached to the seal backing plate 33 in such a manner that the toner sealing member 25 seals the gap through which the developer seal 24 is passed. Therefore, toner leakage is prevented.

In addition, compared to a case in which a flat seal is simply, that is, flatly, pasted to the developer holding frame portion 16 to seal between the developer means frame portion 17 and developer holding frame portion 16, the employment of the seal backing member 33 allows the simplification of a welding board which is necessary for welding.

Further, the provision of the seal backing plate 33 in this embodiment makes it possible for the sealing member 21 to be attached to the developing means frame portion 17 in advance, making it easier for the developing means frame portion 17 and developer holding frame portion 16 to be joined with each other.

Next, a method for attaching the flexible seal 21 to the developing means frame portion 17 and developer holding frame portion 16 will be described.

In this embodiment, the flexible seal 21 is 0.1 mm in thickness. When the process cartridge 15 is in use, the flexible seal 21 is not laminar because the separation sheet is removed prior to the attachment of the flexible seal 21. Employment of non-laminated sheet as the material for the sealing member 21 makes it possible to realize a less rigid flexible member.

Figure 12:
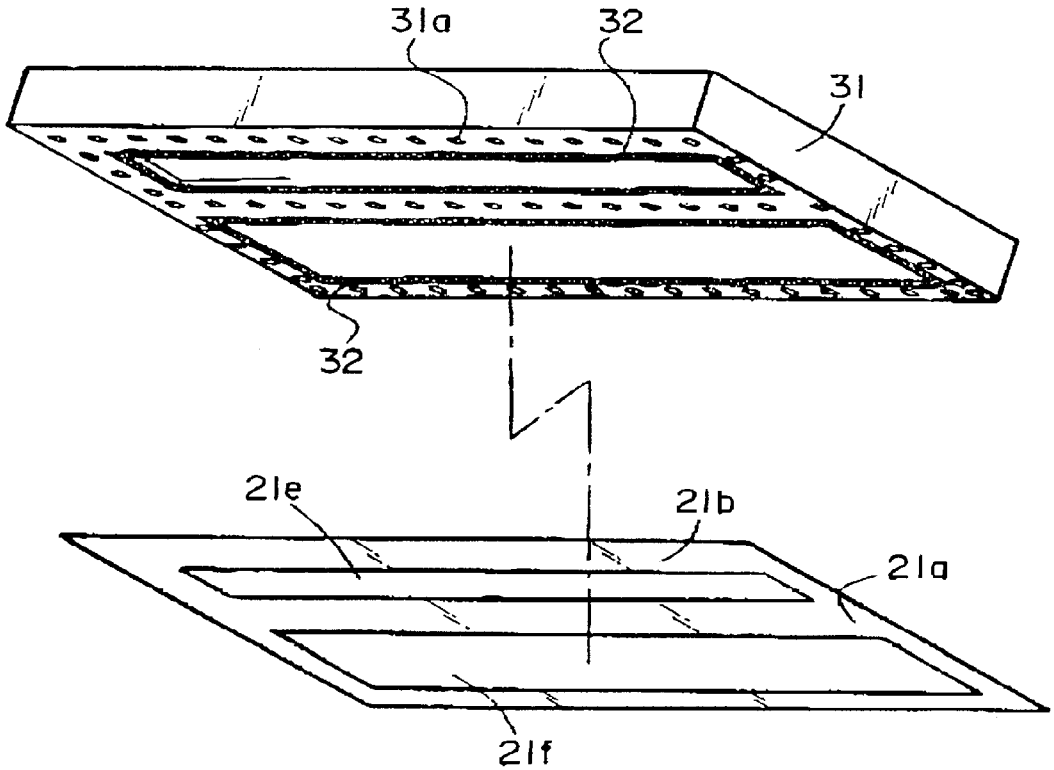
FIG. 12 is a perspective drawing for showing how the flexible seal is placed.

Referring to FIG. 12, the flexible seal 21 in this embodiment is made up of a flexible layer 21*a* and a separation layer 21*b*. The separation layer 21*b* is greater in rigidity than the flexible layer 21*a*. As for the material for the flexible layer 21*a*, PET (polyethyleneterephthalate), PP (polypropylene), ONy (biaxial oriented nylon), ester resin, ethylene-vinyl-acetate (EVA), polyurethane resin, polyester resin, olefin resin, and the like may be used.

Next, a method for forming the bellows-like shape will be described.

Figure 13:
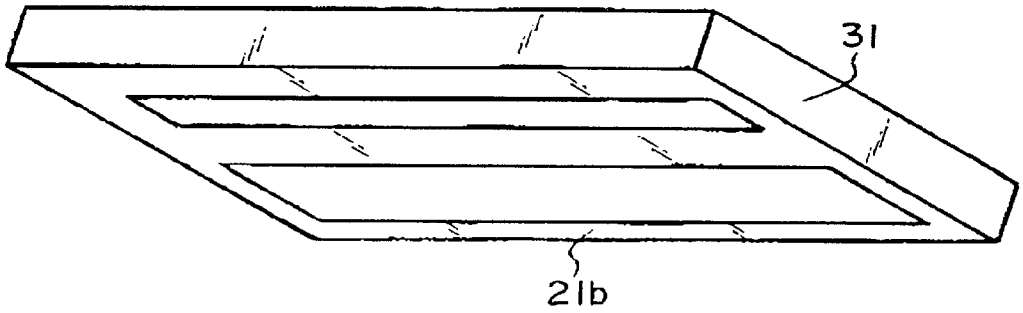
FIG. 13 is a perspective drawing for showing how the flexible seal is placed.
Figure 14:
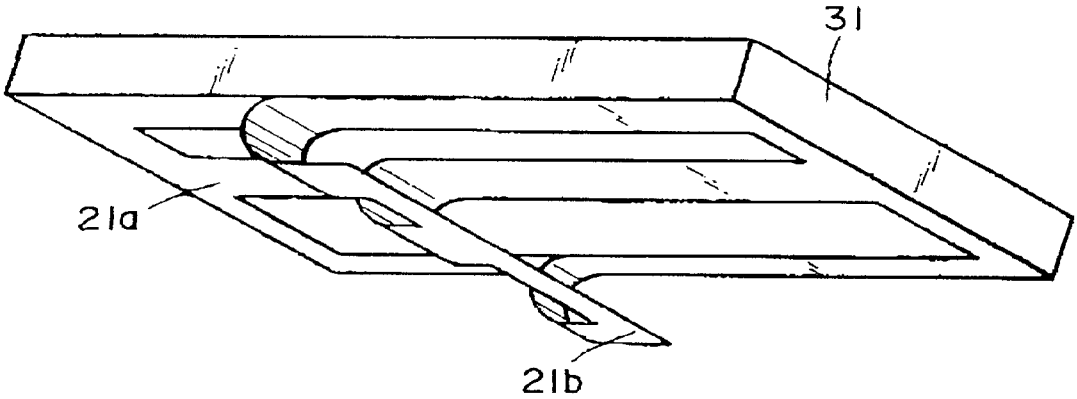
FIG. 14 is a perspective drawing for showing how the flexible seal is placed.

Referring to FIG. 12, a sealing member holding member 31 is provided with a plurality of orifices 31*a* for holding the sealing member 21 by suction. These orifices 31*a* are connected to an unillustrated vacuum pump. The flexible seal 21 is held to the sealing member holding member 31 by the suction provided through the orifices 31*a*, with the layer 21*a* facing the sealing member holding member 31, as shown in FIG. 13. Incidentally, the flexible seal 21 may be electrostatically held to the sealing member holding member 31 by charging the surface of the sealing member holding member 31. With the flexible seal 21 held to the sealing member holding member 31, the separation sheet 21*b*, or the second layer, of the flexible seal 21 is peeled away, leaving only the layer 21*a* (actual flexible seal 21) held to the sealing member holding member 31, a shown in FIG. 14.

Figure 15:
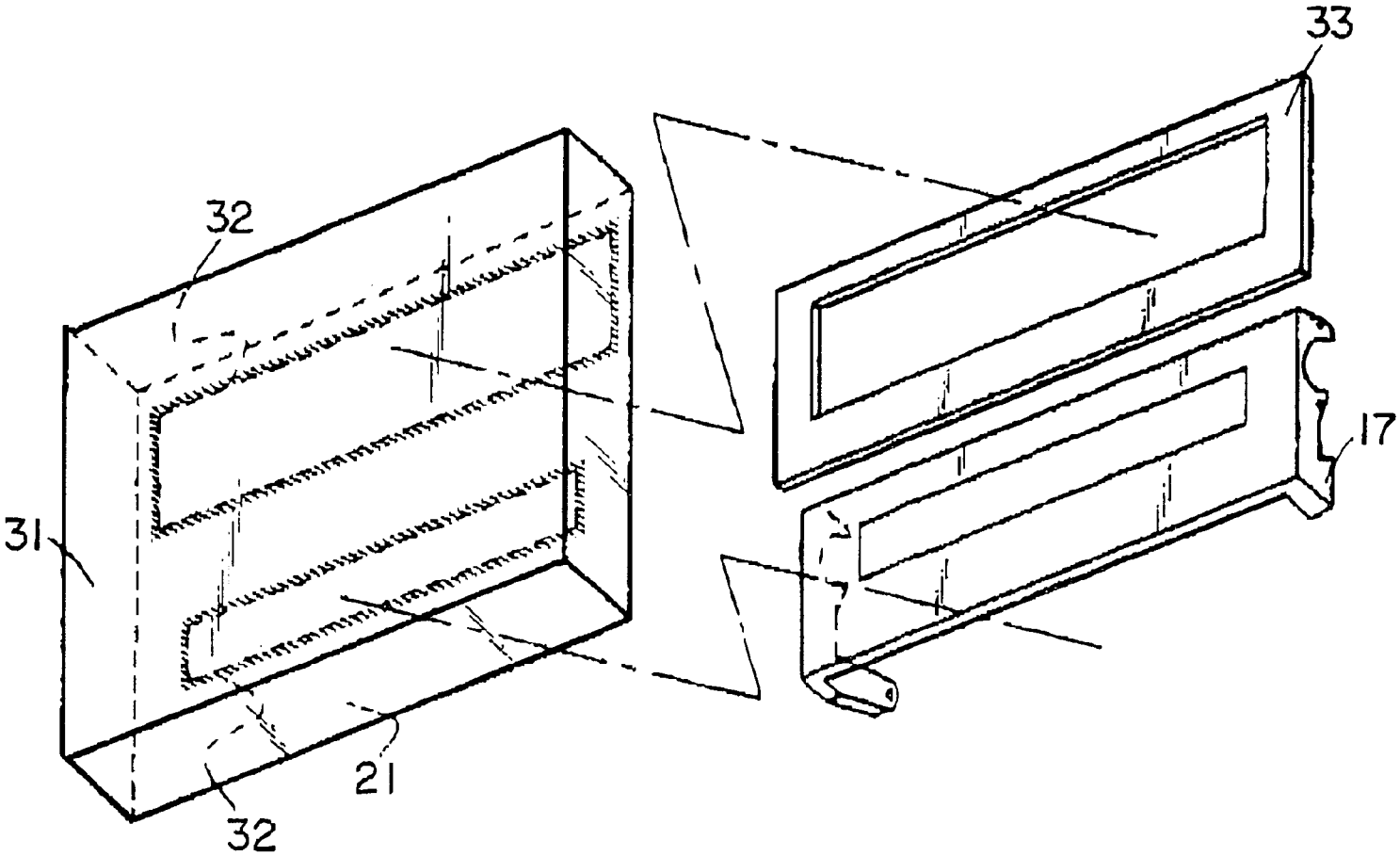
FIG. 15 is a perspective drawing for showing how the flexible seal is placed.

Also referring to FIG. 12, the sealing member holding member 31 is provided with a heating member 32 for impulse sealing. Next, referring to FIG. 15, first, the flexible seal 21 held to the sealing member holding member 31 is pressed upon the seal backing plate 33 and developing means frame portion 17, and then, electrical current is briefly flowed through the heating member 32 to heat the flexible seal 21. The heated flexible seal 21 is immediately cooled. As a result, the flexible seal 21 remains welded to the seal backing plate 33 and developing means frame portion 17. Thereafter, the vacuum is eliminated to release the flexible seal 21 from the flexible seal holding member 31, and the flexible seal holding member 31 is raised to separate it from the flexible seal 21 welded to the developing means frame portion 17 and seal backing plate 33. The seal backing plate 33 functions as a part of the developer holding frame portion 16. In other words, in practical terms, the opening 33*b* of the seal backing plate 33 constitutes the opening of the developer holding frame portion 16.

The flexible seal 21 is welded to the mutually facing surfaces of the seal backing plate 33 and developing means frame portion 17, being folded virtually in half, in a manner to surround the opening 33*b* of the seal backing plate 33 and the developer inlet opening 17*b* of the developing means frame portion 17.

Referring to FIG. 11, after being pasted to the developing means frame portion 17 and the seal backing plate 33, the flexible seal 21 is folded in the direction indicated by the arrow mark so that the first and second openings 21*e* and 21*f* face each other. As a result, the shape of the flexible seal 21 becomes like a section of bellows (pouch). Then, the peripheral edges 21*d* (hatched portions) of the two halves of the flexible seal 21, which are creased by the folding, are attached to each other. The flexible seal 21 may be folded at two more lines so that the folded portion of the flexible seal 21 resembles the bellows of an accordion.

In this embodiment, ester film is employed as the material for the layer 21*a* of the flexible seal 21. However, hot melt sheet such as EVA (copolymer of ethylene-vinyl-acetate) may be employed in place of ester film.

Also in this embodiment, the actual sealing layer 21*a* of the flexible seal 21 is formed of non-laminated sheet. Therefore, if a heat seal method, in which heating is continuous, is employed, the flexible seal 21 is liable to become welded to the heated portions. Thus, employment of an impulse sealing method, in which the heating process and cooling process can be carried out in succession in a short time, makes it possible to weld the intended portions of the flexible seal 21 to the intended portions of the counterparts.

Incidentally, an ultrasonic welding method which instantly generates heat, or adhesive or adhesive tape, which do not involve heating, may be employed in place of the aforementioned impulse sealing method.

As described above, the sealing layer 21*a*, or the actual sealing member, of the flexible seal 21 in this embodiment is supported by the separation layer 21*b*, or the separation sheet, which keeps the sealing layer 21*a* stabilized, and is removed after the adhesion of the sealing layer 21*a* to the sealing member holding member 31. Therefore, even the actual sealing layer 21*a*, which is too thin to be welded without being wrinkled, can be easily welded to the intended portions.

Further, the above described method for attaching the flexible seal 21 can be used when a laminar flexible seal is employed in place of the above described flexible seal 21.

Next, the seal backing plate 33 is attached to the developer holding frame portion 16. During this process, a part of the seal backing plate 33 is not adhered to the developer holding frame portion 16 to allow the passage of the developer seal 24.

Referring to FIG. 7, in this embodiment, the seal backing plate 33 is welded to the developer holding frame portion 16 by the portion 33*a*, leaving unwelded a predetermined portion of seal backing plate 33, across which the toner sealing member 25 presses upon the developer seal 24.

Figure 8:
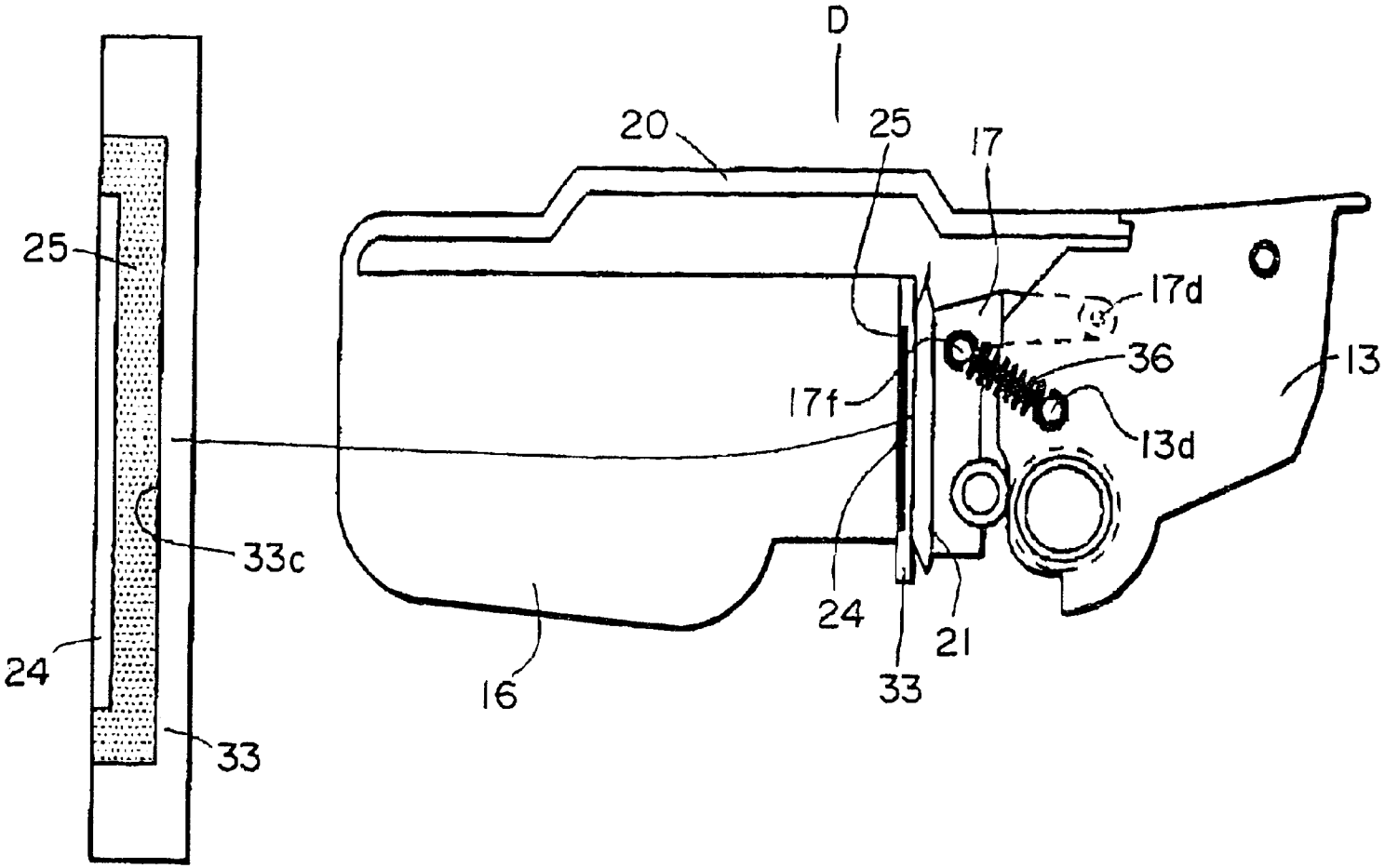
FIG. 8 is a schematic rear view of the process cartridge, with its side cover removed.

The toner sealing member 25 is an elastic member constituted of a narrow strip of felt or the like material. It is placed at the predetermined longitudinal end of the seal backing plate 33, in a manner to extend in the width direction of the process cartridge 15. It is pasted to the bottom surface of a recessed area 33*c* with which the seal backing plate 33 is provided (FIG. 8).

With the provision of the above described structural arrangement, in other words, with the provision of the flexible seal 21, which is constituted of a thin piece of flexible sheet, and has been folded into a bellows-like pouch, between the mutually facing surfaces of the developer holding frame portion 16 and developing means frame portion 17, even when the gap between the two surfaces changes, the resistance effected by the displacement of the developing means frame portion 17 is extremely small.

(Additional Embodiment of Sealing Member for Sealing between Developing Means Frame Portion and Toner Holding Frame Portion)

Figure 16:
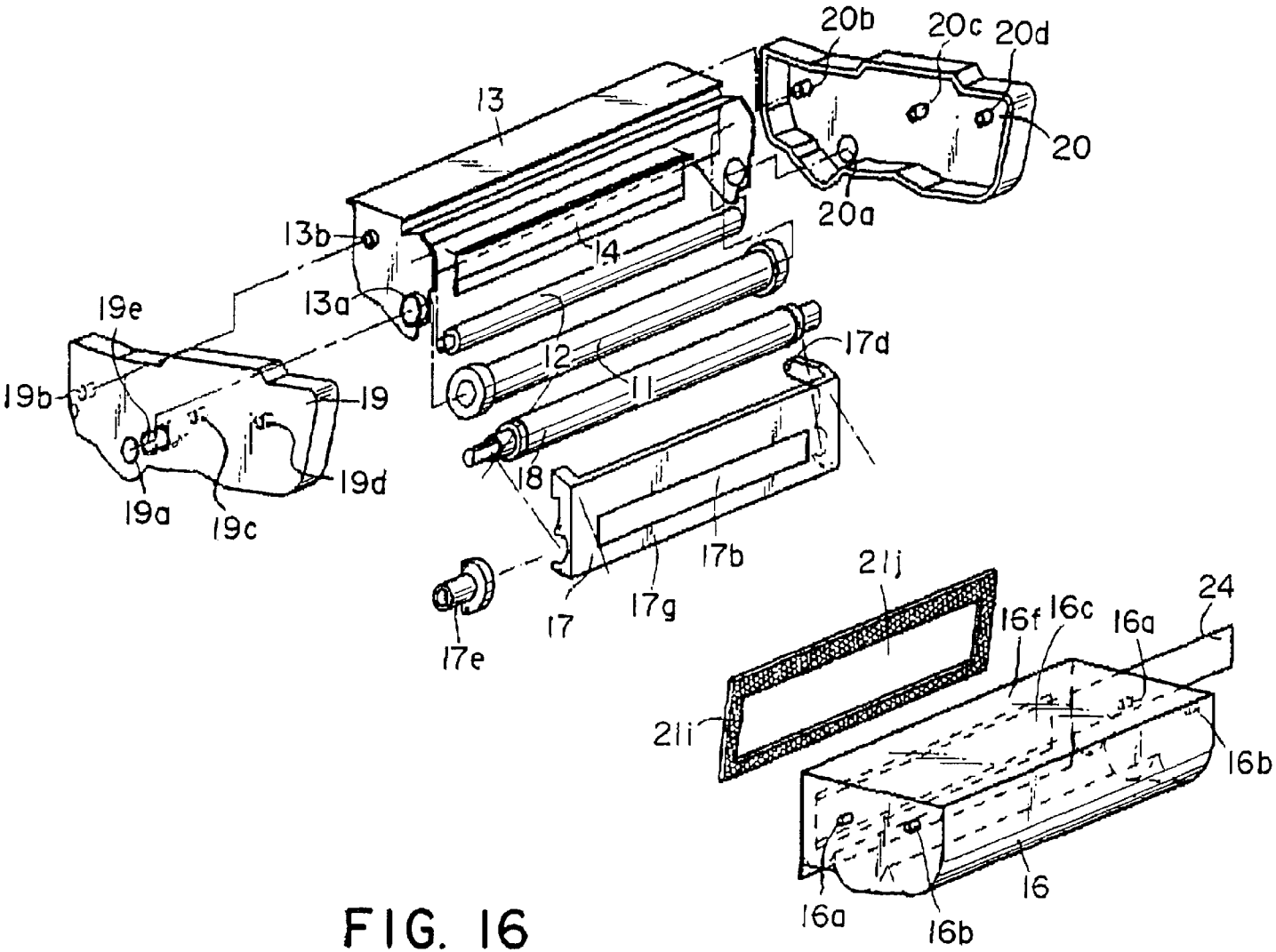
FIG. 16 is an exploded perspective view of the process cartridge, for showing the flexible seal for sealing between the toner container and developing means frame portion, in another embodiment of the present invention.

FIG. 16 is an exploded perspective drawing for describing an additional embodiment of the sealing member in accordance with the present invention. FIG. 16 is a simplified version of FIG. 7, and is different from FIG. 7 in the sealing member.

Figure 17:
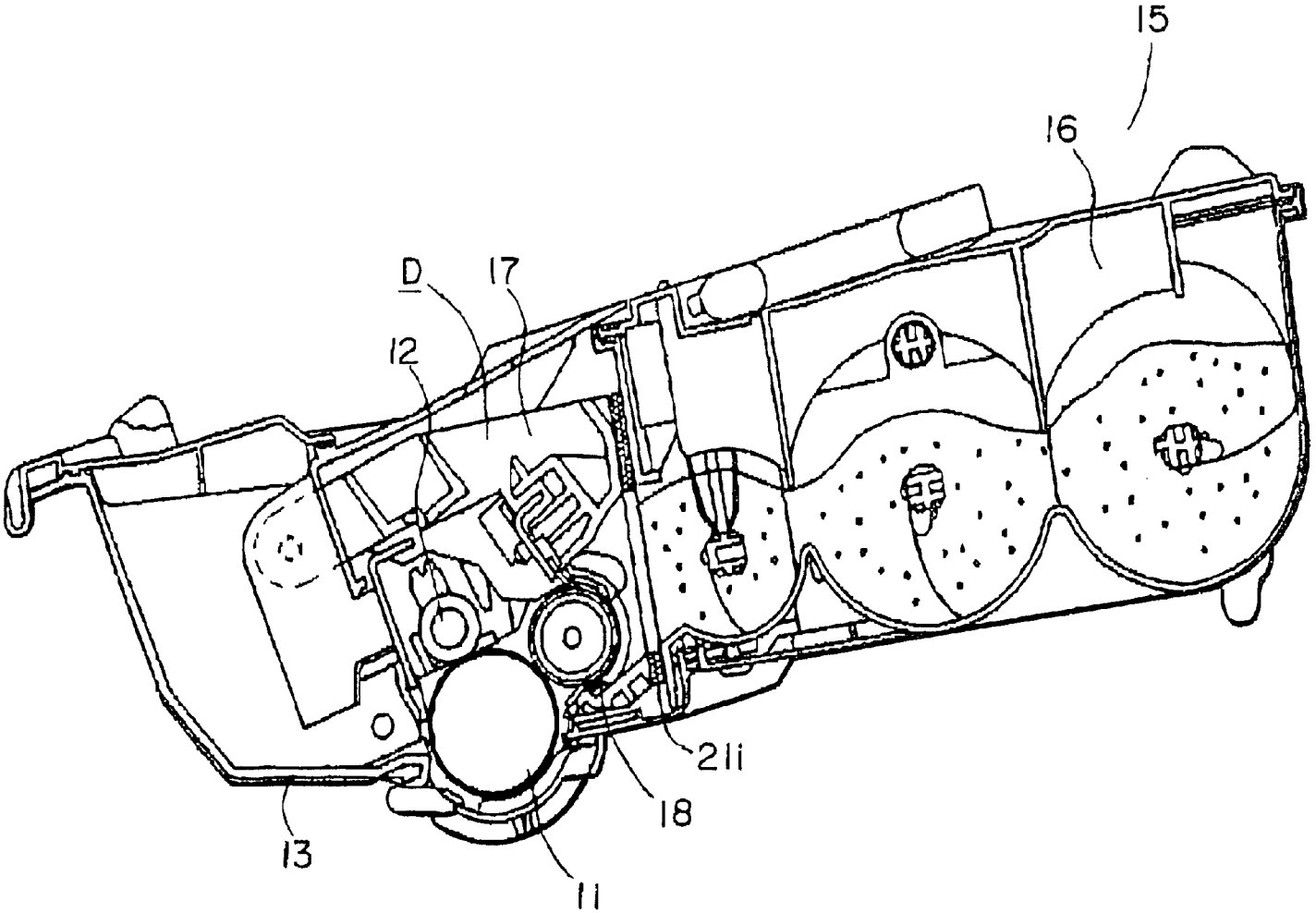
FIG. 17 is a vertical sectional view of the process cartridge in another embodiment of the present invention, for showing the flexible seal for sealing between the toner container and developing means frame portion.

FIG. 17 is a vertical sectional view of another version of a process cartridge in accordance with the present invention.

A sealing member 21*i* is a piece of thin and flat board of flexible material, for example, foamed synthetic resin such as foamed urethane, rubber with a low degree of hardness, silicone rubber, or the like. It is provided with an opening 21*j*. The position of the opening 21*j* is such that, after the attachment of the sealing member 21*i*, it matches the positions of the developer inlet opening 17*b* of the developing means frame portion 17 and the developer outlet opening 16*c* of the developer holding frame portion 16. The sealing member 21*i* is pasted to one or both of the mutually facing surfaces of the developing means frame portion 17 and developer holding frame portion 16, except across a predetermined area through which the developer seal 24 is pulled out.

The thickness of the sealing member 21*i* is greater than the post-assembly distance between the surrounding edge 17*g* of the developer inlet opening 17*b* of the developing means frame portion 17, and the surrounding edge 16*f* of the developer outlet opening 16*c* of the developer holding frame portion 16, which face each other.

Thus, in the assembled process cartridge 15, the sealing member 21*i* remains compressed by the developer inlet opening surrounding edge 17*g* of the developing means frame portion 17 and developer outlet surrounding edge 16*f* of developer holding frame portion 16, which face each other. The reactive force resulting from this compression of the sealing member 21*i* presses the spacer rings 18*b* of the developer roller 18 upon the photosensitive drum 11, and therefore, the resiliency of the sealing member 21*i* is desired to be as small as possible.

Employment of this sealing member 21*i* makes it possible to eliminate the seal backing plate 33 employed in the preceding embodiment, which in turn simplifies the assembly.

(Developer Seal)

The developer seal 24 is placed from one end to the other end of the developer outlet opening 16*c* of the developer holding frame portion 16 to seal the opening 16*c*, and then is doubled back all the way to the starting end of the opening 16*c*, with a small portion of it being extended beyond the starting end as shown in FIG. 7. The stirring members 113 and 114 are placed in the developer holding frame portion 16 prior to the placement of the developer seal 24. After the placement of the developer seal 24, toner is filled into the developer holding frame portion 16 through a toner filling opening 16*g*. After the filling of toner, a toner cap 37 is pressed into the toner filling opening 16*g*.

To sum up the description of the sealing member given above, the developing means frame portion 17 and developer holding frame portion 16 are connected to each other by the flexible seal 21, and the flexible seal 21 is pasted to the developing means frame portion 17 and seal backing plate 33.

The flexible seal 21 has two through holes: the first and second opening 21*f* and 21*e*. One side of each through hole faces the developer outlet opening 16*c* of the developer holding frame portion 16, with the interposition of the opening 33*b* of the seal backing plate 33, whereas the other side of the hole faces the developer inlet opening 17*b* of the developing means frame portion 17. The developer outlet opening 16*c* is a hole through which the toner stored in the developer holding portion 16*h* of the developer holding frame portion 16 is conveyed toward the development roller 18, that is, a developing member. The developer inlet opening 17*b* is a hole through which the toner is received after being conveyed through the developer outlet opening 16*c*, The flexible seal 21 is pasted to the seal backing plate 33 and developing means frame portion 17, by the surrounding edge of one side of its through hole and the surrounding edge of the other side, respectively, in terms of the depth direction of the through hole. The first and second openings 21*e* and 21*f* located at one side of the through hole and the other side of the through hole, respectively, in terms of the depth direction of the through holes face the developer inlet opening 17*b* of the developing means frame portion 17, and the developer outlet opening 16*c* of the developer holding frame portion 16, respectively, with the interposition of the opening 33*b* of the seal backing plate 33.

After being mounted, the flexible seal 21 is shaped like a simple paper bag and one of its opposing two halves of the flexible seal 21, which is comparable to the opposing two walls of a paper bag, has the first opening 21*f* and the other has the second opening 21*e*. The first opening 21*f* of the first half of the flexible seal 21 faces the developer outlet opening 16*c* of the developer holding frame portion 16, with the interposition of the opening 33*b* of the seal backing plate 33, whereas the second opening 21*e* of the second half of the flexible seal 21 faces the developer inlet opening 17*b* of the developing means frame portion 17. The developer outlet opening 16*c* is a hole through which the toner stored in the developer holding frame portion 16 with the developer holding portion 16*b* is conveyed toward the developer roller 18. The developer inlet opening 17*b* is a hole through which the toner is received after being conveyed through the developer outlet opening 16*c*. The flexible seal 21 is pasted to the seal backing plate 33 fixed to the developer holding frame portion 16, by the entirety of the surrounding edge of the first opening 21*f* of the aforementioned first half. Further, the flexible seal 21 is pasted to the developing means frame portion 17, by the entirety of the surrounding edge of the second opening 21*e* of the second half.

Also after being mounted, the flexible seal 21 has at least one folding line between the portion attached to the developing means frame portion 17 and the portion attached to the developer holding frame portion 16. Further, one side of the flexible seal 21 in terms of the direction perpendicular to the longitudinal direction of the process cartridge 15 is pasted to the seal backing plate 33 fixed to the developer holding frame portion 16, and the other side of the flexible seal 21 is pasted to the developing means frame portion 17. In other words, after being mounted, the flexible seal 21 is shaped like a section of bellows.

The flexible seal 21 is formed of elastic material or heat sealable material.

However, the flexible flat sealing member 21*i* in the second embodiment of the present invention, that is, a version of the flexible seal 21, is formed of foamed urethane, rubber with a low degree of hardness, silicone rubber, or the like.

(Structure of Developing Apparatus)

As described before, a tension spring 36 is stretched between the developing means frame portion 17 and cleaning means frame portion 13 (FIG. 8). This embodiment is a result of further development of the above described structure.

Figure 18:
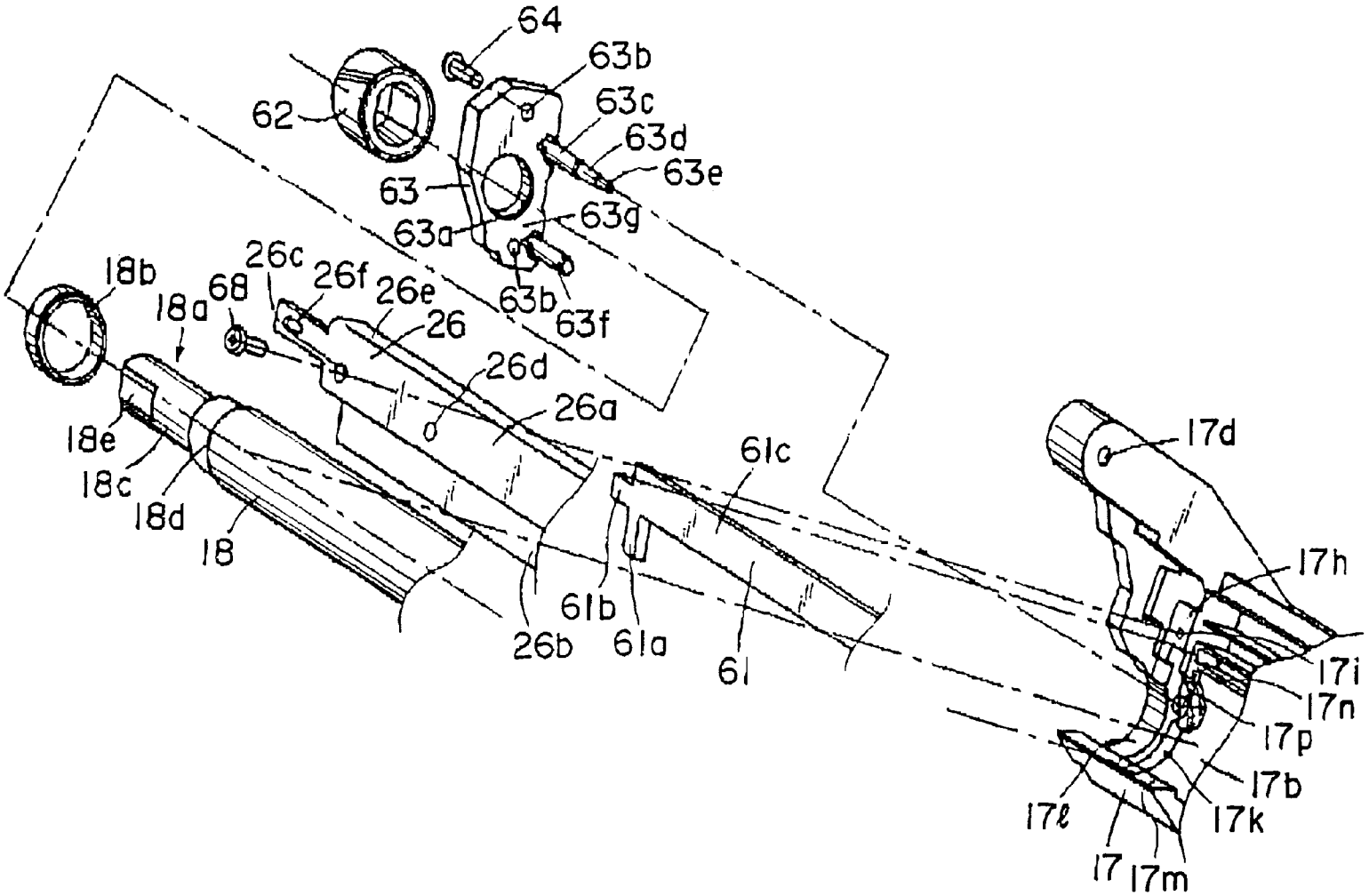
FIG. 18 is an exploded perspective view of the developing apparatus for showing the structure for keeping the developing means frame portion and cleaning means frame portion connected to each other.
Figure 19:
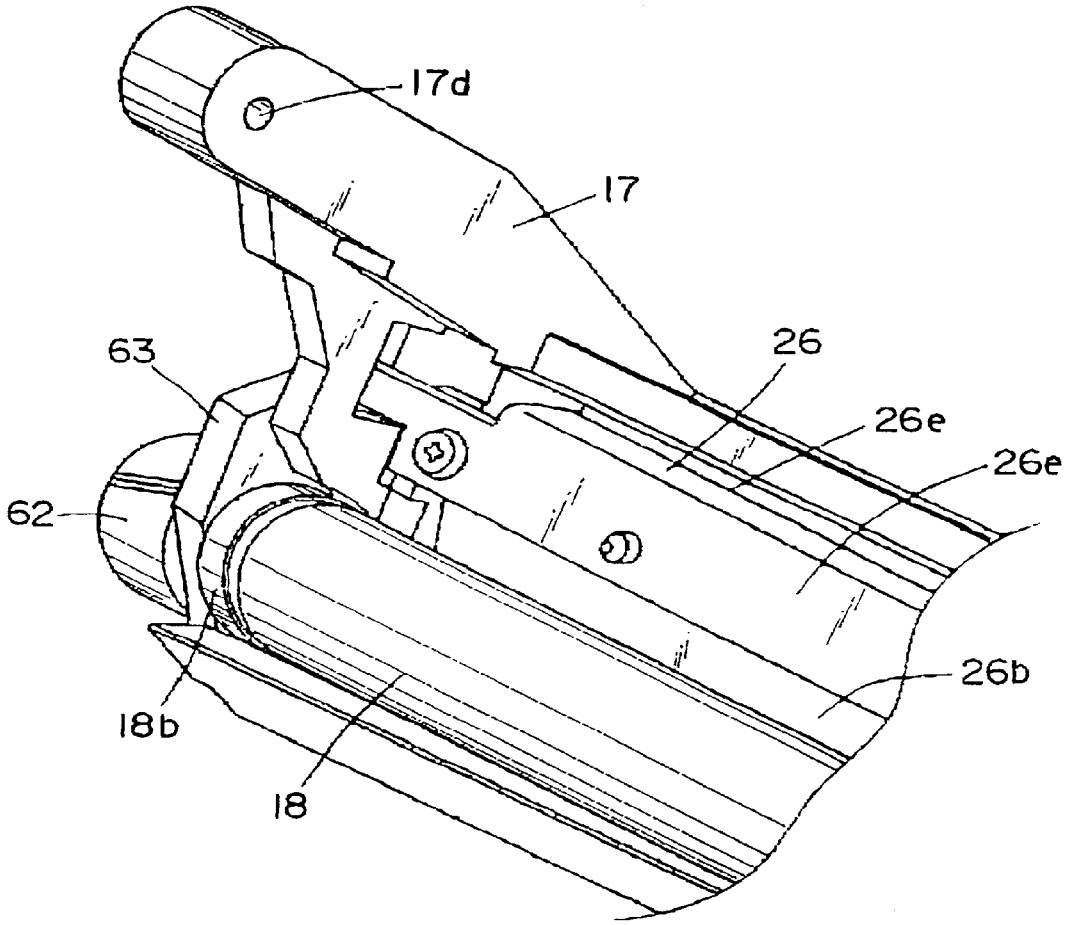
FIG. 19 is a partial perspective view of the developing means.

Next, referring to FIGS. 18 and 19, the structure of a developing apparatus will be described. FIG. 18 is a perspective view of the developing apparatus before its components are assembled into the process cartridge frame, and FIG. 19 is a perspective view of the developing apparatus after its components are assembled into the process cartridge frame. The developing means frame portion 17 contains the development roller 18, development blade 26, and the like, which are components directly related to image formation, and are assembled into the developing means frame portion 17. At this time, only the front end cover 20, that is, one of the end covers located one for one at the longitudinal ends of the developing apparatus, will be described. The rear end cover 19 located at the other longitudinal end of the developing apparatus is virtually the same in structure as the front end cover 20.

The development blade 26 comprises a metallic plate 26*a* with a thickness of 1–2 mm, and a piece of urethane rubber 26*b* fixed to the metallic plate 26 with the use of a hot melting method, double side adhesive tape, and the like. The amount of the toner on the peripheral surface of the development roller 18 is regulated as the urethane rubber piece 26*b* contacts the peripheral surface of the development roller 18 in such a manner that the interface between the urethane rubber piece 26*b* and the development roller 18 becomes parallel to the generatrix of the development roller 18. In some cases, silicone rubber is used as the material for the development blade 26. Referring to FIG. 18, the blade positioning surface 17*h*, as the blade anchoring portion, of the developing means frame portion 17, has a hole 17*i* with female threads, and a dowel-like projection (unillustrated) for blade positioning, which is located toward the center. The dowel-like projection (unillustrated) of the developing means frame portion 17 is fitted into the hole 26*d* of the metallic plate 26*a*. Then, a small screw 68 is screwed into the female-threaded hole 17*i* through the hole 26*c* of the metallic plate 26*a* to fix the metallic plate 26*a* to the flat surface 17*h*. As a result, the position of the free edge of the urethane rubber piece 26*b* is fixed, which in turn dictates the amount of the contact pressure generated between the development roller 18 and the urethane rubber piece 26*b* by the urethane rubber piece 26*b*. In other words, the distance from the free edge of the urethane rubber piece 26*b* to the contact position is fixed, which in turn dictates the development conditions. In order to increase the rigidity of the metallic plate 26*a* so that the contact between the urethane rubber piece 2*b* and the development roller 18 becomes uniform in terms of the longitudinal direction of the development roller 18, the long edge of the metallic plate 26*a*, which is not the long edge to which the urethane rubber piece 26*b* is attached, is bent 90 degrees, forming a bent edge 26*e*. The metallic plate 26*a* is long enough for one of its longitudinal ends to project from the developing means frame portion 17. The portion of the metallic plate 26*a* which projects from the developing means frame portion 17 is provided with a hole 26*f* through which a spring, which will be described later, is fitted.

The developing means frame portion 17 is provided with an elastic sealing member 61 for preventing toner from leaking out. The elastic sealing member 61 is formed of MOLT-PLANE, or the like, and looks somewhat like a reversely placed letter U. It is pasted to the developing means frame portion 17, across the entirety of the top edge (first straight edge 17*n*) of the developer inlet opening 17*b* and the entirety of the short edge (second straight edge 17*p*) of the developer inlet opening 17*b*. More specifically, the first and second straight portions 61*c* and 61*a* of the elastic sealing member 61 are pasted to the first and second straight edges 17*n* and 17*p* of the developer inlet opening 17*b* of the developing means frame portion 17, respectively. This elastic sealing member 61 is interposed between the developing means frame portion 17 and development blade 26, and is compressed by them to prevent toner from leaking out. This elastic sealing member 61 is long enough for one of its longitudinal ends to extend from the developing means frame portion 17 by several millimeters and form an earlobe-like portion. The role of this earlobe-like portion 61*b* is to contribute to the positioning of an unillustrated magnetic seal.

The developing means frame portion 17 is provided with a pair of grooves 17*k*, each of which extends from the corresponding longitudinal end of the developer inlet opening 17*b* to the bottom edge of the developing means frame portion 17, following the semicylindrical surface 17*l*, the curvature of which corresponds to the curvature of the peripheral surface of the development roller 18. In the groove 17*k*, a magnetic seal (unillustrated) is placed so that toner is prevented from leaking out along the peripheral surface of the development roller 18, by the magnetic force from the seal.

Further, a thin elastic sealing member (unillustrated) is pasted to the mandible-like portion 17*m* of the developing means frame portion 17, being placed in contact with the development roller 18 in parallel to the generatrix of the development roller.

The development roller 18 is a cylindrical member formed of metallic material such as stainless steel. It is approximately 16–20 mm in external diameter, and 0.5–1.0 mm in wall thickness. In order to improve the efficiency with which developer is charged, the surface of the development roller 18 is coated with carbon, is sandblasted, or is subjected to the like processes. In this embodiment, it is simply coated with carbon.

The development roller 18 is provided with a pair of sleeve flanges 18*a*, which are located at the longitudinal ends of the development roller 18, one for one (only one is illustrated). The sleeve flange 18*a* is formed of metallic material such as aluminum, stainless steel, or the like, and is pressed into the longitudinal end of the development roller 18. The sleeve flange 18*a* is a stepped cylindrical member, being made up of a first cylindrical portion 18*d* with a larger external diameter, and a second cylindrical portion 18*c* with a smaller external diameter compared to that of the first cylindrical portion 18*d*. The axial lines of both cylindrical portions coincide with that of the development roller 18. The first cylindrical portion 18*d* is fitted with a spacer ring 18*b*, or a member for regulating the distance (hereinafter, "SD gap") between the peripheral surfaces of the development roller 18 and photosensitive drum 11. The spacer ring 18*b* is formed of electrically insulative material such as polyacetal. The external diameter of the spacer ring 18*b* is greater than that of the development roller 18 by twice the SD gap. The second cylindrical portion 18*c* is put through a developer roller bearing 63 (FIG. 20, which is an enlarged perspective view of development roller 18, development roller bearing 63, and their adjacencies, as seen from the direction opposite to the direction from which they are seen in FIGS. 18 and 19) for fixing the position of the development roller 18 relative to the developing means frame portion 17 while rotationally supporting the development roller 18. The outward end portion 18*e* of the second cylindrical portion 18*c* is flatted; the peripheral surface of this outward end portion 18*e* consists of two opposing cylindrical surfaces and two opposing flat surfaces. Around this flatted outward end portion 18*e* of the second cylindrical portion 18*c*, a development roller gear 62 formed of synthetic resin is fitted, being prevented from rotating around the second cylindrical portion 18*c*, by the flatted outward end portion 18*e*. The development roller gear 62 receives driving force from a drum gear (unillustrated), which is a helical gear attached to one of the longitudinal ends of the photosensitive drum 11, and rotates the development roller 18. The direction of the helical teeth of the drum gear is such that the development roller 18 is thrust inward of the developing means frame portion 17 in terms of the longitudinal direction of the developing means frame portion 17. Within the development roller 18, a magnetic roll for adhering the toner to the peripheral surface of the development roller 18 is disposed (which is not illustrated in FIG. 18, but will be described later).

The development roller bearing 63 is formed of resin with a high degree of lubricity. It is a virtually flat member with a thickness of 2–5 mm. In the middle of the flat portion 63*g* of the development roller bearing 63, a cylindrical hole 63*a* with a bearing surface is located. This hole 63*a* with a bearing surface is 8–15 mm in diameter. The aforementioned second cylindrical portion 18*c* of the sleeve flange 18*a* is fitted in this hole 63*a* with a bearing surface, making the development roller 18 rotatable. Further, the flat portion 63*g* is provided with dowel-like projections made up of portions 63*c*, 63*d* and 63*e*, which are for fixing the position of the development roller bearing 63 relative to the developing means frame portion 17, and extend roughly in parallel to the hole 63*a* with a bearing surface the portions 63*d* and 63*e* of the dowel-like projection, which are the middle and tip portions of the dowel-like projection, and the axes of which coincide with the axis of the portion 63*c*, are used to fix the position of the magnetic seal. Further, the flat portion 63*g* is provided with a hole 63*b* with female threads, which is used for fixing the development roller bearing 63 to the developing means frame portion 17, with use of small screws 64 or the like more specifically, the portion 63*c* of the dowel-like projection of the development roller bearing 63 fits in an unillustrated hole located at one of the longitudinal ends of the developing means frame portion 17, whereas the portion 63*f* of the dowel-like projection of the development roller bearing 63 fits in an unillustrated elongated hole located at the same longitudinal end of the developing means frame portion 17. The flat portion 63*g* of the development roller bearing 63 meets the aforementioned longitudinal end of the developing means frame portion 17. Then, the small screws 64 are screwed into the female threaded holes of developing means frame portion 17 through the screw holes 63*b* of the development roller bearing 63. As a result, the development roller bearing 63 is fixed to the developing means frame portion 17, and therefore, the positional relationship between the development blade 26 fixed to the developing means frame portion 17, and the development roller 18, is accurately fixed for consistently outputting high quality images.

Since the bearing surface of the hole 63*a* of the development roller bearing 63 rotationally supports the sleeve flange 18*a* of the development roller 18, material high in slipperiness, which generally is higher in cost, is quite often employed as the material for the development roller bearing 63 (for example, polyphenylene-sulfide (PPS), or polyamide (PA)). One of the solutions to the high cost of the development roller bearing 63 is to divide the development roller bearing 63 into two pieces: a bushing portion, that is, the portion which actually rotationally supports the development roller 18, and a housing portion, and to use relatively inexpensive material such as highly impact resistance polystyrene (HIP) or the like as the material for the housing portion, so that the volume of the portion of the development roller bearing 63, which needs to be formed of costly material, can be reduced.

Within the development roller 18, a magnet (unillustrated) for adhering toner to the peripheral surface of the development roller 18 is contained.

The description given above concerns one of the longitudinal ends of the development roller 18, on the side from which the development roller 18 is driven. The longitudinal end of the development roller 18 on the other side will be described later.

(Structure for Supporting Development Apparatus)

Figure 20:
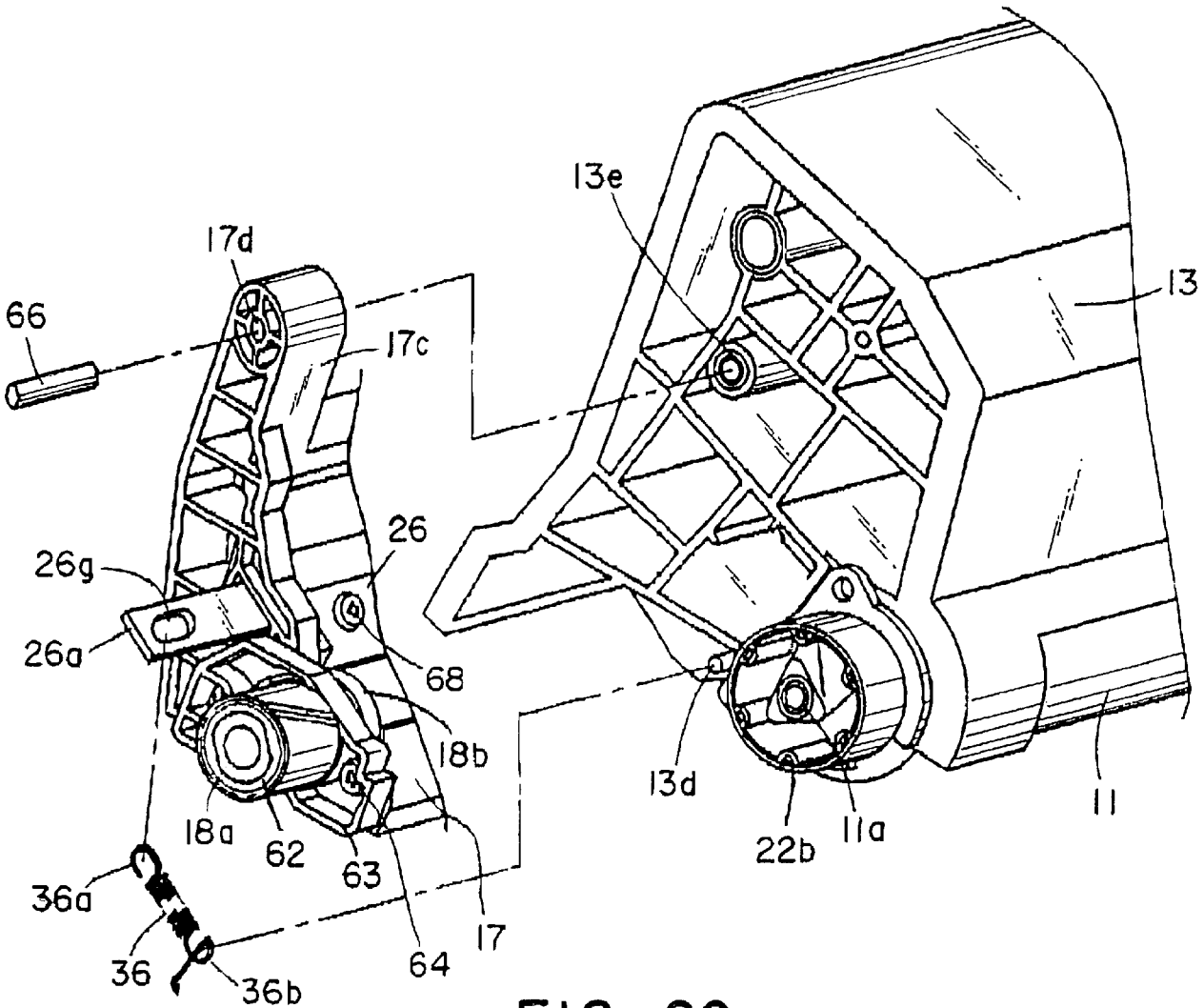
FIG. 20 is an exploded, perspective drawing for showing the structure for keeping the developing means apparatus and cleaning means frame portion connected.
Figure 21:
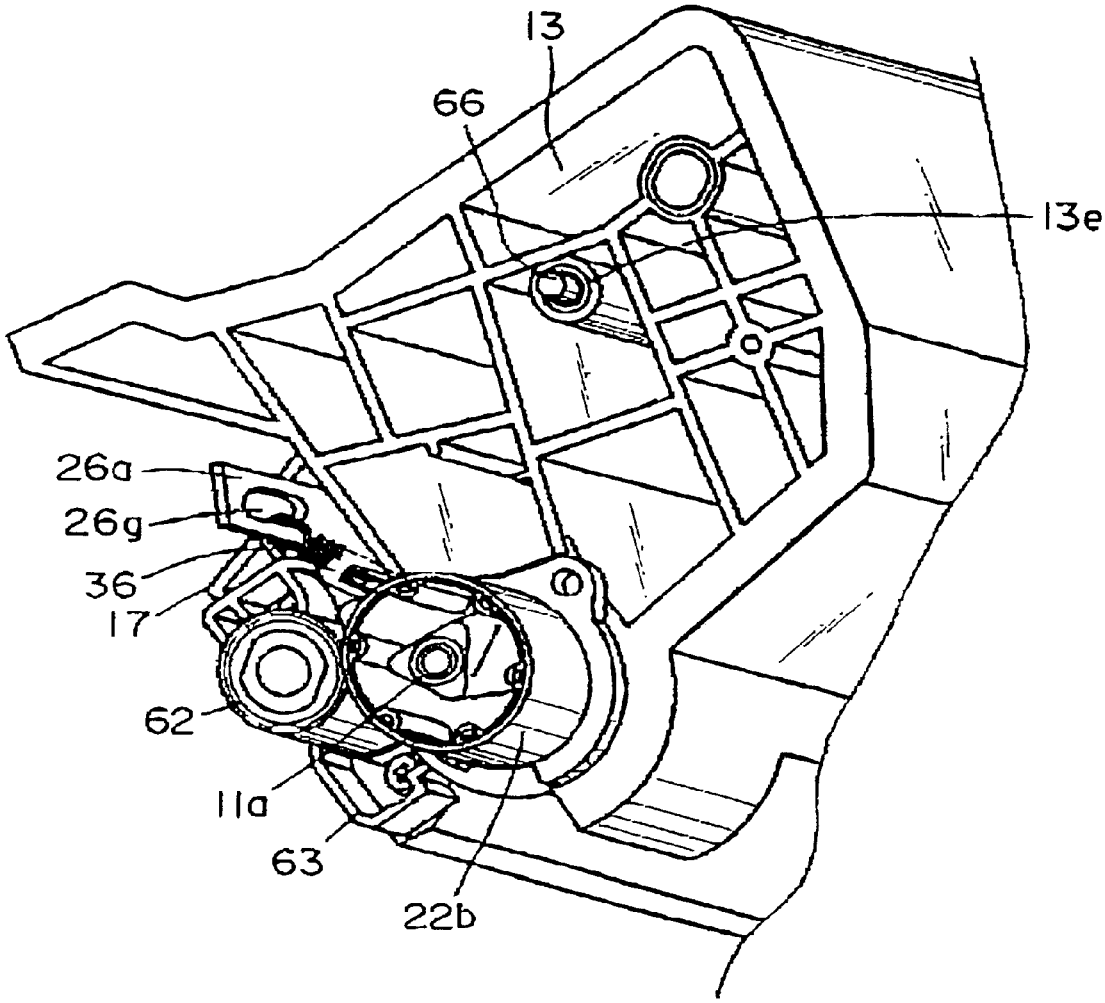
FIG. 21 is a perspective drawing for showing how the developing apparatus and cleaning means frame portion remain connected to each other.
Figure 22:
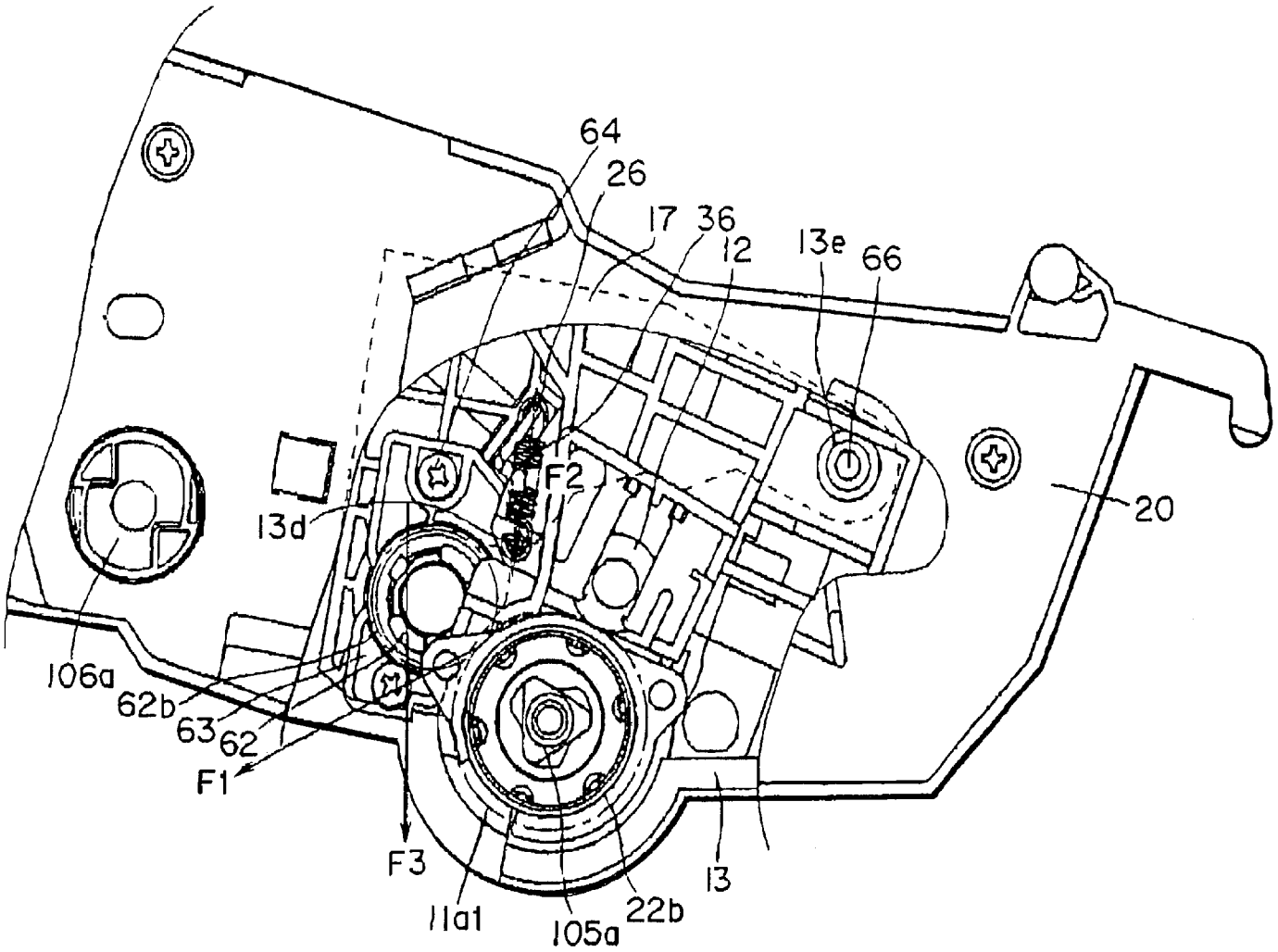
FIG. 22 is a rear view of the joint between the developing apparatus and cleaning means frame portion.
Figure 23:
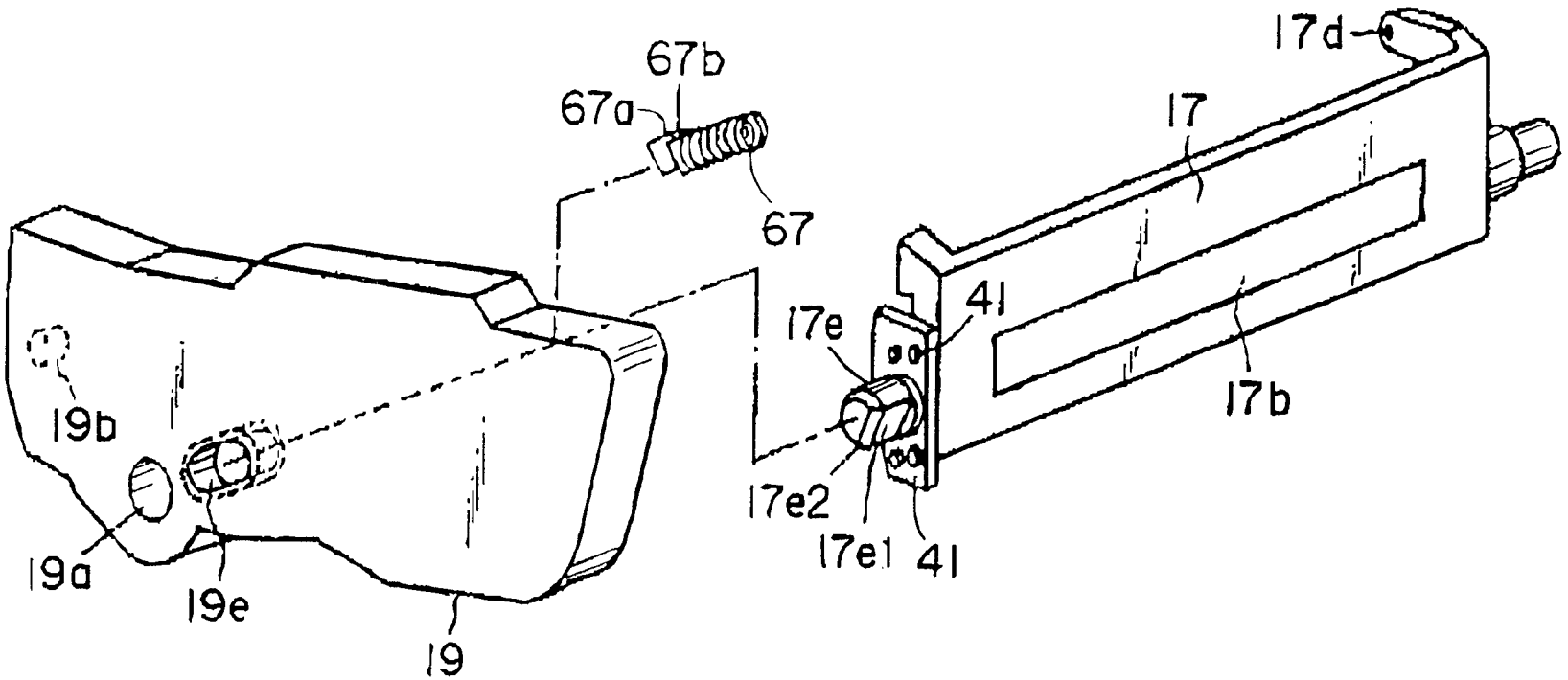
FIG. 23 is an exploded perspective drawing for showing the relationship between the developing means frame portion and side cover.

Next, referring to FIGS. 7, 20, 21, 22 and 23, the structure for supporting the developing apparatus will be described. FIG. 20 is a perspective drawing of the developing apparatus before the developing apparatus is supported by the cleaning means frame portion 13, as seen from the side from which the developing apparatus is driven (hereinafter, "driven side"). FIG. 21 is a perspective drawing of the developing apparatus which is being supported by the cleaning means frame portion 13, as seen from the driven side. FIG. 22 is an enlarged view of a portion of FIG. 4, with the end cover removed. FIG. 23 is a perspective view of the developing means frame portion and end cover, as seen from the side (hereinafter, "non-driven side") opposite to the side of the developing apparatus, before the assembly of the developing means frame portion 17.

As described before, in order to output images of optimum quality, an optimum amount of SD gap (gap between photosensitive drum 11 and development roller 18) must be maintained. For this purpose, the development roller 18 in this embodiment is kept pressed upon the photosensitive drum 11 with the application of an optimum amount of pressure (hereinafter, "D pressure") to maintain the optimum amount of SD gap (FIG. 2). In this case, the optimum amount of D pressure is in a range of 500 g–200 g at both the driven and non-driven sides. If the D pressure is in a range no more than this range, vibrations or the like cause the SD gap to widen, resulting in an image with white spots or the like. If it is in a range no less than this range, there are possibilities that the spacer rings 18*b* will be squashed by the D pressure (contact pressure between spacer rings 18 and photosensitive drum 11), resulting in a narrower SD gap, and in addition, that the load placed on the internal and peripheral surfaces of the spacer rings 18*b* by the D pressure will accelerate the shaving, or the like, of the spacer rings 18, making it impossible to maintain the optimum amount of SD gap. In this embodiment, the optimum amount of SD gap is maintained by adopting the following structure. Below, the supporting of the developing apparatus (method for maintaining SD gap) on the driven side, and that on the non-driven side, will be separately described.

Referring to FIGS. 20, 21 and 22, on the driven side, the developing means frame portion 17 and the cleaning means frame portion 13 are positioned so that the center axis of a hole 17*d* located at the end of the arc portion 17*c* of the development means frame portion 17 (frame portion in which the development roller, the development blade, and the like are contained) aligns with the center axis of a hole 13*e* of the cleaning means frame portion 13. Then, a parallel pin 66 is put through both the holes 17*d* and 13*e*. As a result, the developing means frame portion 17 is connected to the cleaning means frame portion 13 in such a manner that the rotational axis of the photosensitive drum 11, the rotational axis of the development roller 18, and the center axis of the parallel pin 66 are positioned in the same plane; the spacer ring 18*b* is placed in contact with the photosensitive drum 11; and the developing means frame portion 17 is allowed to pivot about the pin 66. Referring to FIG. 22, the pressure which keeps the driven side of the development roller 18 pressed upon the photosensitive drum 11 is generated by a combination of three forces: a force F1 which is applied to each tooth 62*b* of the development roller gear 62 (load which applies to the pitch point of each tooth, that is, the point of each tooth, which coincides with the transverse line of action); a force F2 generated by the tension spring 36 stretched between the cleaning means frame portion 13 and the developing apparatus; and a force F3, that is, the weight of the developing apparatus itself, which applies downward from the center of gravity of the developing apparatus. In other words, the developing apparatus is structured so that the three forces F1, F2 and F3 indicated in FIG. 22 generate such momentum that works to pivot the developing means frame portion in the counterclockwise direction about the pin (pivotal axle) 66. As a result, the development roller 18 is kept pressured upon the photosensitive drum 11. Further, the developing apparatus is structured so that the position of the pin 66, or the pivotal axle, becomes such that the line connecting the center of the interface between the photosensitive drum 11 and spacer ring 18*b* to the pivotal axis, or the center axis of the pin 66, and the direction of the force F1, forms a small angle of approximately 5 degrees. This structural arrangement is for preventing the large fluctuation of D pressure that results from the fluctuation of force F1 caused by torque fluctuations. Regarding weight F3 of the developing apparatus itself, the developing apparatus is structured so that the load from the developer does not fall on the developing apparatus D, and therefore, weight F3 is stable. Further, the tension spring 36 is positioned and supported so that the force generated by the tension spring 36 is not wasted, as will be described below, and therefore, force F2 is stable. Consequently, the value of the pressure D1, or the D pressure on the driven side, remains constant.

More specifically, referring to FIG. 20, the tension spring 36 is 0.5–1.0 mm in wire diameter. One end of the tension spring 36 forms a hook 36*a* and the other end forms a hook 36*b*. These hook portions 36*a* and 36*b* are used for anchoring the tension spring 36 to the apparatuses. As the material for the tension spring 36, resilient material such as SUS, piano wire, phosphor bronze, or the like, is used. The hook 36*a* of the tension spring 36 is put through the hole 26*g* of the metallic plate 26*a* of the development blade 26, and the hook 36*b* is put around the axle-like spring anchoring projection 13*d* of the cleaning means frame portion 13. The hole 26*g* of the development blade 26 is in such a portion of the development blade 26 that is projecting from the developing means frame portion 17. The hole 26*g* is 2–5 mm in width and 4–8 mm in length. The spring anchoring projection 13*d* of the cleaning means frame portion 13 is located near the photosensitive drum 11, and is 2–5 mm in diameter. It is one of the integral parts of the cleaning means frame portion 13. The hole 26*g* and spring anchoring projection 13*d* are positioned so that the line connecting the hole 26*g* and the spring anchoring projection 13*d* of the cleaning means frame portion 13 becomes roughly perpendicular to the line connecting the hole 26*g* and the pivotal axle (66). Since the tension spring 36 is hung on the development blade 26, it is unnecessary to provide the developing means frame portion 17 itself with such a spring anchoring projection, in the form of an axle or the like, that projects from the developing means frame portion 17. Therefore, the shapes of the walls of the developing means frame portion 17 at both longitudinal ends are simple, which in turn makes it easier for the cartridge frame to be placed in the flexible seal attachment jig to attach the flexible seal to the developing means frame portion 17, resulting in drastic improvement in assembly efficiency. Further, the attachment of the tension spring 36 to the development blade 26 means that the tension spring 36 is attached to a metallic component which is high in rigidity. Therefore, it does not occur that the D pressure is reduced by the deformation or the like of the spring anchoring projection 13*d* traceable to the force of the tension spring 36. Further, if the dowel-like spring anchoring projection 13*d* is to be provided as one of the integrally formed parts of the developing means frame portion 17, it is necessary for the spring anchoring projection 13*d* to be increased in size to prevent the D pressure loss which is liable to be caused by the deformation of the spring anchoring projection 13*d*. In this embodiment, however, the developing means frame portion 17 does not need to be provided with the dowel-like spring anchoring projection 13*d*, and the absence of the dowel-like anchoring portion leads to spacial efficiency.

Referring to FIG. 23, the non-driven side of the developing means frame portion 17 has a connecting member 17*e*, which is such a portion of the developing means frame portion 17 that projects in the longitudinal direction of the development roller 18, and the axial line of which coincides with that of the development roller 18. The developing means frame portion 17 is structured so that the connecting member 17*e* is kept pressured toward the axial line of the photosensitive drum 11. The connecting member 17*e* also doubles as the bearing for supporting the non-driven side of the development roller 18.

Next, referring to FIGS. 7 and 23, the structure involved in the generation of the D pressure on the non-driven side will be described. The non-driven side of the developing means frame portion 17 has the connecting member 17*e* which is fixed to the developing means frame portion 17, and projects in the longitudinal direction of the development roller 18. The axial line of the connecting member 17*e* is in alignment with that of the development roller 18. The developing means frame portion 17 is structured so that the connecting member 17*e* is kept pressured toward the photosensitive drum 11. The connecting member 17*e* is fixed to the developing means frame portion 17 with the use of screws. Referring to FIG. 23, the connecting member 17*e* is placed in a groove 19*e* (in this embodiment, elongated hole which extends approximately in the diameter direction of the photosensitive drum 11) of the rear end cover 19, being allowed to move in the diameter direction of the photosensitive drum 11. In the groove 19*e*, an elastic member 67 is placed, on the side opposite to the photosensitive drum 11 with respect to the connecting member 17*e*, so that the connecting member 17*e* is kept pressured by the pressing member 67*a*. The elastic member 67 is a compression coil spring, and is 0.5–1.0 mm in wire diameter. The force which this spring generates constitutes the source of the contact pressure D2 between the development roller 18 and the photosensitive drum 11, on the non-driven side. In other words, the amount of the contact pressure between the development roller 18 and the photosensitive drum 11, on the non-driven side, is dictated by the resiliency of the elastic member 67 alone, and therefore, is stable. Not only does this groove 19*e* support the connecting member 17*e*, but it also regulates the moving direction of the development roller 18. The groove 19*e* is formed narrower on the bottom side, or the deeper end of the groove 19*e* as seen from the inward side of the rear end cover 19, that is, the outward side of the rear end cover 19, to prevent the pressing member 67*a* from coming out of the process cartridge 15, from the aforementioned bottom side of the groove 19*e*.

The flat surface 67*b* of the pressing member 67*a* is in contact with the elastic member 67. The flat surface 67*b* is perpendicular to the pressing direction of the elastic member 67. The surface of the pressing member 67, on the side opposite to the flat surface 67*b*, is also a flat surface, and is parallel to the flat surface 67*b*, being in contact with the flat portion 17*e*1 of the connecting member 17*e*. This flat portion 17*e*1 is the portion of the connecting member 17 by which the connecting member 17 is pressed by the elastic member 67.

(Description of Coupling Members)

Figure 24:
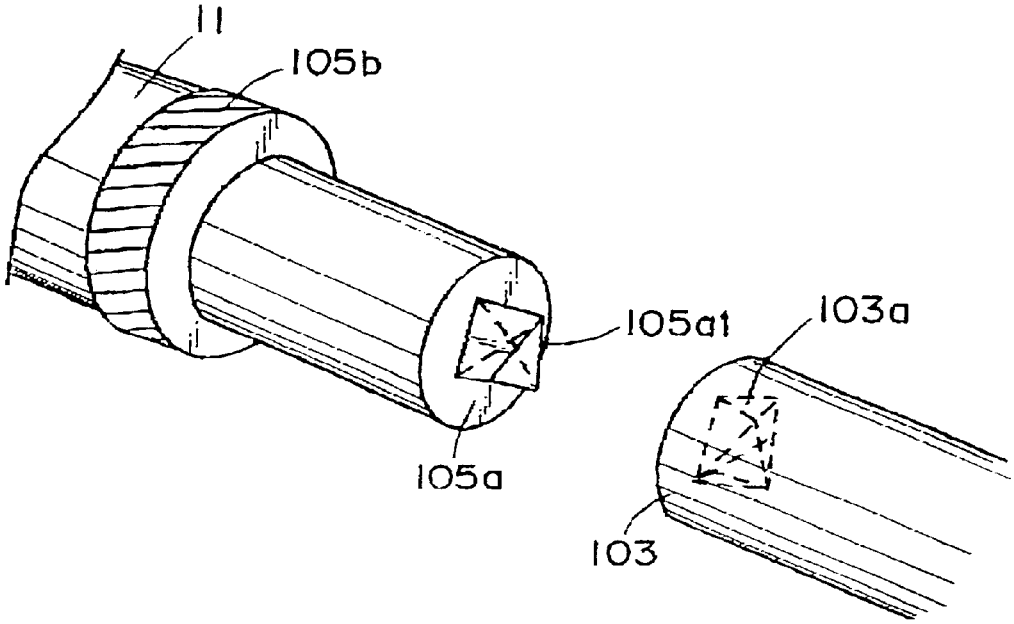
FIG. 24 is a perspective drawing of the couplings for driving the photosensitive drum.
Figure 25:
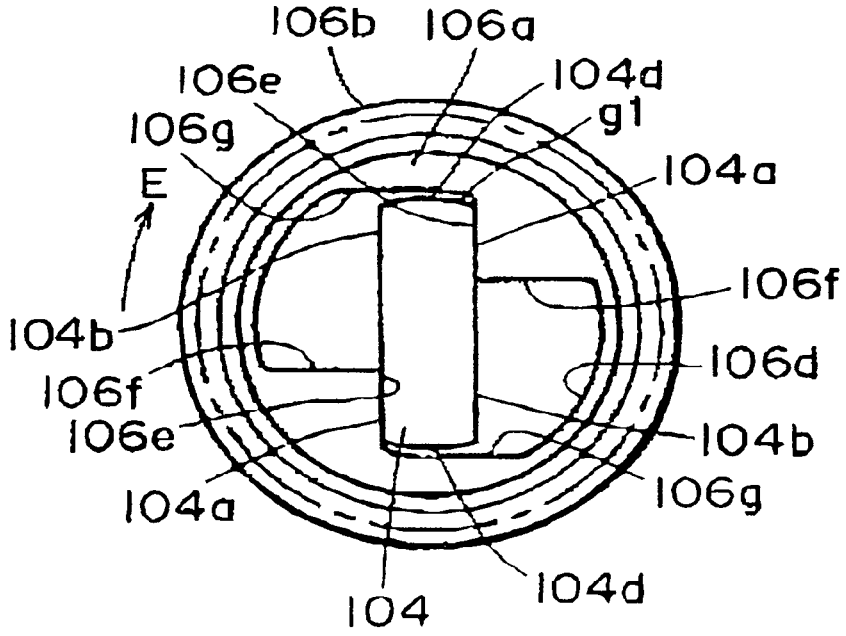
FIG. 25 is a rear view of the couplings for driving the stirring members.
Figure 26:
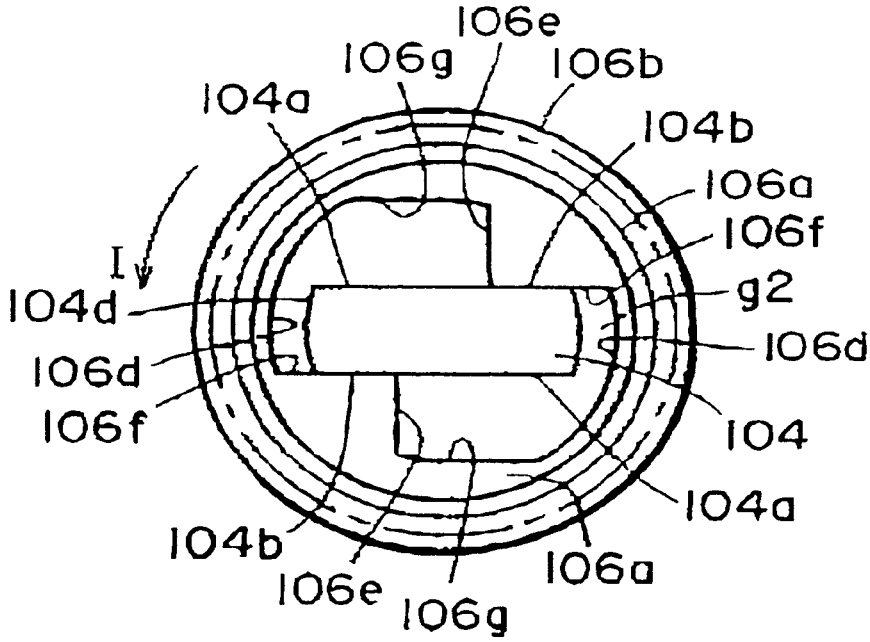
FIG. 26 is a rear view of the coupling for driving the stirring members.

Referring to FIGS. 24–26, the shapes of the couplings will be described.

Referring to FIG. 24, a first coupling 105*a* as one of the driving force receiving members of the process cartridge 15 has a projection 105*a*1 in the form of an approximately equilateral triangular pillar, more specifically, an equilateral triangular pillar twisted in the rotational direction of the first coupling 105*a*. On the other hand, a first coupling 103 on the main assembly side as one of the driving force transmitting members of the apparatus main assembly has a hole 103*a* which is in the form of an approximately equilateral triangular pillar twisted in the rotational direction of the coupling 103, and into which the projection 105*a*1 engages. Thus, as the first coupling 103 of the main assembly is rotated after the engagement of the first coupling projection 105*a*1 into the hole 103*a* of the first coupling 103, the rotational axis of the projection 105*a*1 (photosensitive drum 11) becomes aligned with the rotational axis of the first coupling 103 of the apparatus main assembly, because each of the three lateral edges of the projection 105*a*1 makes contact with, and remains in contact with, the corresponding surface of the hole 103*a*. The driving force is transmitted from the main assembly side to the process-cartridge side in the above-described condition.

As described above, the first coupling 105*a* of the process cartridge side, and the first coupling 103 of the apparatus main assembly, are a projection and a hole, respectively, which are in the form of a twisted equilateral triangular pillar. Therefore, as the first coupling 105*a* rotates after the engagement between the two couplings 105*a* and 103, thrust is generated in the axial direction; they pull each other.

Referring to FIGS. 25 and 26, a second coupling 104 on the main assemble side of the image forming apparatus has a projection in the form of a flatted cylindrical solid pillar. The portions of the flat surfaces immediately adjacent to the cylindrical surfaces constitute contact areas 104*a* and 104*b*, more specifically, a pair of contact areas 104*a* symmetrical about the rotational axis of the second coupling 104, and a pair of contact areas 104*b* symmetrical about the rotational axis of the second coupling 104. With respect to each cylindrical surface, the contact area 104*a* is on one side of the cylindrical surface, and the contact area 104*b* is on the other side of the same cylindrical surface. The second coupling 106*a* on the process cartridge side has a hole 106*d*, which looks as if a pair of triangle pillars having a cross section in the form of a right-angled isosceles triangle are placed on the lateral wall of a cylindrical hole in a manner to be symmetrical about the axial line of the hole, with the side comparable to the base of a right-angle isosceles triangle facing the lateral wall. The adjacent two internal flat surfaces, comparable to the sides of a right-angled isosceles triangle, of each of these triangular protrusions within the hole 106*d*, are perpendicular to each other, and constitute contact area 106*e* and 106*f*.

Referring to FIG. 25, as the second coupling 104 on the main assembly side rotates in E direction, that is, the direction in which the developer seal 24 is removed by an unillustrated automatic toner seal removing mechanism, the contact areas 104*a* of the second coupling 104 of the main assembly come into contact with the correspondent contact areas 106*e* of the triangular protrusions of the second coupling 106*a*, and transmit driving force to the process cartridge side.

More specifically, the aforementioned hole 106, which was referred to as a cylindrical hole, is only partially cylindrical; the opposing two portions of the cylindrical wall are rendered virtually flat, constituting a pair of virtually flat surfaces 106*a* parallel to the surfaces 106*f*. This arrangement was made in order to make as small as possible the gap g1 between the cylindrical surface 104*d* of the second coupling 104 on the main assembly side, and the wall of the hole 106*d* of the second coupling 106*a* on the process-cartridge side, in terms of the radial direction of the hole 106*d*, in the state in which the contact areas 104*a* are in contact with the corresponding contact areas 106*e*.

The surface 104*d* of the second coupling 104 on the main assembly side is cylindrical, the axial line of which coincides with the rotational axis of the coupling 104 on the main assembly side. After the completion of the driving of the automatic sealing removing mechanism for removing the developer seal 24, the second coupling 104 on the main assembly side is rotated in reverse, that is, in I direction in FIG. 26. As a result, the contact areas 104*b* of the second coupling 104 on the main assembly side come into contact with the contact areas 106*f* of the second coupling 106*a*, and begin to transmit driving force to the second coupling 106*a*, which in turn transmits driving force to the toner stirring members 113, 114 and 123, and the like. In this embodiment, after the engagements of the contact areas 104*b* with the contact areas 106*f*, the gap g2 between the cylindrical surface of the second coupling 104 on the main assembly side and the corresponding cylindrical surface of the second coupling 106*a* is approximately 2 mm.

With the employment of the above described structure, while the developer seal 24 is removed, the rotational axis of the second coupling 104 on the main assembly side and the rotational axis of the second coupling 106*a* align with each other, but it does not occur that the photosensitive drum 11 is rotationally driven. Then, after the completion of the removal of the developer seal 24, in other words, during the formation of an image, the rotational axis of the first coupling 105*a* of the photosensitive drum 11 aligns, and remains aligned, with the first coupling 103 on the main apparatus side, whereas the alignment between the second coupling 106*a*, and the second coupling 104 on the main assembly side, which transmit driving force to the toner stirring members 113, 114 and 123, and the like, becomes secondary; in other words, if they are not in alignment with each other, they continue to transmit driving force, without aligning with each other, so that they do interfere with the alignment between the rotational axes of the first coupling 103 of the apparatus main assembly, and the first coupling 105*a* of the process cartridge.

(Description of Driving System)

Figure 27:
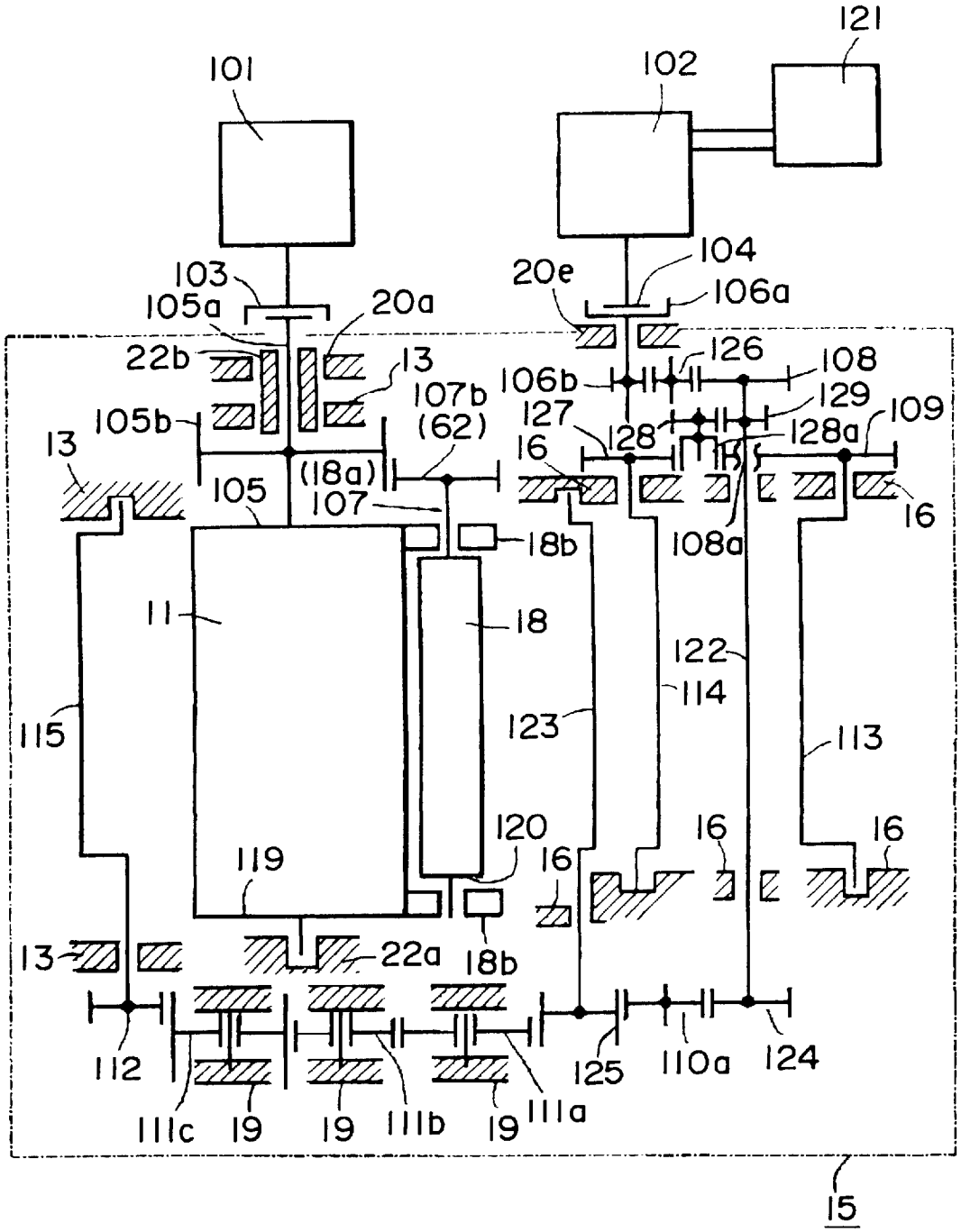
FIG. 27 is a schematic drawing of the system for driving the process cartridge.

FIG. 27 is a schematic drawing of the drive trains of the image forming apparatus in this embodiment. The referential codes employed in this schematic drawing are only for this drawing; for example, a development sleeve gear 107*b* in this drawing corresponds to the development gear 62 (FIGS. 7 and 20) in the actual structure.

When the process cartridge 15 is in the apparatus main assembly 17, the process cartridge driving force sources 101 and 102, for example, electric motors, provided on the apparatus main assembly 27 side are connected, through the couplings 103 and 104, to couplings 105*a* and 106*a*, which rotate with the input gears 105*b* and 106*b* on the process-cartridge side, respectively. The coupling 106*a* is supported by a bearing formed by hole 20*e*. The coupling 105*a* and gear 105*b* are integral, or virtually integral, parts of a gear flange 105 (gear flange 105 also being referred to as a drum flange 105), and are supported by the cleaning means frame portion 13 with the interposition of the bearing 22*b*. The provision of the driving force source 102 as the independent driving force source for the toner stirring system makes it possible to provide the driving force source 102 with a motor velocity controlling apparatus 121, so that the toner-stirring-system driving velocity can be varied through the coupling 104 on the main-assembly side, and the input coupling 106*a* on the process-cartridge side.

The controlling apparatus 121 makes it possible to turn on or off the driving force source 102 according to the cumulative number of copies formed with the use of the process cartridge 15 currently in use, the amount of the toner in the process cartridge 15, the amount of torque necessary to drive the stirring members in the process cartridge 15, and the like parameters, as well as to vary the stirring member driving velocity.

Further, the above described setup makes it possible keep constant the stirring member driving velocity even when the photosensitive drum 11 and development roller 18 of the apparatus main assembly 27 of a high speed image forming apparatus are increased in speed. The driving force source 102 may be replaced with a multi-speed transmission so that the stirring members can be driven at an optimum speed by changing the transmission ratio of the multi-speed transmission according to the specification of the apparatus main assembly 27.

Next, the drive trains on the process cartridge side will be described.

The photosensitive drum 11 and development roller 18 which are directly involved in the development of an electrostatic latent image are provided with gear flanges 105 and 107, integral with gears 105*b* and 107*b*, which are attached to their longitudinal ends, on the same side, respectively. To the other longitudinal ends of the photosensitive drum 11 and development roller 18, bearing flange 119 and 120 are fixed. In other words, the photosensitive drum 11, gear flange 105, and bearing flange 119 make up a photosensitive drum unit, and the development roller 18, gear flange 107, and bearing flange 120 make up a development roller unit. The gear 105*b* and sleeve gear 107*b* are meshed with each other.

As the coupling 103 is rotated by the driving force source 101 on the apparatus main assembly 27 side, the photosensitive drum 11 and development roller 18 rotate. The photosensitive drum unit is rotationally supported by the bearings 22*a* and 22*b*. The development roller 18 rotates, with its spacer rings 18*b*, the external diameter of which are larger than that of the development roller 18, and the rotational axis of which coincides with that of the development roller 18, kept pressed upon the peripheral surface of the photosensitive drum 11, maintaining an optimum gap between its peripheral surface and the peripheral surface of the photosensitive drum 11. The bearings 22*a* and 22*b* are directly fitted in the holes with which the process cartridge 15 and cleaning means frame portion 13 are provided, respectively, or are directly fixed to them, respectively (FIG. 7), and the journal portions of the flanges 105 and 119 fit in the bearings 22*a* and 22*b*, respectively.

As for the driving of the toner-stirring system, a driving force is transmitted to the stirring members 113 and 114 through a gear train in which, the aforementioned input gear 106*b* is meshed with an idler input gear 126, which is meshed with an idler gear 108, which is fixed to a shaft 108*a*, to which an idler gear 129 is fixed, which is meshed with an idler gear 128, which is a step gear, the small gear portion 128*a* of which is meshed with stirring input gears 109 and 127. The rotational axis of the input gear 106*b* and the rotational axis of the stirring member 114 do not need to align with each other, and therefore, the position of the input gear 106*b* is relatively flexible. The aforementioned gears in the process cartridge 15 are rotationally supported by the cartridge frame.

The shaft 108*a* of the idler gear 108 is integral with the driving force transmitting shaft 122, or connected thereto in a straight line. The driving force transmitting shaft 122 is connected to an idler output gear 124 on the other side of the process cartridge 15, in terms of the longitudinal direction of the process cartridge 15, to transmit the driving force to the stirring member 123 by way of a stirring gear 125 meshed with an idler gear 110*a*. The driving force transmitting shaft 122, and stirring members 113, 114 and 123 are rotationally supported by the developer holding frame portion 16.

Thus, as the input gear 106*b* rotates, the stirring members 114, 113 and 123, and driving force transmitting shaft 122, rotate because their journal portions are rotationally supported by the bearing portions with which the developer holding frame portion 16 is provided.

Referring to FIG. 24, as the coupling 103 rotates, thrust is generated in the direction to pull the projection 105*a*1, in the form of a twisted triangular pillar, of the drum flange 105 into the hole 103*a*, in the form of a twisted triangular pillar, of the coupling 103 on the apparatus main assembly 27 side, while aligning the rotational axes of the drum flange 105 and coupling 103. As a result, the positional relationship between the apparatus main assembly 27 and the process cartridge 15 becomes fixed. Since an engagement gap, which is large enough to tolerate a certain degree of misalignment, is provided between the projection of the coupling 104 and the wall of the hole of the coupling 106*a*, the engagement of the former into the latter does not affect the positioning of the first coupling 105*a* on the drum-flange side during the engagement (FIGS. 26 and 25) Further, a projection as a process-cartridge rotation controller, which will be described later, of the second guide portion 20*g* of the front end cover 20, is located on the apparatus main assembly 27. In other words, the couplings on the side through which the driving force which affects latent image formation and latent image development is transmitted is precisely positioned relative to the apparatus main assembly with the use of a self-aligning function of the aforementioned coupling combination, whereas the couplings on the side through which the force for driving the stirring system is transmitted is structured to assure mainly the transmission of the driving force while tolerating a certain amount of misalignment.

Further, within the cleaning means frame portion 13, a part of which constitutes a removed toner bin 5, a removed toner conveying member 115, in the form of a feather, for conveying the toner removed from the photosensitive drum 11, is placed. The removed toner conveying member 115 is rotationally supported by the bearing portion of the cleaning means frame portion 13. To one of the longitudinal ends of the removed toner conveying member 115, a removed toner conveyance force input gear 112 is fixed. The removed toner conveyance force input gear 112 is indirectly meshed with the gear 124 by way of idler gears 111*c*, 111*b*, and 111*a*, stirring gear 125 and idler gear 110*a*. The driving force transmitting shaft 122 has the output gear 124 fixed to the longitudinal end of the shaft 122, on the non-driven side, that is, the side opposite to the longitudinal end of the shaft 122 to which the input gear 108 is fixed. The idler gears 111*a*, 111*b* and 111*c* are rotationally supported by the corresponding bearing portions of the rear end cover 19, by their shaft portions. Thus, as the driving force transmitting shaft 122 rotates, the removed toner conveying member 115 rotates following the rotation of the shaft 122. Incidentally, the bearing portions which support the idler gears 111*a*, 111*b* and 111*c* are non-rotational shafts integrally formed with the rear end cover 19.

The idler gear 111*c* may be a step gear, the large diameter gear portion of which is meshed with the idler gear 111*b*, and the smaller diameter gear portion of which is meshed with the removed toner conveying gear 112.

As described above, the moving components within the process cartridge 15 are grouped into the driven train for driving the photosensitive drum 11 and development roller 18, and the drive train for driving the stirring members and removed toner conveying member, and each drive train is driven by its own driving force source provided on the apparatus main assembly 27 side.

It is possible to structure the drive trains so that the removed toner conveying member 115 is driven from the portion of the toner holding frame portion 16, located opposite to the portion of the toner holding frame portion 16, from which driving force is transmitted to the stirring member 113 or 114, or so that the removed toner conveying member 115 is driven by the driving force received from any of the input gears 106*b*, 109, 127, and idler gears 108 and 128, by way of a gear train.

(Structure of Cooling Air Passage)

Figure 28:
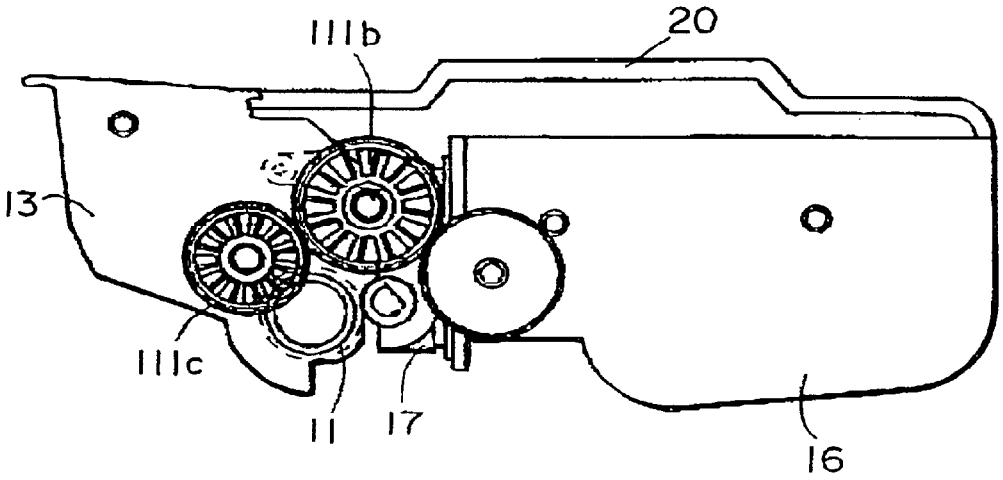
FIG. 28 is a front view of the cooling means of the process cartridge.
Figure 29:
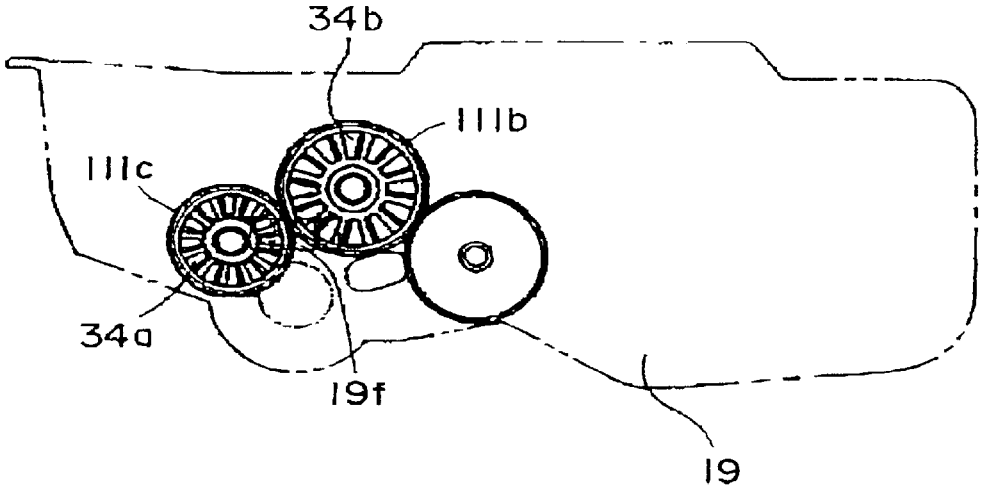
FIG. 29 is a front view of the cooling means of the process cartridge.

FIGS. 28 and 29 are schematic drawings of the gear trains placed in the adjacencies of the photosensitive drum 11, the former being a side view thereof with the side cover removed and the latter being a side view thereof with the side cover indicated by an imaginary line. Within the cleaning means frame portion 13, the conveying member 115 for conveying the recovered toner inward of the removed toner bin 5 is provided. In a structure in which the removed toner conveying member 115 is driven by the force transmitted from the photosensitive drum 11, there are times when rotational velocity must be drastically reduced. However, in the case of a structure in which the removed toner conveying member 115 receives driving force from the toner stirring member 114 in the developer holding frame portion 16, it is unnecessary to drastically reduce rotational velocity; in other words, it is easier to obtain an optimum rotational velocity. In the latter case, the gears 111*b* and 111*c* are placed outside developer holding frame portion 16 and developing means frame portion 17, while in the adjacencies of the photosensitive drum 11 (FIG. 28).

In this embodiment, in order to prevent temperature increase in the adjacencies of the photosensitive drum 11, the rear end cover 19 is structured to secure an air passage 19*f* (FIG. 29) in the adjacencies of the photosensitive drum 11. However, the gears 111*b* and 111*c* of the gear train block the flow of the cooling air through the air passage 19*f*. Therefore, the gears 111*b* and 111*c* are provided with slits 34*a* and 34*b*, respectively, along with axial flow fan blades, to aggressively taken in, or exhaust, air through the air passage 19*f*.

Figure 30:
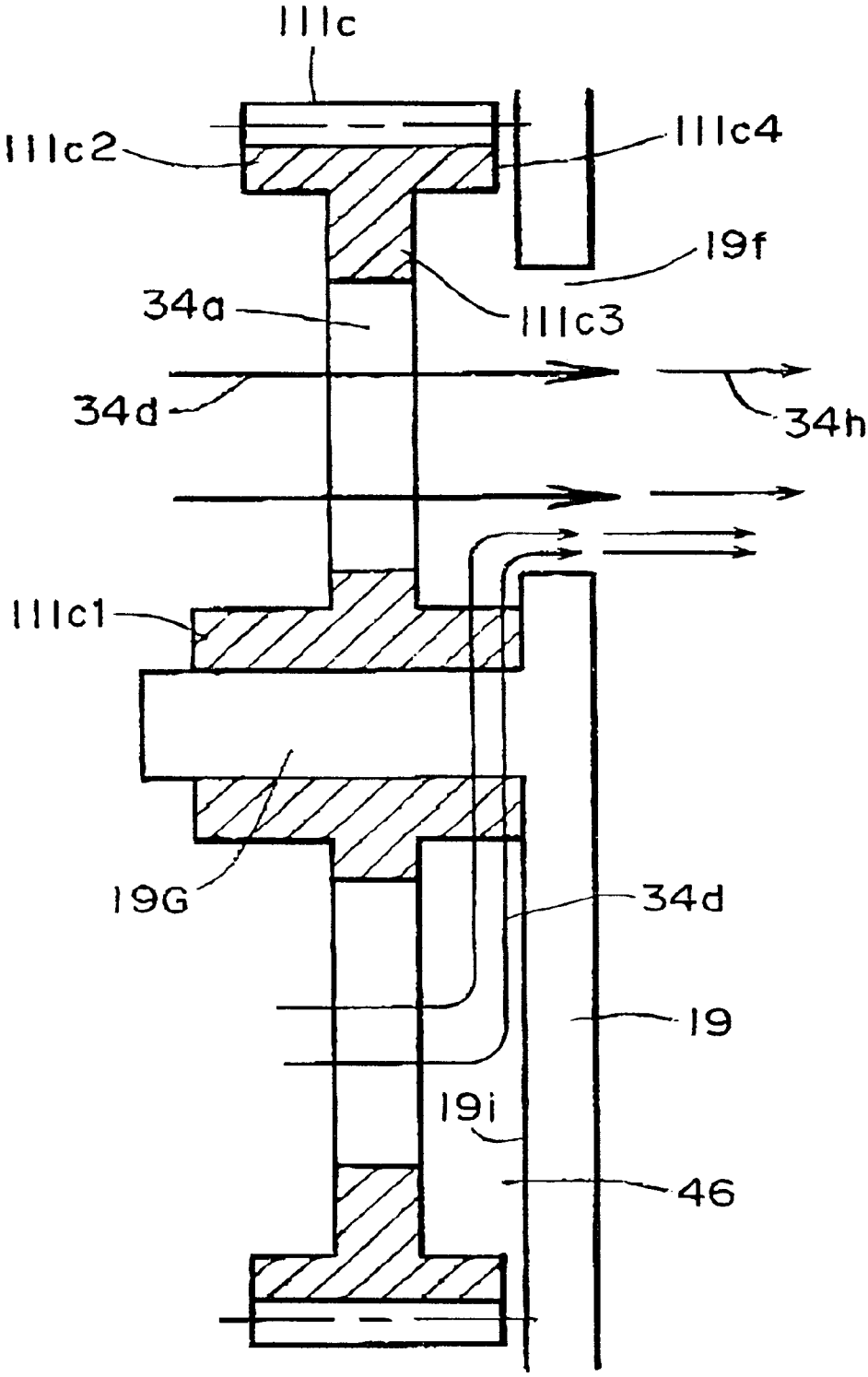
FIG. 30 is a sectional view of a gear with an impeller, at a plane A—A in FIG. 31.
Figure 31:
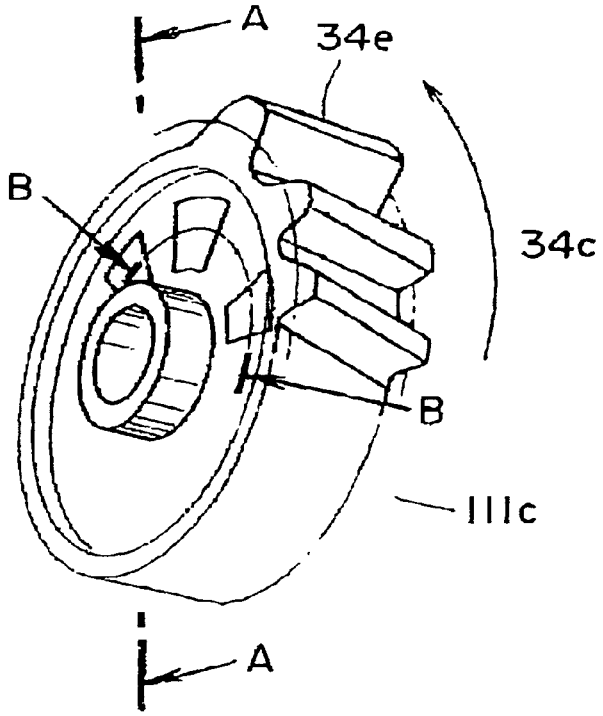
FIG. 31 is a perspective view of the gear with an impeller.
Figure 32:
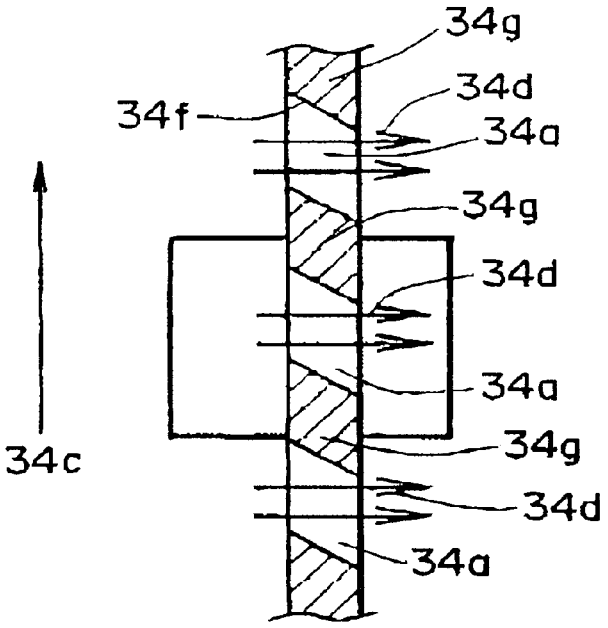
FIG. 32 is a sectional view of the gear with an impeller, at a plane B—B in FIG. 31.

Next, referring to FIGS. 30, 31 and 32, the structure of the cooling air passage will be described. FIG. 31 is a perspective view of the gear 111*c*. The gear 111*b* is virtually the same as the gear 111*c*, except that it is opposite in the direction in which the teeth and air passages are twisted. Therefore, the gears 111*b* and 111*c* will be described with reference to the gear 111*c* as the representative of both gears. FIG. 32 is a sectional view of the gear 111*c* at a cylindrical plane B—B in FIG. 31. FIG. 30 is a sectional view of the gear 111*c* at a plane A—A in FIG. 31.

The gear 111*c* is a helical gear, which is made up of a rim 111*c*2 with teeth, a boss 111*c*1, a disc-shaped hub 111*c*3 which connects the rim 111*c*2 and boss 111*c*1. The hub 111*c*3 has a plurality of slits 34*a* which are radially extended, and evenly distributed in terms of the circumferential direction. The surfaces of the hub 111*c*3 are recessed from the lateral surfaces of the rim 111*c*2 and boss 111*c*1, being therefore located a small distance away from the inward surface 19*i* of the rear end cover 19. Thus, the air passage 19*f* of the rear end cover 19, which connects the inside and outside of the rear end cover 19, and the slits 34*a*, are connected by the space 46 between the outward surface of the hub 111*c*3 and the inward surface 19*i* of the rear end cover 19. The gear 111*c* is rotationally supported by a shaft 19G, which projects inward from the inward surface 19*i* of the rear end cover 19 in the longitudinal direction of the process cartridge 15, and which is put through the center hole of the boss 111*c*1. The gear 111*c* is prevented from moving in the shaft direction by an unillustrated stopper ring fitted around the shaft 19G. The outwardly facing lateral surface 111*c*4 of the rim 111*c*1 is closer to the inward surface 19*i* of the rear end cover 19 than the outwardly facing surface of the hub 111*c*3, reducing the amount of air which passes through the gap between the two surfaces 111*c*4 and 19*i*. In order to reduce the amount of the air which passes through this gap between the two surfaces 111*c*4 and 19*i* as much as possible, the two surfaces 111*c*4 and 19*i* may be intricately structured to form a labyrinth between them.

The above described slits 34*a* are positioned so that their loci overlap with the air passage 19*f*.

Referring to FIG. 32, each of the portions of the hub between adjacent two slits 34*a* constitutes a helical blade 34*g*. The blade 34*g* is desired to be shaped like an axial flow fan blade in order to provide an optimum air flow efficiency. However, the gear 111*c* is slow in rotational velocity, and therefore, the blade may be simply slanted. The provision of these slits 34*a* forms an impeller on the inward side of the rim 111*c*2 in terms of the radial direction of the gear 111*c*.

Referring to FIGS. 31 and 32, as the gear 111*c* rotates in the direction of an arrow mark 34*c*, air flows in the shaft direction indicated by an arrow mark 34*d*, and enters the space 46. Thereafter, air flows from the space 46 to the air passage 19*f* of the rear end cover 19, and is exhausted from the process cartridge through the air passage 19*f*, as shown in FIG. 30.

Since the space 46 is wide enough to allow air to simultaneously flow into the space 46 through all slits 34*a*, all blades 34*g* always contribute to the generation of air flow.

If the direction in which the surface of the blade 34*g* is tilted is reversed, the direction of air flow reverses, in other words, the air outside the image forming apparatus is sent into the process cartridge 15, even if the rotational direction of the gear 111*c* is kept the same. Thus, the direction of air flow is desired to be set to be most effective for cooling in consideration of the positioning of the components, as well as the overall structure of the apparatus.

Matching the direction in which the teeth 34*e* of the gear 111*c* are twisted with the direction in which the blades 34*g* of the gear 111*c* are twisted, makes the direction of the air flow created by the teeth 34*e* and the direction of the air flow created by the blades 34*g* the same in terms of the shaft direction, and also is beneficial in terms of mold structure when the gear 111*c* is formed of resin. In the case in which the gear 111*c* is structured so that its teeth and blades 34*g* send air in the same direction in terms of the shaft direction, it is recommendable that a gap through which air is allowed to flow is provided between the outwardly facing lateral surface of the rim 111*c*2 and the inwardly facing surface of the rear end cover 19, and also that a cover is extended along the peripheral surface of the gear 111*c*, except for the area in which the gear 111*c* is meshed with the counterpart, so that the cover functions like the casing of a blower.

Since the gear 111*c* is provided with the slits 34*a*, which radially extend from the center portion of the gear 111*c*, and the blades 34*g* with a tilted surface 34*f*, the air within the process cartridge 15, the temperature of which would have excessively increased while the air was stagnating around the charging station and the cleaning station with the cleaning blade, is exhausted from the process cartridge 15 as the gear 111*c* is rotated during image formation. Further, the heat generated by a fixing apparatus 10 and the like is also removed by the air flow. As for the main assembly 27 side of the image forming apparatus, it is provided with air vents through which the main assembly 27 is naturally ventilated, or air vents with a ventilating means (unillustrated) such as a fan, through which the main assembly 27 is forcefully ventilated.

(Structure of Developing Means Frame Portion)

Figure 9:
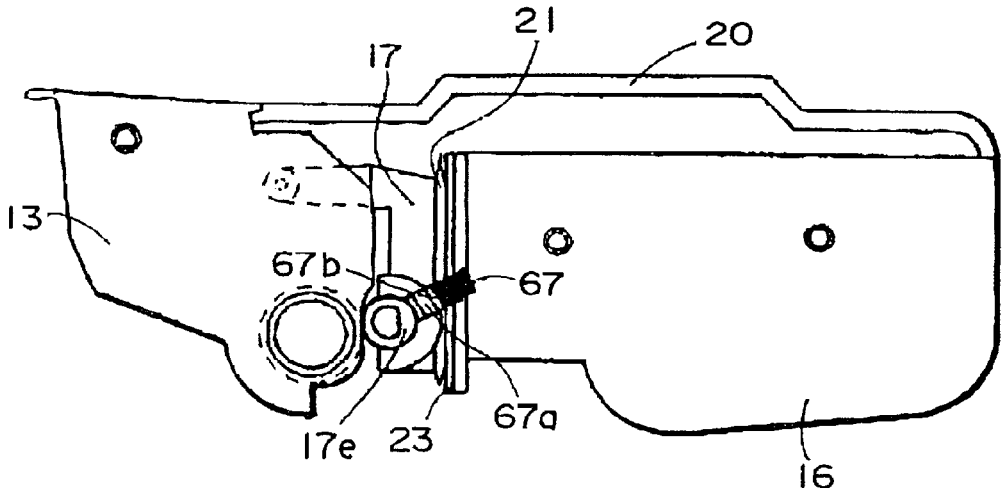
FIG. 9 is a schematic front view of the process cartridge, with its side cover removed.
Figure 33:
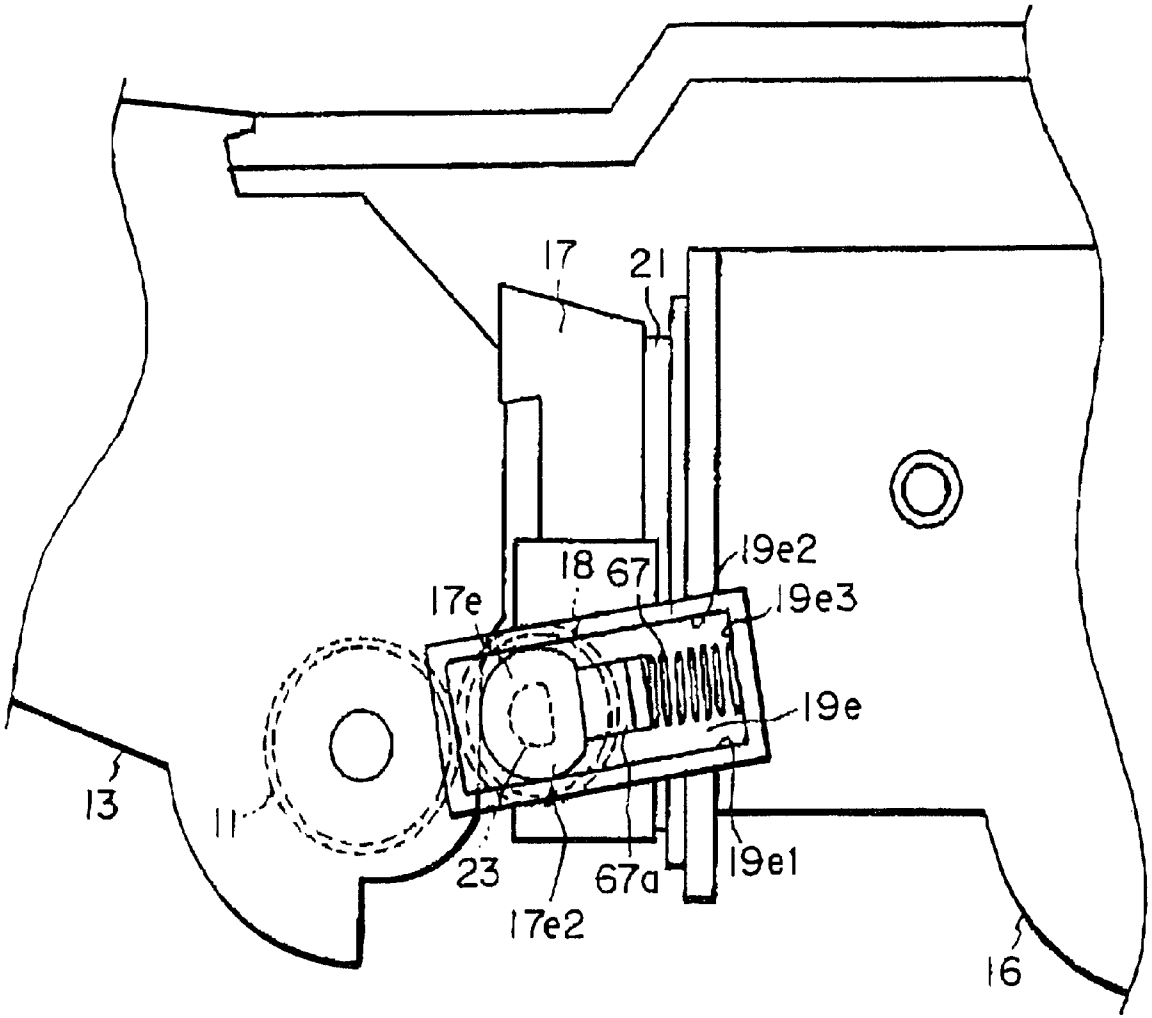
FIG. 33 is a partial front view of the process cartridge, with its side cover removed.
Figure 34:
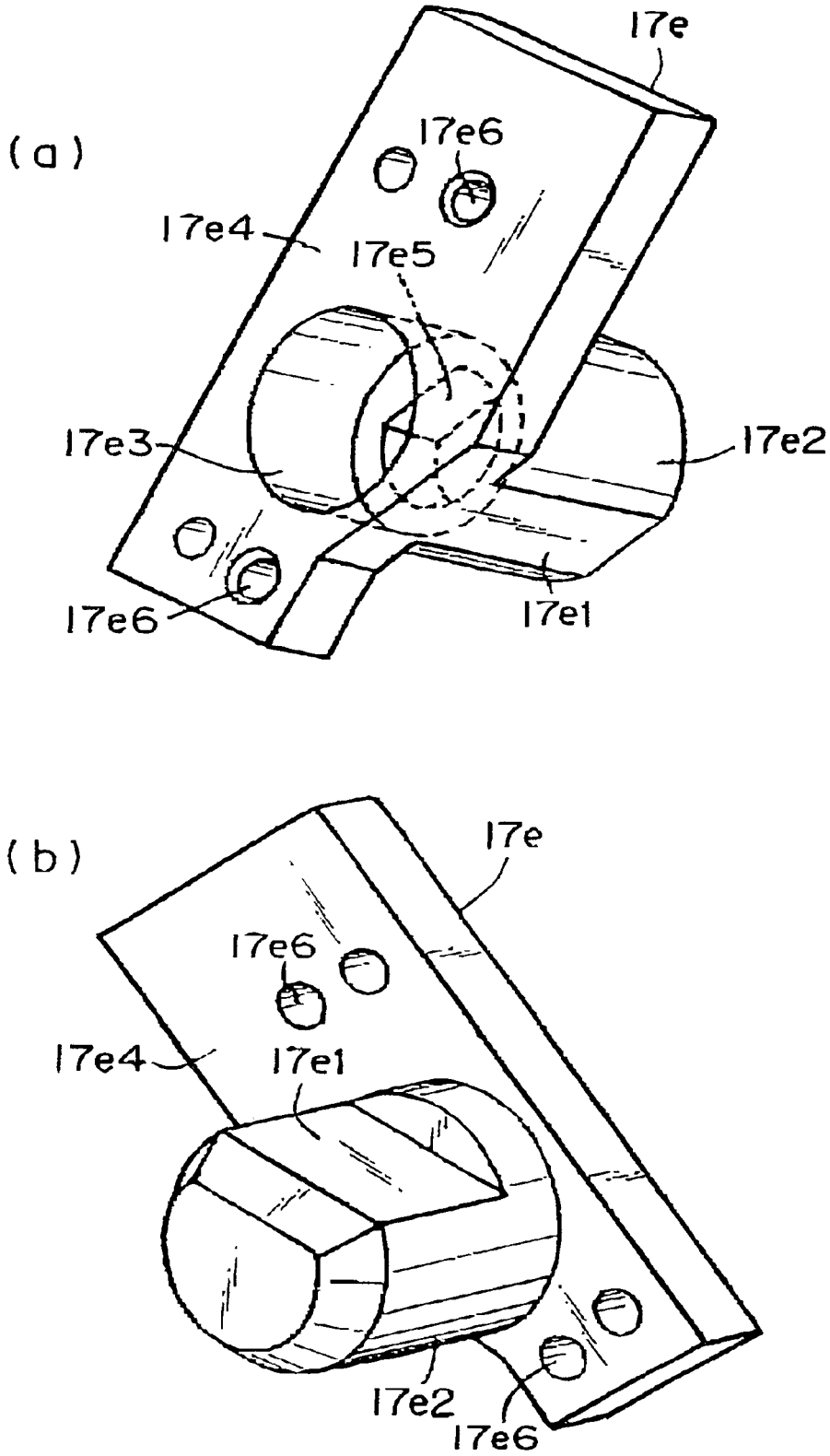
FIG. 34 is a perspective view of a connecting member with a projection, (a) and (b) being perspective views of rear and front views of the connecting member with a projection, respectively.

Next, referring to FIGS. 7, 9 and 33–37, the structure of the developing means frame portion 17 will be described. FIG. 9 is a side view of process cartridge 15, with the front end cover 20 removed, and FIG. 33 is a side view of the developing means frame portion 7, as seen from the side opposite to the side from which the process cartridge 15 is seen in FIG. 7, with virtually the entirety, except for a predetermined small portion, of the rear end cover 19 removed. FIG. 34 is a perspective view of the connecting member 17*e* of the developing means frame portion 17, depicting the positioning and connecting of the developing means frame portion 17 to the rear end cover 19, on the opposite side the process cartridge.

The developing means frame portion 17 contains a development roller unit made up of the development roller 18 and a magnetic roll 28 contained in the development roller 18. The development roller unit is rotationally supported by the aforementioned connecting member 17*e* which doubles as a development-roller bearing. The connecting member 17*e* is fixed to the developing means frame portion 17 with the use of small screws 41, being accurately positioned relative to the developing means frame portion 17. Also attached to the developing means frame portion 17 are the development blade 26 (FIG. 2) and an unillustrated magnetic seal.

Figure 36:
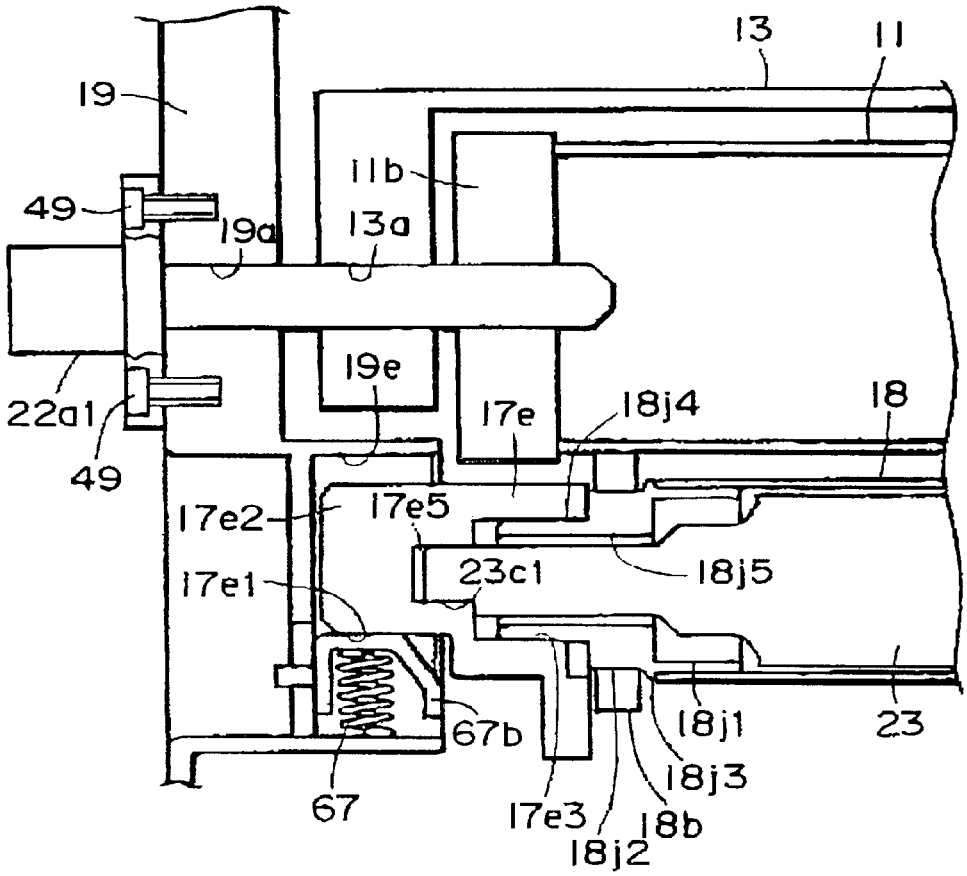
FIG. 36 is a vertical sectional view of the structure for supporting one of the longitudinal ends of the development roller and one of the longitudinal ends of the photosensitive drum.

One of the longitudinal ends of the magnetic roll 23 is rotationally supported by the internal surface of the development roller 18, and the other is nonrotationally supported by the connecting member 17*e* which also functions as a development roller bearing. With this arrangement, a predetermined gap is maintained between the magnetic roll 23 and development roller 18. Electric power to the development roller 18 is transmitted by way of an unillustrated contact point placed within the development roller 18. The development roller 18 is fitted with a pair of spacer rings 18*b* for maintaining a predetermined gap between the development roller 18 and photosensitive drum 11 (FIG. 36).

(Structure for Supporting Development Roller and Magnetic Roll)

Figure 35:
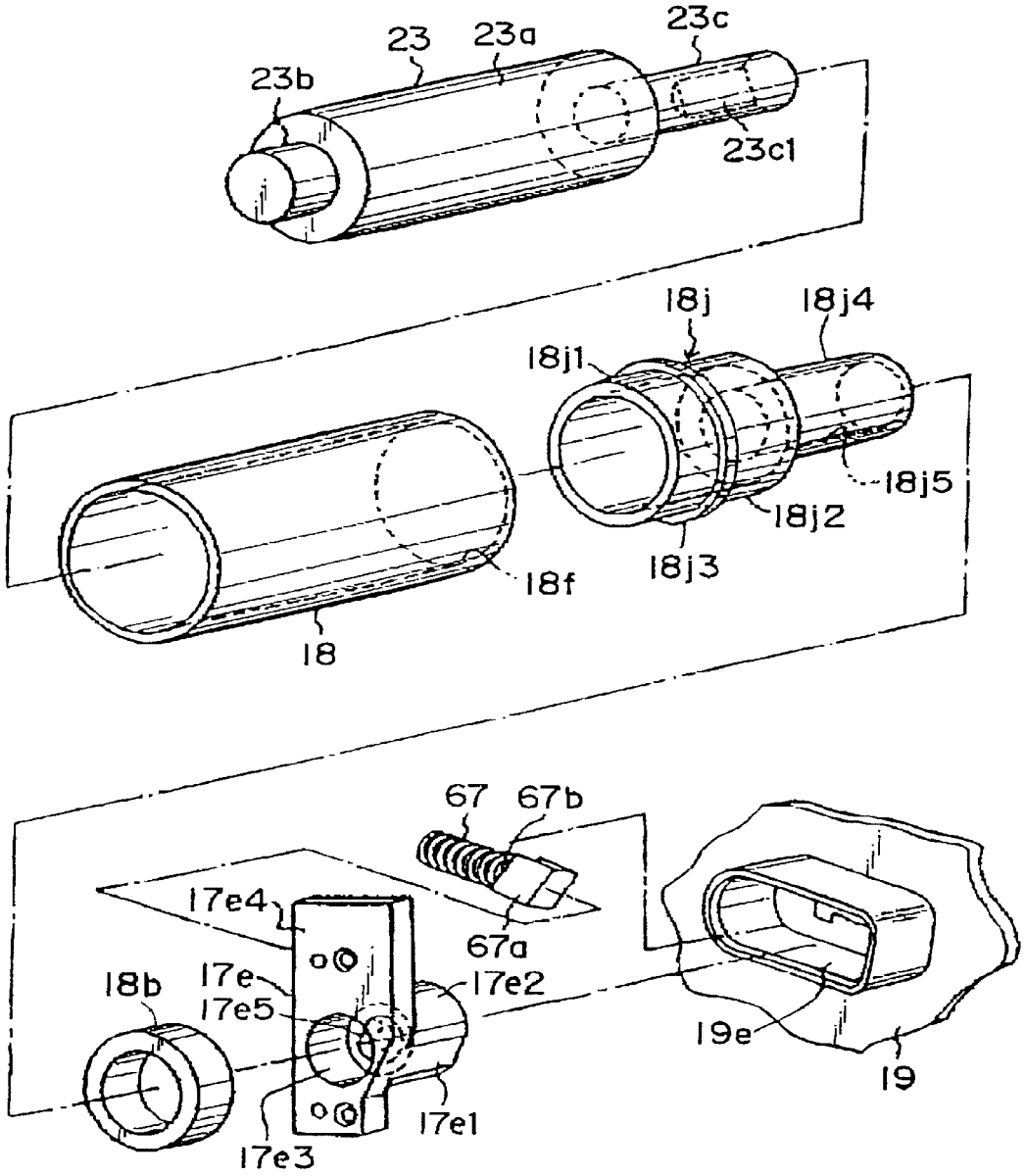
FIG. 35 is an exploded perspective view of one of the development roller bearings of the process cartridge, and its adjacencies.

Next, referring to FIGS. 34–36, the structure for supporting the development roller 18 and magnetic roll 23 will be described. FIG. 34 is an external perspective view of the connecting member 17*e* which doubles as development roller bearing, and FIG. 35 is an exploded perspective view of the connecting member 17*e* and its adjacencies in the process cartridge 15. FIG. 36 is a vertical sectional view of a portion of one of the longitudinal ends of the process cartridge 15.

The development roller 18 is a cylindrical member formed of metallic material such as aluminum, stainless steel, or the like. It is 16–20 mm in external diameter, and 0.5–1 mm in wall thickness. In order to improve toner charging efficiency, the surface of the metallic cylinder is coated with carbon, or subjected to sandblasting or the like process (in this embodiment, it is simply coated with carbon). The longitudinal end of the development roller 18, on the non-driven side, is provided with a hole 18*t* into which a sleeve flange 18*j* is pressed.

Referring to FIG. 35, the sleeve flange 18*j* is a cylindrical, hollow, and stepped member formed of metallic material such as aluminum, stainless steel, or the like, and is fixed to the aforementioned longitudinal end of the development roller 18 by being pressed into the hole 18*f*. It has a portion 18*j*1, which is pressed into the longitudinal end of the development roller 18. The sleeve flange 18*j* is fixed to the development roller 18 by pressing this portion 18*j*1 into the development roller 18. The sleeve flange 18*j* has a collar 18*j*3 and a small diameter portion 18*j*2. In terms of the axial direction of the sleeve flange 18*j*, the collar 18*j*3 is on the outward side of the portion 18*j*1, which is pressed into the development roller 18, and the small diameter portion 18*j*2 is on the outward side of the collar 18*j*3. The collar 18*j*3 is approximately the same in diameter as the development roller 18. The small diameter portion 18*j*2 is smaller in diameter than the portion 18*j*1 which is pressed into the development roller 18, and the axial line of the small diameter portion 18*j*2 coincides with that of the portion 18*j*1. The small diameter portion 18*j*2 is fitted with a spacer ring 18*b* for regulating the distance between the development roller 18 and photosensitive drum 11. Further, the sleeve flange 18*j* has a journal 18*j*4, which is on the outward side of the small diameter portion 18*j*2, and is smaller in diameter than the small diameter portion 18*j*2.

In addition, the sleeve flange 18*j* is provided with a through hole 18*j*5, the axial line of which coincides with that of the journal 18*j*4. One of the longitudinal ends of the magnetic roll 23 is put through this through hole 18*j*5, and therefore, the position of the magnetic roll 23 relative to the developing means frame portion 17 is fixed by the connecting member 17*e*.

Referring to FIG. 35, on the other hand, the magnetic roll 23 is made up of a large diameter portion 23*a*, and two shaft portions 23*b* and 23*c*. The large diameter portion 23*a* is placed within the development roller 18. The magnetic roll 23 is a magnet with a plurality of magnetic poles, which are exposed at its peripheral surface. Ordinarily, the magnetic roll 23 is oriented so that the position of one of the magnetic poles roughly corresponds to the position at which the distance between the development roller 18 and photosensitive drum 11 is smallest. Each of the other magnetic poles is also positioned at an optimum location. The total number of the magnetic poles is four. In order to keep the magnetic force stable at the peripheral surface of the development roller 18, the distance between the peripheral surface of the large diameter portion 23*a* of the magnetic roll 23, and the peripheral surface of the development roller 18 must be kept constant. In order to keep this distance constant, the aforementioned shaft portion 23*c* of the magnetic roll 23 is supported by the connecting member 17*e*. In order to assure that the positions of the magnetic poles of the magnetic roll 23 in terms of the circumferential direction of the development roller 18 remains stable, the shaft portion 23*c* of the magnetic roll 23 is provided with a D-cut portion 23*c*1, which regulates the rotational movement of the magnetic roll 23. On the other longitudinal end side of the magnetic roll 23, the shaft portion 23*b* is supported by a magnetic roll bearing (unillustrated) within the sleeve flange 18*a* (FIGS. 7 and 8)

The connecting member 17*e* is formed of resin, and is made up of a flange 17*e*4 with a thickness of 2–5 mm, and a projection 17*e*2 with an external diameter of 8–15 mm. The projection 17*e*2 is fitted in a groove 19*e* of the rear end cover 19. The peripheral surface of the projection 17*e*2 has a flat portion 17*e*1, which is more or less perpendicular to the plane connecting the axial lines of the development roller 18 and photosensitive drum 11. This flat portion 17*e*1 is the surface which receives the pressure from the aforementioned elastic member 67, or a compression coil spring, through the pressing member 67*a*, and assures that the development roller 18 is pressed upon the photosensitive drum 11. With this arrangement it is assured that the development roller 18 is kept pressed upon the photosensitive drum 11 without wasting the force from the compression coil spring. Therefore, the distance between the photosensitive drum 11 and development roller 18 remains constant to output high quality images in any case whatever.

Also, the connecting member 17*e* is provided with a cylindrical first hole 17*e*3 as the hole of the development roller bearing portion of the connecting member 17*e*, which is in the surface of the flange 17*e*4, on the side opposite to the surface with the projection 17*e*2, with respect to the flange 17*e*4. The axial line of the hole 17*e*3 coincides with the axial line of the projection 17*e*2, and its diameter is 8–15 mm. The journal 18*j*4 of the sleeve frame 18*j* rotationally fits in this hole 17*e*3; in other words, the development roller 18 is rotationally supported by the connecting member 17*e*. The position of the development roller 18 relative to the photosensitive drum 11 in terms of the rotational direction is highly accurately fixed by the connecting member 17*e* and rear end cover 19 alone. In other words, the parallelism of the development roller 18 relative to the photosensitive drum 11 is assured. More specifically, even if the rotational axes of the photosensitive drum 11 and development roller 18 remain parallel to each other in terms of the plane of the surface of FIG. 36, they may become divergent or nonparallel to each other in terms of a plane perpendicular to the plane of the surface of FIG. 36, resulting in fluctuation in the gap between the photosensitive drum 11 and development roller 18. This results in the shifting of the development station in the circumferential direction of the photosensitive drum 11. With the above described structural arrangement, the shifting of the development station in the circumferential direction of the photosensitive drum 11 does not occur.

Further, the connecting member 17*e* is provided with a second hole 17*e*5 with a D-shaped cross section, which is a positioning hole and is located inward of the hole 17*e*3. The axial line of this hole 17*e*5 coincides with that of the projection 17*e*2. The D-cut portion 23*c*1 of the magnetic roll 23 is fitted in this second hole 17*e*5 to fix the positions of the magnetic poles. In other words, the positional relationship between the magnetic roll 23 and development roller 18 is highly precisely fixed with the use of a single component, or the connecting member 17*e*, making it easier to assure accuracy in the positional relationship between the magnetic roll 23 and development roller 18.

As described above, the magnetic roll 23 is positioned in such a manner that one of its four magnetic poles more or less squarely faces the photosensitive drum 11, and the positional relationship between the magnetic roll 23 and photosensitive drum 11 is fixed by the connecting member 17*e* and rear end cover 19. Therefore, accuracy in the positional relationship between the magnetic roll 23 and photosensitive drum 11 is easily assured.

Figure 37:
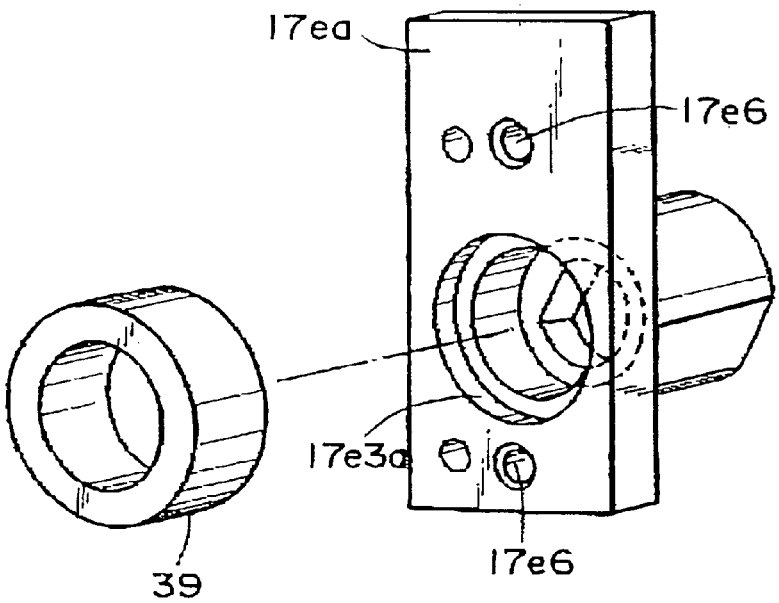
FIG. 37 is a perspective view of the connecting member with a projection, in another embodiment of the present invention.
Figure 38:
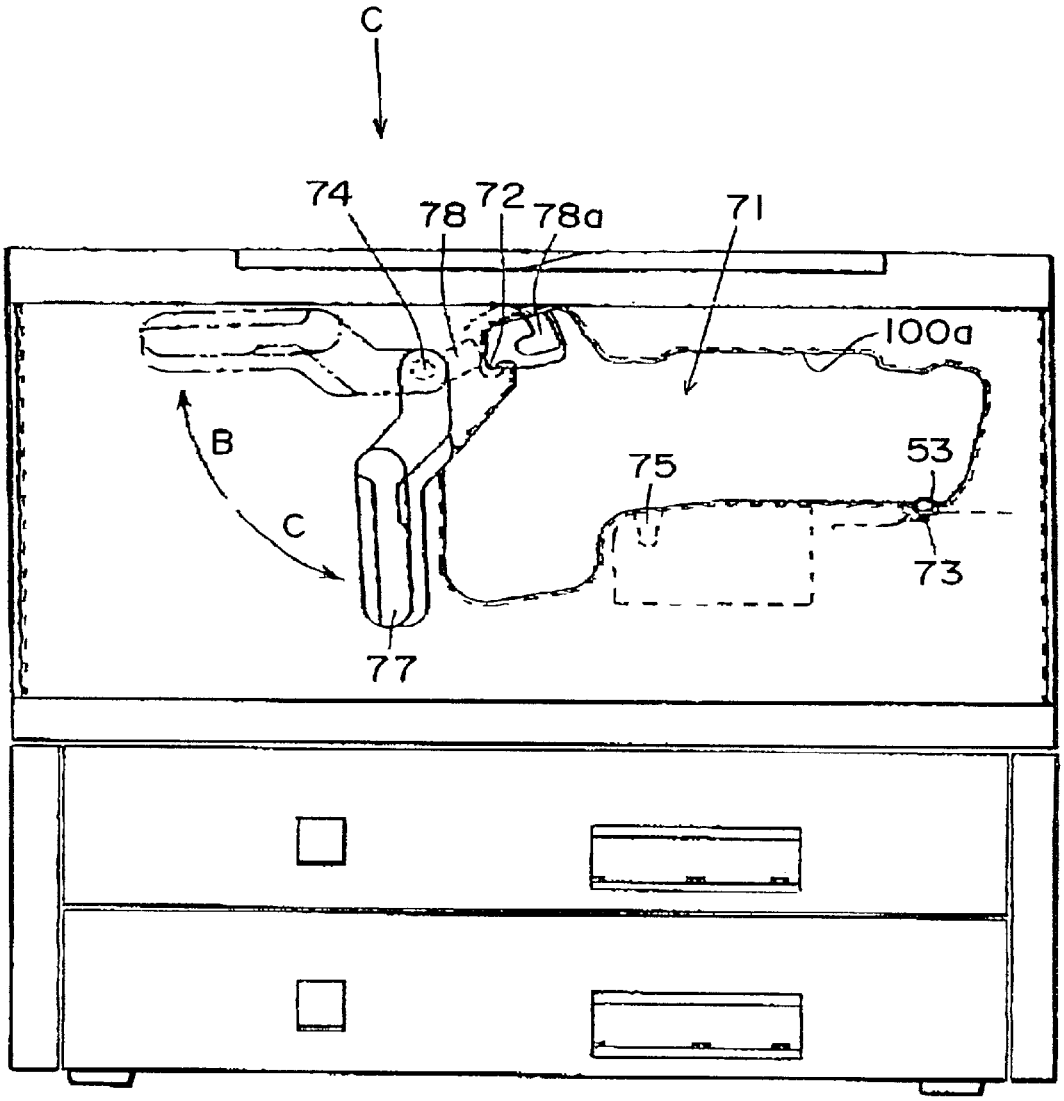
FIG. 38 is a front view of the cartridge mounting space in the main assembly of an image forming apparatus, and its adjacencies.

Referring to FIG. 34, the flange 17*e*4 of the connecting member 17*e* is provided with a pair of screw holes 17*e*6, which are positioning holes and are located sufficiently apart from each other. Referring to FIG. 37, the connecting member 17*e* is accurately positioned relative to the developing means frame portion 17 and is firmly fixed to the developing means frame portion 17 with the use of the small screws 41 (FIG. 23). Consequently, the positional relationship among the development blade 26, magnetic seal, and the like fixed in advance to the development means frame portion 17, and the magnetic roll 23 and development roller 18, the positions of which are fixed by the connecting member 17*e*, becomes fixed.

Referring to FIGS. 35 and 36, to repeat the above described structure following the order in which the components are assembled, first, the cylindrical portion 18*j*1 of the sleeve flange 18*j* is inserted into the hole 18*f* located at one of the longitudinal end of the development roller 18 to firmly fix the sleeve flange 18*j* to the development roller 18. Next, the magnetic roll 23 is inserted into the development roller 18. Then, the sleeve flange 18*a* and magnetic roll bearing (unillustrated) are fitted into the other side of the development roller 18 to complete the development roller 18.

Next, the spacer rings 18*h* are fitted around the small diameter portion 18*j*2 of the sleeve flange 18*j*, and the second cylindrical portion 18*c* of the sleeve flange 18*a*, one for one, and the development roller gear 62 (FIGS. 7 and 18) is fitted around the flattened portion 18*e* of the sleeve flange 18*a*. Then, this assembled combination of the development roller components is attached to the development means frame portion 17 using the connecting member 17*e*. Thereafter, the elastic member 67, which is a compression coil spring, is fitted around the projection (unillustrated) provided on the flat surface 67*b* of the pressing member 67*a*, and this combination of the elastic member 67 and the pressing member 67*a* is placed in the groove 19*e* of the rear end cover 19. Then, with the connecting member 17*e* attached to the developing means frame portion 17, the projection 17*e*2 of the connecting member 17*e* is inserted into the groove 19*e* of the rear end cover 19, causing the pressing member 67*a* to settle in the groove 19*e* against the force from the elastic member 67 (the state illustrated in FIG. 36 is realized).

As is evident from FIG. 36, the positions of the development roller 18 and the magnetic roll 23 relative to the rear end cover 19 are fixed by the connecting member 17*e*. Further, the surface by which the pressure is received is on the developing means frame portion 17 side. The phase of the D-cut portion 23*c*1 of the magnetic roll 23 relative to the magnetic poles is optional. However, if this phase is fixed so that the flat surface of the D-cut portion 23*c*1 becomes perpendicular to the plane connecting the axial lines of the development roller 18 and the photosensitive drum 11, the second hole 17*e*5 of the connecting member 17*e*, into which the D-cut portion 23*c*1 of the magnetic roll 23 is inserted, can be formed so that the corresponding portions of the projection 17*e*2 and the second hole 17*e*5 become similar in contour to each other, and coaxial, improving the efficiency of component manufacture in component processing.

As described above, according to this embodiment, component count is reduced by enabling each component to perform plural functions. As a result, it is possible to provide a user with an inexpensive process cartridge. Further, the positions of the main components such as the photosensitive drum 11, development roller 18, magnetic roll 23, and the like, which are significantly involved in image formation, are fixed with the use of a relatively small number of components. Therefore, the positional relationship among these components is superior compared to the conventional setup, and therefore, the image forming process of an image forming apparatus in accordance with the present invention is more stable.

The development roller 18 is rotationally supported in the first hole 17*e*3 of the bearing portion of the connecting member 17*e*. Therefore, material such as PPS or PA, which is superior in slipperiness, and therefore, superior as bearing material, is often used as the material for the connecting member 17*e*. However, these materials are relatively expensive. Thus, the following measures may be taken to reduce the cost of the connecting member 17*e*. For example, the connecting member 17*e* may be separated into two pieces: a bushing 39 as an actual bearing, and a main body 17*ea* with a hole 17*e*3*a* in which the bushing 39 is fitted, as shown in FIG. 37. This configuration makes it possible to reduce the volume of the portion of the connecting member 17*e*, which requires costly material; relatively inexpensive material such as HIPS can be used as the material for the main body 17*ea* of the 17*e*. Further, if the bushing 39 as an actual bearing is differently shaped, the connecting member 17*e* may be integral with the developing means frame portion 17 (all that is necessary is to insert the development roller from the diagonal direction when attaching the development roller). With this configuration, component count is smaller, with an additional benefit of elimination of small screws or the like, and therefore, the number of assembly steps is also smaller. Therefore, cost reduction is greater.

The above described cartridge is approximately 4 kg in weight, approximately 460 mm long, approximately 300 mm wide, and approximately 110 mm in height.

(Means for Mounting Process Cartridge into Apparatus Main Assembly)

Figure 39:
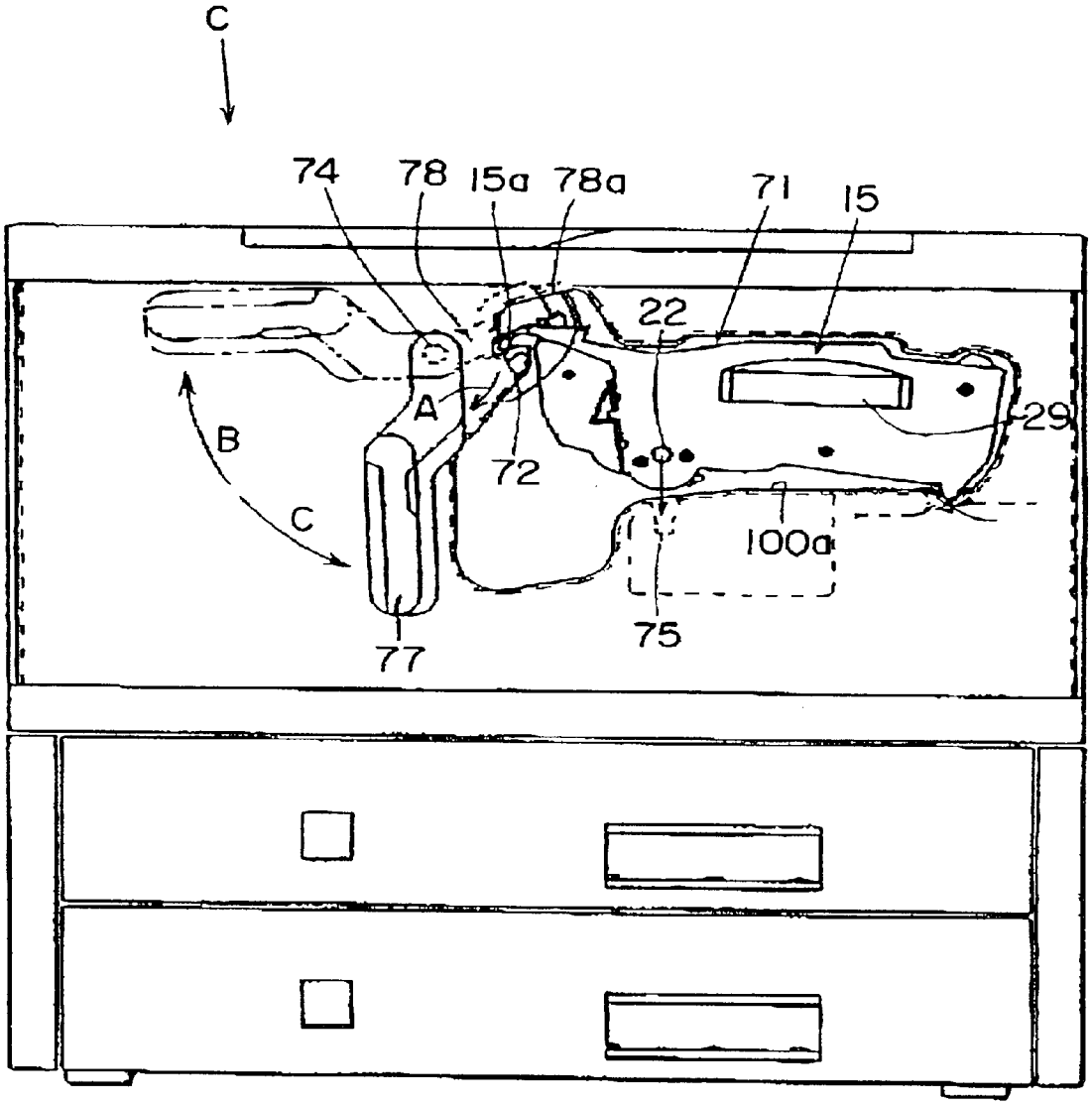
FIG. 39 is a front view of the cartridge mounting space and its adjacencies, for showing how the process cartridge is inserted into, or pulled out of, the main assembly of an image forming apparatus.

Referring to FIG. 42(L), the apparatus main assembly 27 is provided with a double-leafed hinged door 60, which is located on the front side of the apparatus main assembly 27. As this door 60 is opened as shown in FIG. 42(M), an opening 100*a* as the entrance for the process cartridge 15 is exposed as shown in FIG. 39. The mounting space 71 for the process cartridge 15 is visible through this opening 100*a*.

Also visible through the opening 100*a* are a guide 72 in the form of a rail fixed to the apparatus main assembly 27, a first recess 73*a* as a guide, a second recess 73*b* as a guide, and a flat surface 73*c*. as a guide (recess 73*a* and 73*b*, and flat surface 73*c* make up guide 73). They extend in the front to back direction. With reference to the opening 100*a*, the guides 72 and 73 are located at the top left, and right bottom corners, respectively. The guide 72 is a straight groove more or less parallel to the photosensitive drum 11. This straight groove 72 opens upward, having a semicircular cross section. The guiding recesses 73*a* and 73*b* are parallel to the guide 72.

Figure 43:
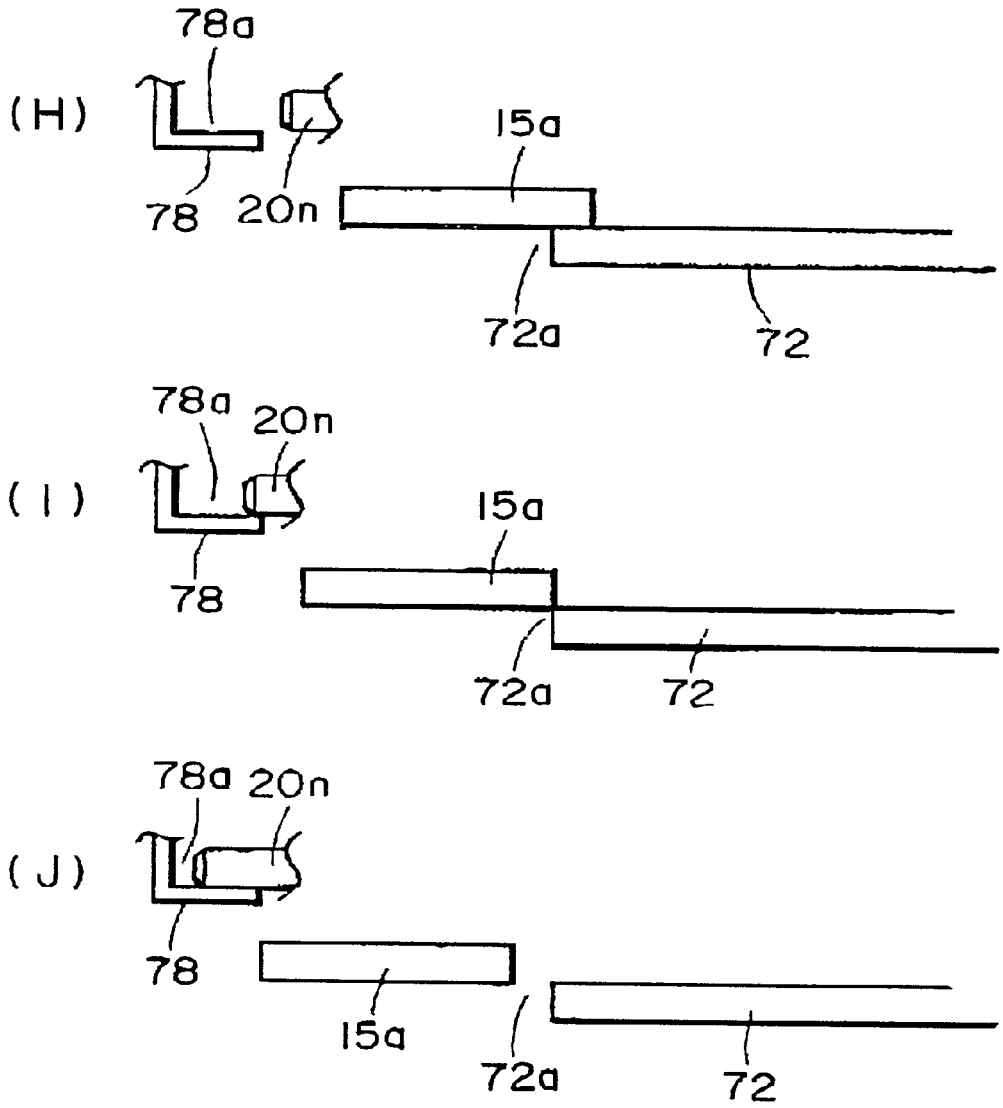
FIG. 43 is a vertical sectional view of the lever for raising or lowering the process cartridge, and the guide rail portions of the main assembly of an image forming apparatus, which shows their relationships in the stages (H), (I) and (J) of the process in which the process cartridge is inserted into the main assembly of an image forming apparatus.

Referring to FIG. 43, the guide 72 does not extend all the way to the rear, so that a gap 72*a* is provided. The guide 73 extends rearward from the opening 100*a* to a cylindrical member 53 provided on the rear wall 52 of the cartridge mounting space, or the deepest end of the cartridge mounting space as seen from the opening 100*a*. The cylindrical member 53 has an almost cylindrical hole 53*a*. This hole 53*a* is virtually parallel to the photosensitive drum 11, and is straight above the guide 73. However, the position of the axial line of the hole 53*a* of the cylindrical member 53 is higher than the position of the axial lines of the semicylindrical recesses 73*a* and 73*b*. The details of this positional relationship will be described later.

There is a lever 78 at the top left corner of the inward end of the cartridge mounting space. This lever 78 is used to lower or raise a process cartridge, and will be referred to internal lever 78. The internal lever 78 is pivotally supported by the front wall 100*b* and rear wall 52 of the apparatus main assembly 27; the internal lever 78 is mounted on a shaft 74, which is supported by the front wall 100*b* and the rear 52 of the apparatus main assembly 27. The shaft 74 extends in the longitudinal direction of the apparatus main assembly 27 beyond the front wall 100*b* of the apparatus main assembly 27, and this projecting portion is where the base portion of an external lever 77 is fixed. The shaft 74 is horizontal, and perpendicular to the recording-medium-conveyance direction. Thus, the end of the internal lever 78 is virtually vertically movable by the external lever 77. The internal lever 78 is provided with a cam groove 78*a*, which constitutes a portion which catches the connecting member 20*n* (which will be described later) of the process cartridge 15.

The rear wall 52 of the cartridge mounting space of the apparatus main assembly 27 is provided with a first coupling 103 (main assembly side coupling) and a second coupling 104 (main assembly side coupling), which face the cartridge mounting space 71.

The bottom side of the cartridge mounting space 71 constitutes a passage for recording medium (sheet S). In this passage, the aforementioned transfer roller 9 is placed, and adjacent to each longitudinal end of the transfer roller 9, a stand with a shaft positioning recess 75 (75*a*, 75*b*) is located. In the shaft positioning recess 75*a* (on the upstream side in terms of the process cartridge insertion direction), a photosensitive drum supporting shaft 22*a*1 of the photosensitive drum bearing 22*a* is fitted. With the shaft 22*a*1 being in the recess 75*a*, the axial line of the shaft 22*a*1 coincides with the axial line of the photosensitive drum 11, and therefore, the non-driven side longitudinal end of the photosensitive drum 11 is accurately positioned relative to the apparatus main assembly 27. In the shaft positioning recess 75*b*, the photosensitive drum bearing 22*b*, which coaxially surrounds the first coupling 105*a* of the process cartridge is fitted. This drum bearing 22*b* is a cylindrical member, and doubles as a positioning member. With the drum bearing 22*b* being in the positioning recess 75*b*, the axial lines of the drum bearing 22*b* and photosensitive drum 11, which coincide with each other, virtually coincide with the axial line of the first coupling 103 of the apparatus main assembly. The amount of misalignment between the axial lines of the first coupling 103 of the apparatus main assembly and the drum bearing 22*b* is within an approximate range of 100 $\mu$m–1 mm. Thus, as the first coupling 103 of the apparatus main assembly rotates, the first coupling 105*a* of the process cartridgge is aligned with the first coupling 105 on the main assembly side. As a result, the photosensitive drum and the first coupling 103 of the apparatus main assembly rotate together, with their rotational axes coinciding with each other. In other words, during the rotation of the photosensitive drum 11, the position of the drum bearing 22*b* as a positioning member is not completely fixed by the positioning recess 75*b*; the former remains floating within the latter. Next, the cartridge mounting means on the cartridge side will be described.

Referring to FIG. 5, as seen in the cartridge insertion direction, the top rear corner of the deepest end of the process cartridge 15 is provided with a first guide portion 15*a*, which is guided by the guide 72 on the main assembly side. The edge portion of the first guide portion 15*a* parallel to the longitudinal direction of the process cartridge 15 is tilted downward. The edge of the first guide portion 15*a* is approximately parallel to the photosensitive drum 11, and is rounded to give the edge a semicircular cross section. This edge of the first guide portion 15*a* fits in the semicylindrical straight groove of the guide 72. The first guide portion 15*a* extends only in the rear side of the process cartridge in terms of the process cartridge insertion direction. The first guide portion 15*a* has a horizontally extending portion 15*a*-1 which is above the top surface of the cartridge frame and is approximately parallel to the top surface of the cartridge frame, and a portion 15*a*-2 which extends diagonally downward from the horizontally extending portion 15*a*-1. The bottom edge of the downwardly projecting portion 15*a*-2 is guided by the guide 72 on the main assembly side.

Referring to FIG. 6, the process cartridge 15 is provided with a second guide portion 20*g*, which is at the bottom right corner of the deepest end, as seen from the side from which the process cartridge is mounted, in other words, the farthest portion from the aforementioned first guide portion 15*a*, in terms of the widthwise direction of the process cartridge. This second guide portion 20*g* is provided with a projection 20*g*1 in the form of a round boss, and a supporting portion 20*g*2 integral with the projection 20*g*1. The projection 20*g*1 is nearly cylindrical and virtually parallel to the photosensitive drum 11. The supporting portion 20*g*2 is continuous with a front end cover 20. The bottom portions of the projection 20*g*1 and supporting portion 20*g*2 are continuous, and are semicircular in cross section. The diameter of the projection 20*g*1 is such that the projection 20*g*1 can be loosely fitted in the hole 53*a* of the cylindrical member 53. The second guide portion 20*g* is one of the integrally formed parts of the front end cover 20.

Also referring to FIG. 6, the process cartridge 15 is provided with a first guide portion 15*a* which is located at the top left corner of the deepest end of the process cartridge 15, as seen from the upstream side in terms of the direction in which the process cartridge 15 is mounted into the apparatus main assembly 27. The first guide portion 15*a* extends leftward, and the extending end of the first guide portion 15*a* tilts downward. The edge of the downwardly tilting portion of the first guide portion 15*a* is given a semicircular cross section. The process cartridge 15 is provided with a connecting member 20*n* in the form of a round pin, which is located at the top left corner of the deepest end of the process cartridge 15 as seen from the upstream side of the process cartridge insertion direction, and projects in the process cartridge insertion direction from a point slightly above the base portion of the aforementioned first guide portion 15*a*. The connecting member 20*n* is one of the integrally formed parts of the front end cover 20. The position of the connecting member 20*n* is above the top surface of the cartridge frame, and projects in the direction in which the process cartridge 15 is inserted into the apparatus main assembly 27, beyond the front surface of the cartridge frame. This front surface of the cartridge frame means the cartridge frame surface located at the leading end of the cartridge frame when the process cartridge 15 is inserted into the apparatus main assembly 27. Incidentally, the first guide portion 15*a* extends along both the leading end cover 20 and cleaning means frame portion 13; it is made up of a portion which is an integrally formed part of the leading end cover 20, and another portion which is an integrally formed part of the cleaning means frame portion 13. The process cartridge 15 is also provided with a second guide portion 20*g*, which is located at the bottom right side of the leading end, as seen from the trailing side in terms of the direction in which the process cartridge 15 is mounted into the apparatus main assembly 27. The second guide portion 20*g* has a projection 20*g*1, which has a slanted surface 20*g*3, which is below the projection 20*g*1. The process cartridge 15 is also provided with a third guide 19*g*, which projects downward from the bottom right side of the trailing end, in terms of the direction in which the process cartridge 15 is mounted into the apparatus main assembly 27. The bottom side of the third guide 19*g* is in the form of a semicylinder, the axial line of which is parallel to the photosensitive drum 11 and coincides with axial line of the projection 20*g*1 of the second guide portion 20*g*. The third guide 19*g* is an integral formed part of the rear end cover 19.

Figure 42:
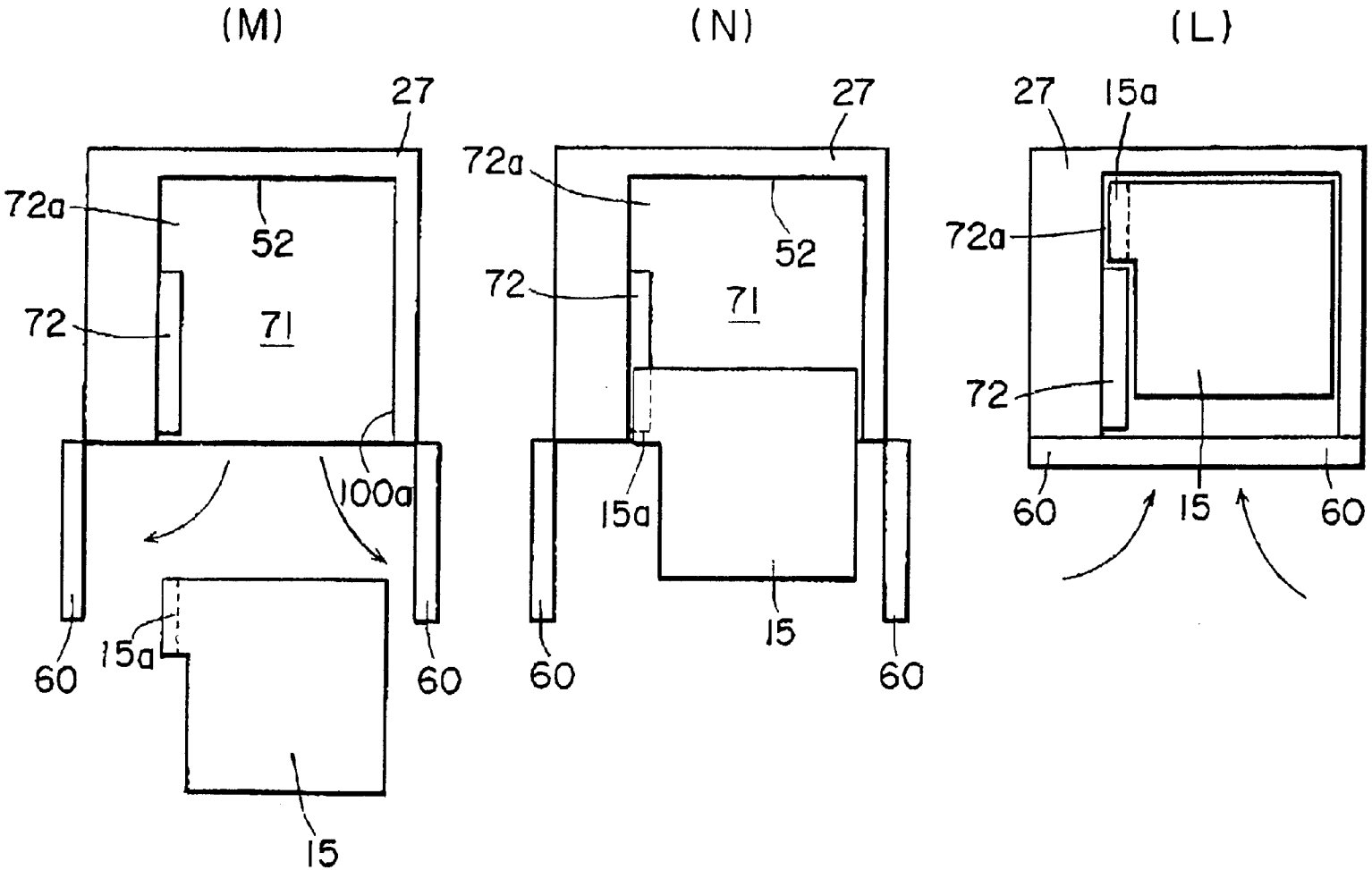
FIG. 42 is a plan of the process cartridge mounting space, and the process cartridge, for showing the stages (L), (N) and (M) of the process in which the process cartridge is inserted into the main assembly of an image forming apparatus.

Referring to FIG. 42, the process cartridge 15 is inserted into the image forming apparatus main assembly 27 in the following manner. First, the door 60 on the front side (non-driven side in terms of the axial direction of the photosensitive drum) of the image forming apparatus main assembly 27 is opened. Next, the process cartridge 15 is lifted and inserted into the cartridge mounting space 71 through the opening 100*a*, by a user, with the aforementioned first handle 30 on the top surface of the process cartridge 15 grasped by one of user's hands, and the second handle 29 on the user side grasped by the other hand. Then, the first guide portion 15*a* of the process cartridge 15 is rested on the guide 72 on the main assembly side, and the second guide portion 20*g* of the process cartridge 15 is rested in the second recess 73*b* of the guide 73. Then, the process cartridge 15 is pushed straight (rearward of the plane of FIG. 39; directions indicated by an arrow mark in FIGS. 42(M) and 42(N)) almost all the way in the longitudinal direction of the photosensitive drum 11.

As described before, the guide 72 does not extend all the way to the rear wall of the cartridge-mounting space 71, creating a gap 72*a* between the deepest end of the guide 72 and the rear wall of the cartridge mounting space 71. Thus, as the first guide portion 15*a* slides on the guide 72 in the image forming apparatus main assembly 27 in the axial direction of the photosensitive drum 11, first, the leading end of the first guide portion 15*a* sticks out in the air from the deepest end of the guide 15*a* on the main assembly side as shown in FIG. 43(H) until the first guide portion 15*a* becomes disengaged from the guide 72. Slightly before the first guide 15*a* becomes disengaged from the guide 72, the connecting member 20*n*, which is at the leading end of the process cartridge 15 in terms of the cartridge-insertion direction, at this time, begins to slide into the cam groove 78*a* of the internal lever 78, as shown in FIG. 43(I). Then, as the process cartridge 15 is inserted deeper, the first guide portion 15*a* becomes disengaged from the guide 72 as shown in FIG. 43(J), causing a part of the process cartridge 15 to be supported by the internal lever 78 as the connecting member 20*n* is supported by the internal lever 78.

On the other hand, at the same time as the first guide portion 15*a* of the process cartridge 15 is rested on the guide 72 on the main assembly side, the second guide portion 20*g* located at the bottom right side of the leading end is rested on the guide 73. Then, as the process cartridge 15 is pushed deeper into the cartridge mounting space 71, the second guide portion 20*g* slides inward on the guide 73. Then, before the projection 20*g*1 of the second guide portion 20*g* reaches the cylindrical member 53, the third guide 19*g*, which is located at the bottom right side of the trailing end in terms of the process cartridge insertion direction engages into the second recess 73*b* of the guide 73. Referring to FIG. 6, the third guide 19*g* has a slanted surface 19*g*1, which is at the leading end in terms of the process cartridge insertion direction, smoothing the entry of third guide 19*g* into the second recess 73*b* of the guide 73. As the third guide 19*g* enters the second recess 73*b* of the guide 73, the bottom right side of the leading end of the process cartridge 15 in terms of the process cartridge insertion direction is supported in the second recess 73*b*, in the cartridge mounting space 71. At this point, the first guide portion 15*a*, which is at the lading end in terms of the cartridge insertion direction, is being supported by the guide 72 on the main assembly side. Then, as the process cartridge 15 is inserted deeper, the projection 20*g*1, which is located at the bottom right side of the leading end of the process cartridge 15, enters the hole 53*a* of the cylindrical member 53 at the same time as the aforementioned connecting member 20*n* enters the cam groove 78*a* of the internal lever 78. During this process, the right side of the leading end of the process cartridge 15 is lifted, because the position of the axial line of the hole 53*a* of the cylindrical member 53 is higher than the position of the axial line of the projection 20*g*1 which is guided by the recess 73*a* of the guide 73. Referring to FIG. 6, the bottom side of the leading end of the projection 20*g*1 has a slanted surface 20*g*3, contributing to the smooth entry of the projection 20*g*1 into the hole 53*a* of the cylindrical member 53.

Immediately after the completion of the entry of the projection 20*g*1 into the hole 53*a* of the cylindrical member 53, and the engagement of the connecting member 20*n* into the cam groove 78*a* of the internal lever 78, the first guide portion 15*a* is straight above the gap 72*a*, and therefore, the process cartridge 15 is being supported at three other locations, in addition to where the third guide 19*g* is resting in the second recess 73*b* of the guide 73.

Figure 40:
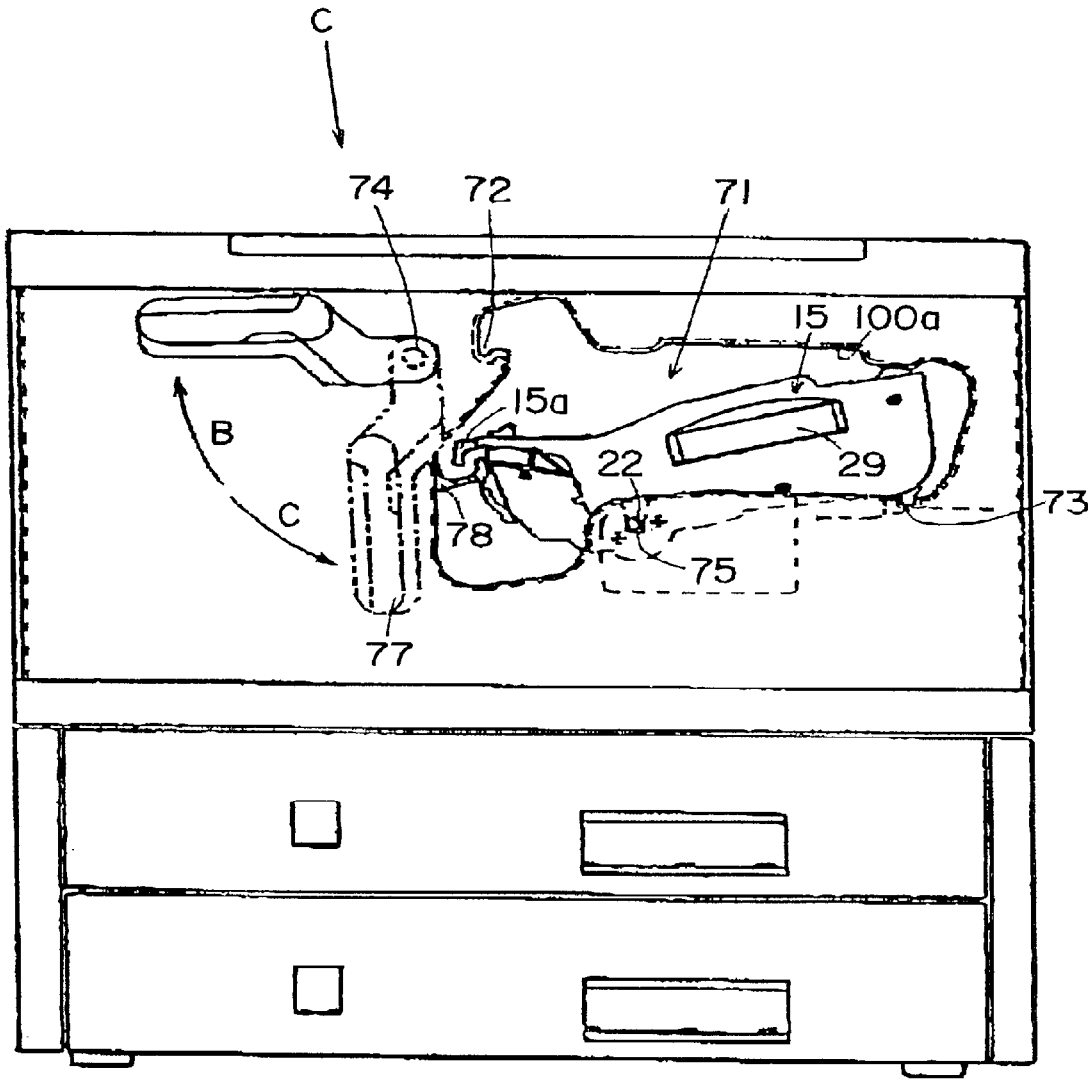
FIG. 40 is a front view of the cartridge mounting space and its adjacencies, for showing how the process cartridge is mounted in the main assembly of an image forming apparatus.
Figure 41:
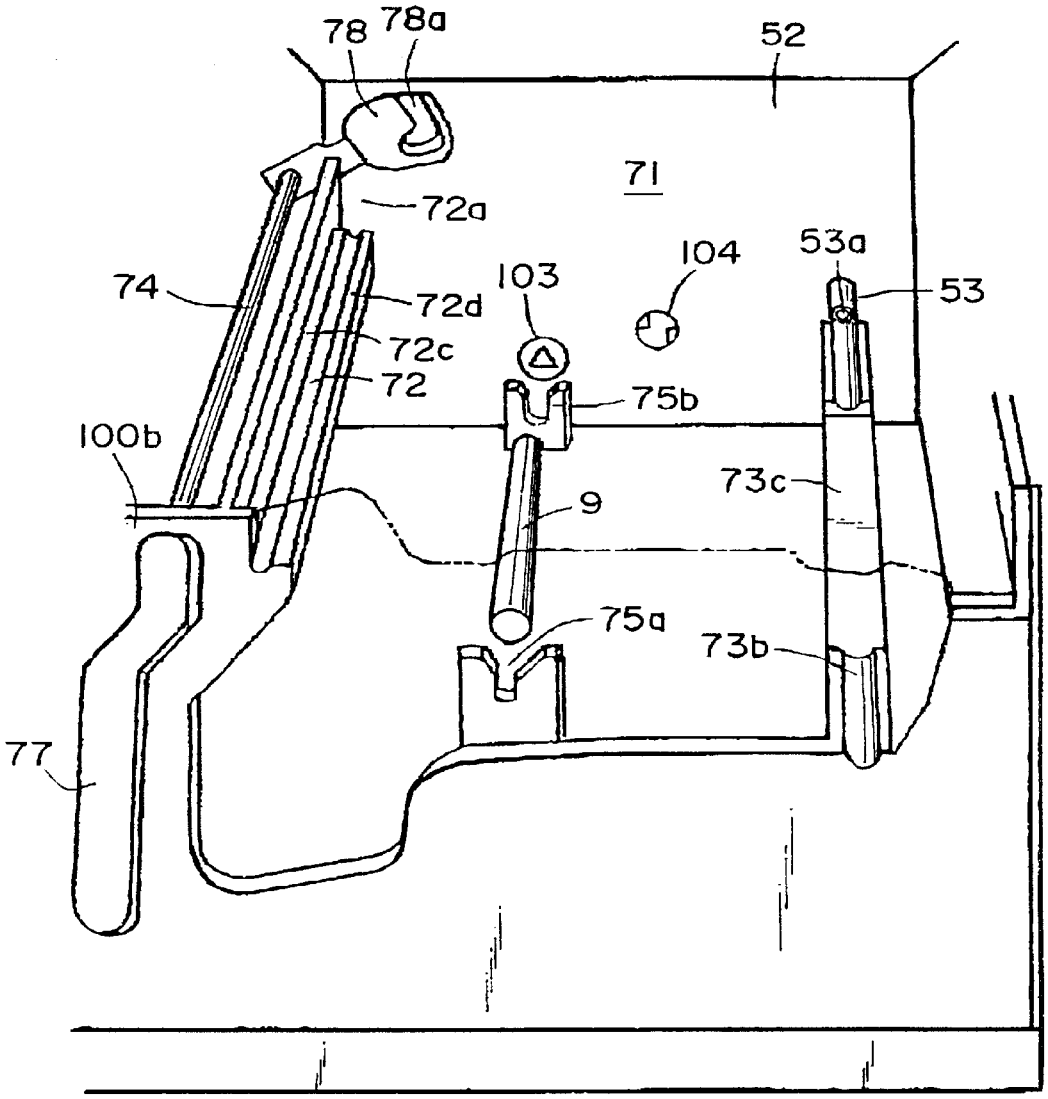
FIG. 41 is a front view of the process cartridge mounting space in the image forming apparatus.
Figure 45:
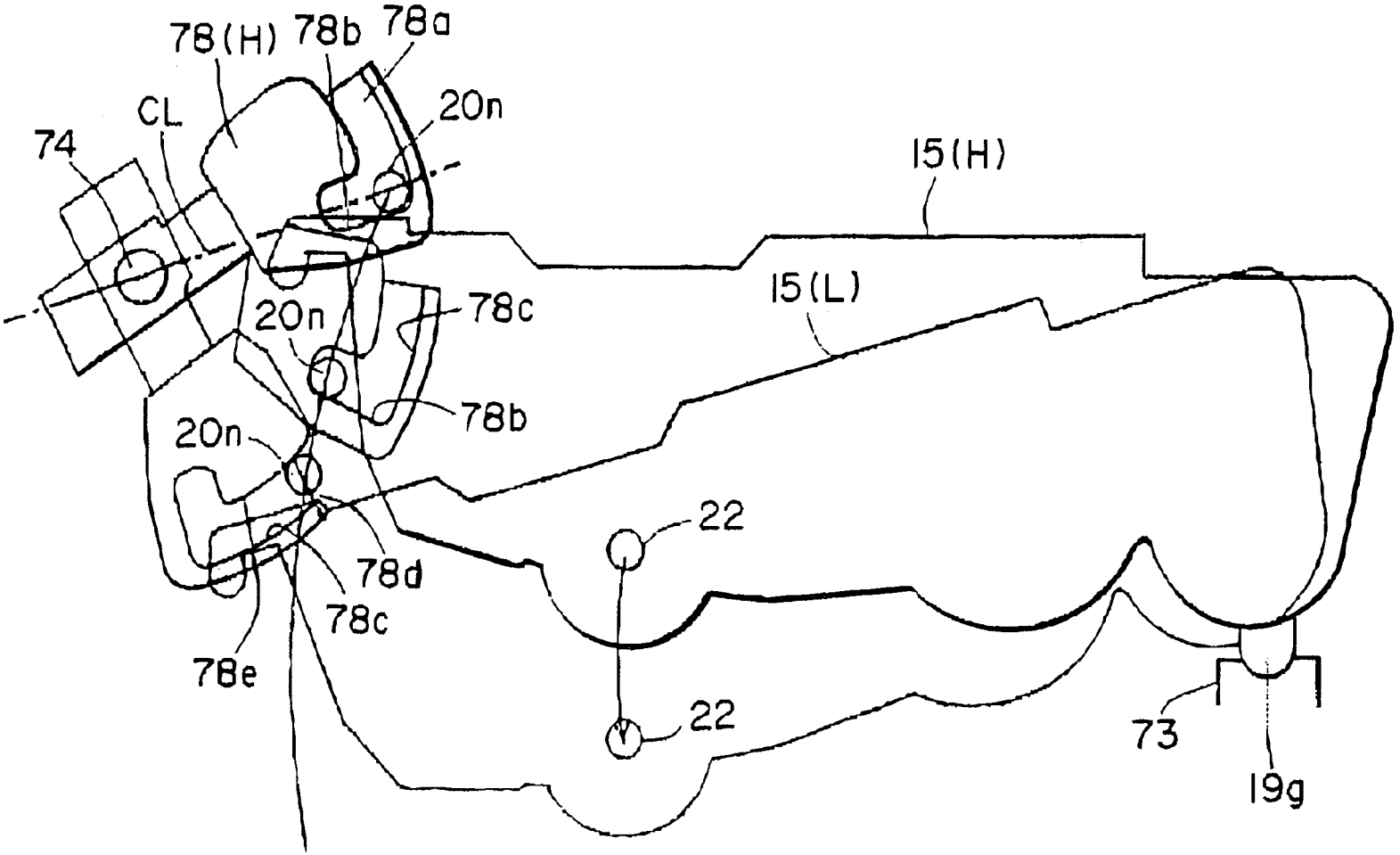
FIG. 45 is a vertical cross sectional view of the process cartridge and a portion of the cartridge mounting space, which shows the locus of the process cartridge in the cartridge mounting space.
Figure 46:
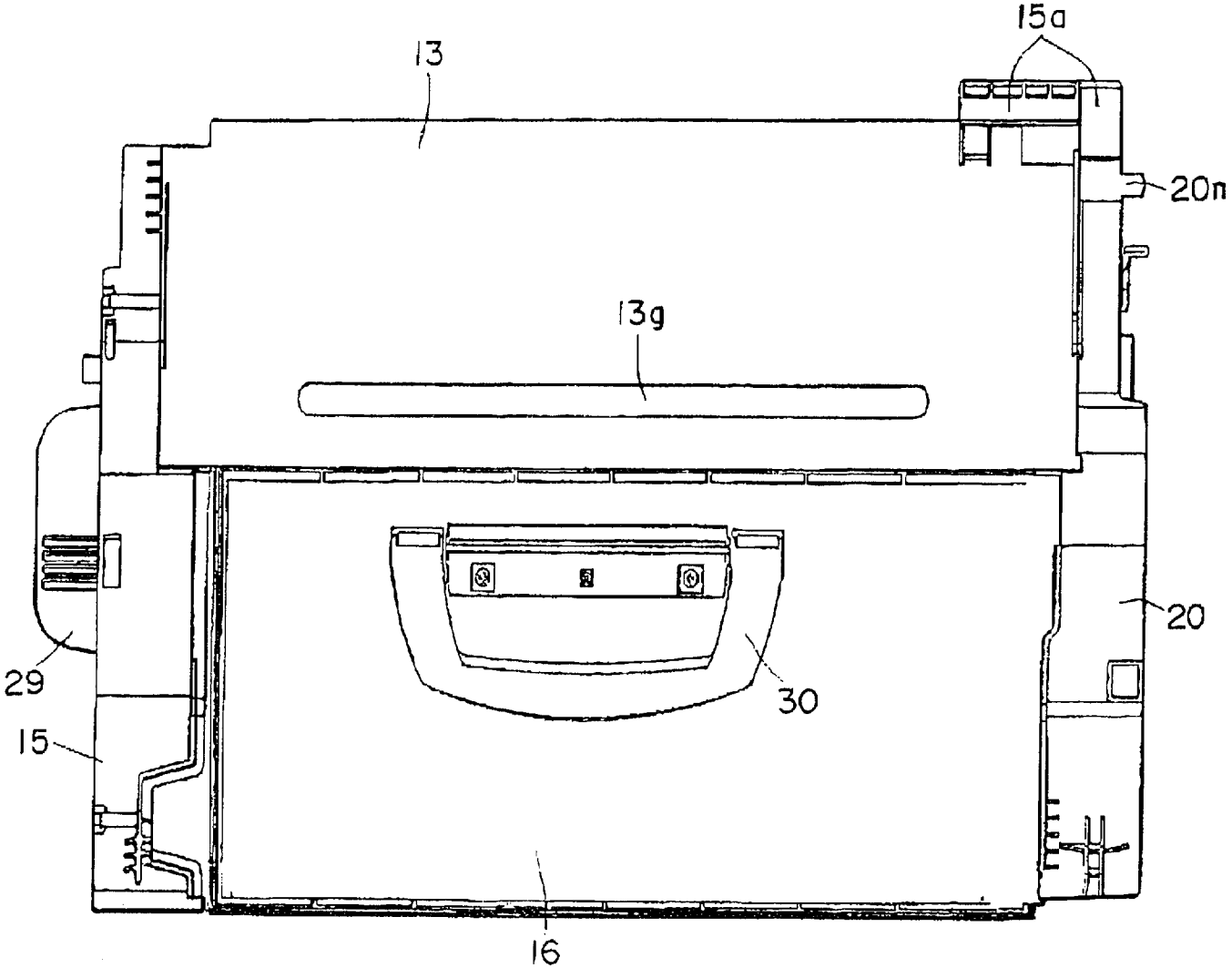
FIG. 46 is a plan of the process cartridge.
Figure 47:
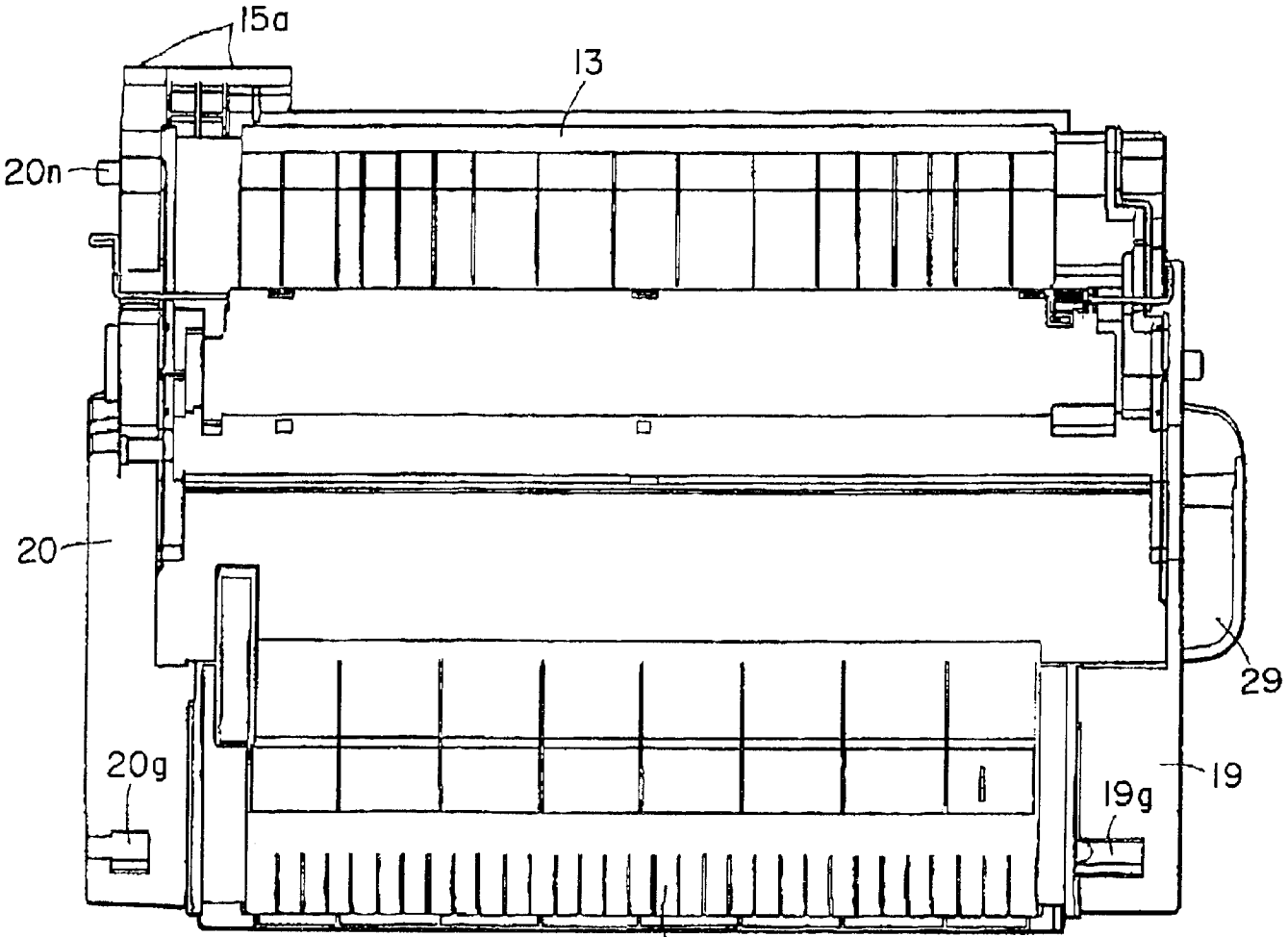
FIG. 47 is a bottom view of the process cartridge.

When the external lever 77 is in the state in FIG. 39, it is held by an unillustrated notch. As the external lever 77 is rotated in the direction indicated by an arrow mark B, the shaft 74 rotates with the lever 77 in the direction to lower the cam groove 78*a*. As a result, the process cartridge 15 pivots about the projection 20*g*1 in the hole 53*a* of the cylindrical member 53, and the third guide 19*g* supported in the second recess 73*b* of the guide 73 as shown in FIG. 45, so that the left side of the process cartridge 15 descends, with the connecting member 20*n* in the cam groove 78*a* moving in he cam groove 78*a*. The mounting of the process cartridge 15 into the apparatus main assembly 27 ends as the external lever 77 becomes horizontal (FIG. 40).

At this time, referring to FIG. 45, the process in which the process cartridge 15 is lowered by the internal lever 78 will be described.

In FIG. 45, the contour of the process cartridge 15 designated by a reference code 15(H) shows the attitude of the process cartridge 15 immediately after the process cartridge 15 has been horizontally pushed into the cartridge-mounting space 71 all the way, or the attitude (H). When the process cartridge 15 assumes the attitude (H), the connecting member 20*n*, the projection 20*g*1, and the third guide 19*g* of the process cartridge 15, are supported by the internal lever 78, the hole 53*a* of the cylindrical member 53, and the second recess 73*b* of the guide 73, correspondingly.

As the cam groove 78*a* of the internal lever 78 descends, the connecting member 20*n* also descends. During this descent, the line connecting the centers of the projection 20*g*1 and third guide 19*g* functions as the pivotal axis for the mounting of the process cartridge 15. The process cartridge 15 descends due to its own weight, with the connecting member 20*n* sliding on the bottom 78*b* the cam groove 78*a* toward the shaft 74. As the process cartridge 15 descends halfway, the connecting member 20*n* intersects the line connecting the center of the semicylindrical portion of the third guide 19*g* and the center of the shaft 74 in FIG. 45. At this point, the position of the connection member 20*n* is closest to the shaft 74. The curvature of the cam groove 78*a* is selected so that. as the connecting member 20*n* descends from a position at which the internal lever 78 is at the position 78(H), the connecting member 20*n* follows the line CL connecting the centers of the connecting member 20*n* and shaft 74 in FIG. 45. As the cam groove 78*a* side of the internal lever 78 descends further, the connecting member 20*n* slides on the bottom 78*b* of the cam groove 78*a* in a manner to move away from the shaft 74. Before the connecting member 20*n* reaches the outward side wall 78*c* of the cam groove 78*a*, which is connected to the right edge of the bottom 78*b* and has a cylindrical curvature, the drum bearing portion 22 (22*a* and 22*b*) of the process cartridge 15 engages with the shaft positioning recess 75. From this point on, the connecting member 20*n* does not move. Then, the cam groove 78*a* moves further downward, with the presence of a distance between the outward side wall 78*c* of the cam groove 78*a* and the connecting member 20*a*, and the opening 78*d* of the cam groove 78*a* comes to the position of the connecting member 20*n*. The outward and inward side walls 78*c* and 78*e* have cylindrical curvature, the axial line of which coincides with that of the shaft 74, and the gap between the two walls 78*c* and 78*e* is greater than the diameter of the connecting member 20*n*. The space between the outward and inward walls 78*c* and 78*e* is open on the top side, providing an opening 78*d*.

By the end of the above described process in which the process cartridge 15 is inserted into the apparatus main assembly 27, the first coupling 103, that is, a driving force transmitting member, on the main assembly side, and the second coupling 104 on the main assembly side, will have fully engaged with the first coupling 105*a*, that is, a driving force receiving member, on the process cartridge side, and the second coupling 106*a* on the process cartridge side, respectively. It is possible that these couplings fail to fully engage. In such cases, however, as soon as the couplings on the main assembly side are driven, the couplings on the main assembly side, which are under the pressure from the spring, advance and instantly engage with their counterparts on the process cartridge side.

As the unillustrated driving power source on the apparatus main assembly 27 side is driven and the coupling 105*a* of the process cartridge rotates, their rotational axes are aligned with each other. As a result, the rotational axis of the photosensitive drum 11 is aligned with the rotational axis of the first coupling 103 on the apparatus main assembly side. The distance the bearing 22*b* for the photosensitive drum, which has been resting in the positioning recess 75*b* on the main assembly side, is moved for this alignment is approximately 100 $\mu$m to 1 mm. While the process cartridge 15 is driven, it is supported by the positioning recess 75*a* on the trailing side in terms of the cartridge-insertion direction, and the cylindrical portion 53, and the meshing between the first coupling 103 of the apparatus main assembly and first coupling on the process-cartridge side. As described before, even if there is a small amount of misalignment between the second coupling 104 on the main assembly side and the second coupling 106*a* on the process-cartridge side, the driving force is transmitted without a hitch.

After the settling of the process cartridge 15 in the predetermined position in the cartridge mounting space after its descent, the process cartridge 15 is supported by the positioning recess 75*a* of the apparatus main assembly 27, the hole 53*a* of the cylindrical portion 53 of the apparatus main assembly 27, and the positioning recess 75*b* of the apparatus main assembly 27.

In other words, the process cartridge 15 is in the predetermined position in the cartridge mounting space, with the positioning member (shaft portion 22*a*1) of the process cartridge 15 being in the positioning recess of the main assembly, the positioning member (shaft portion 22*b*) of the process cartridge 15 being in the positioning recess 75*b* of the main assembly, and the projection 20*g*1 of the process cartridge 15 being in the hole 53*a*.

As the external lever 77 of the main assembly is rotated from the position illustrated in FIG. 40 in the direction indicated by an arrow mark C, the shaft 74 rotates in the same direction. As a result, the internal lever 78 moves upward. As the internal lever 78 moves upward, the connection member 20*n* on the leading end of the top left side of the process cartridge 15 in terms of the cartridge-insertion direction is moved upward by the carri groove 78*a*. Therefore, the projection 20*g*1 on the leading end of the bottom left side in terms of the cartridge-insertion direction rotates in the cylindrical portion 53 of the apparatus main assembly 27, the left side of the process cartridge 15 as seen from the trailing side of the cartridge-insertion direction, moves upward, the shaft 22*a*1 moves upward away from the positioning recess 75*a*, and the bearing 22*b* moves upward away from the positioning recess 75*b*. After the slight upward movements of the left side of the process cartridge 15, the shaft 22*a*1, and the bearing 22*b*, the third guide 19*g* on this side of the bottom right of the process cartridge 15 as seen from the trailing side of the cartridge-insertion direction descends and is supported by the second recess 73*b* of the guide 73. In this state, the connecting member 20*n* moves upward in a manner to circle around the axial lines of the projection 20*g*1 and the cylindrical curvature of the downwardly facing surface of the third guide 19*g*, with the projection 20*g*1 and the third guide 19*g* supported by the cylindrical portion 53, and the second recess 73*b* of the guide 73, respectively. As a result, the state of the process cartridge 15 illustrated in FIG. 40 is realized. In this state, the first guide portion 15*a*, which is on the inward end of the top left side of the process cartridge 15 as seen from the front side of the apparatus main assembly 27, is in a position which allows the first guide portion 15*a* to move straight upward through the gap 72*a*, and enter the guide 72 of the main assembly. Next, in the sate illustrated in FIG. 39, the process cartridge 15 is pulled toward the front side of the apparatus main assembly 27 by holding the second handle 29 by a hand. As the process cartridge 15 is pulled, the connecting member 20*n* on the inward end of the top left side of the process cartridge 15 begins to come out of the cam groove 78*a* as a connecting-member catching portion, and at the same time, the projection 20*g*1 on the inward end of the bottom right portion of the process cartridge 15 as seen from the trailing side of the cartridge-insertion direction moves in a direction to disengage from the cylindrical portion 53. In this state, the first guide portion 15*a* on the inward end of the top left portion of the process cartridge 15 as seen from the trailing side of the cartridge-insertion direction has moved to the position corresponding to the position of the gap 72*a*, and therefore, as the process cartridge 15 is pulled toward the operator, the pin-shaped connecting member 20*n* on the inward end of the top left side of the process cartridge 15 as seen from the trailing side of the cartridge-insertion direction, disengages from the cam groove 78*a*, after the first guide portion 15*a* moves onto the guide 72 of the main assembly. At about the same time, the projection 20*g*1 on the inward end of the bottom right portion of the process cartridge 15 as seen from the trailing side of the cartridge-insertion direction, disengages from the cylindrical portion 53. On the right side of the process cartridge 15 as seen from the front side of the apparatus main assembly 27, the third and second guides 19*g* and 20*g* rest on the first and second guide 73*a* and 73*b*, respectively. In this state, as the process cartridge 15 is pulled toward the front side of the apparatus main assembly 27, the first guide portion 15*a* slides on the guide 72 of the main assembly, and the third and second guides 19*g* and 20*g* slide on the guide 73. First, the third guide 19*g* disengages from the guide 73 as it comes out of the opening 100*a*. Next, as the process cartridge 15 is pulled further toward the front side of the apparatus main assembly 27 while holding the process cartridge 15 by the second handle 29, the first guide portion 15*a* moves to the operator side end of the guide 73*b* of the main assembly. In this state, as the process cartridge 15 is pulled toward the operator, while holding the first handle 30 with a hand, to pull the process cartridge 15 completely out of the apparatus main assembly 27 through the opening 100*a*, the first guide portion 15*a* disengages from the operator side end of the guide 72 toward the operator, and at the same time, the second guide portion 20*g* disengages from the operator side end of the second recess 72*b* of the guide 72 toward the operator.

Figure 44:
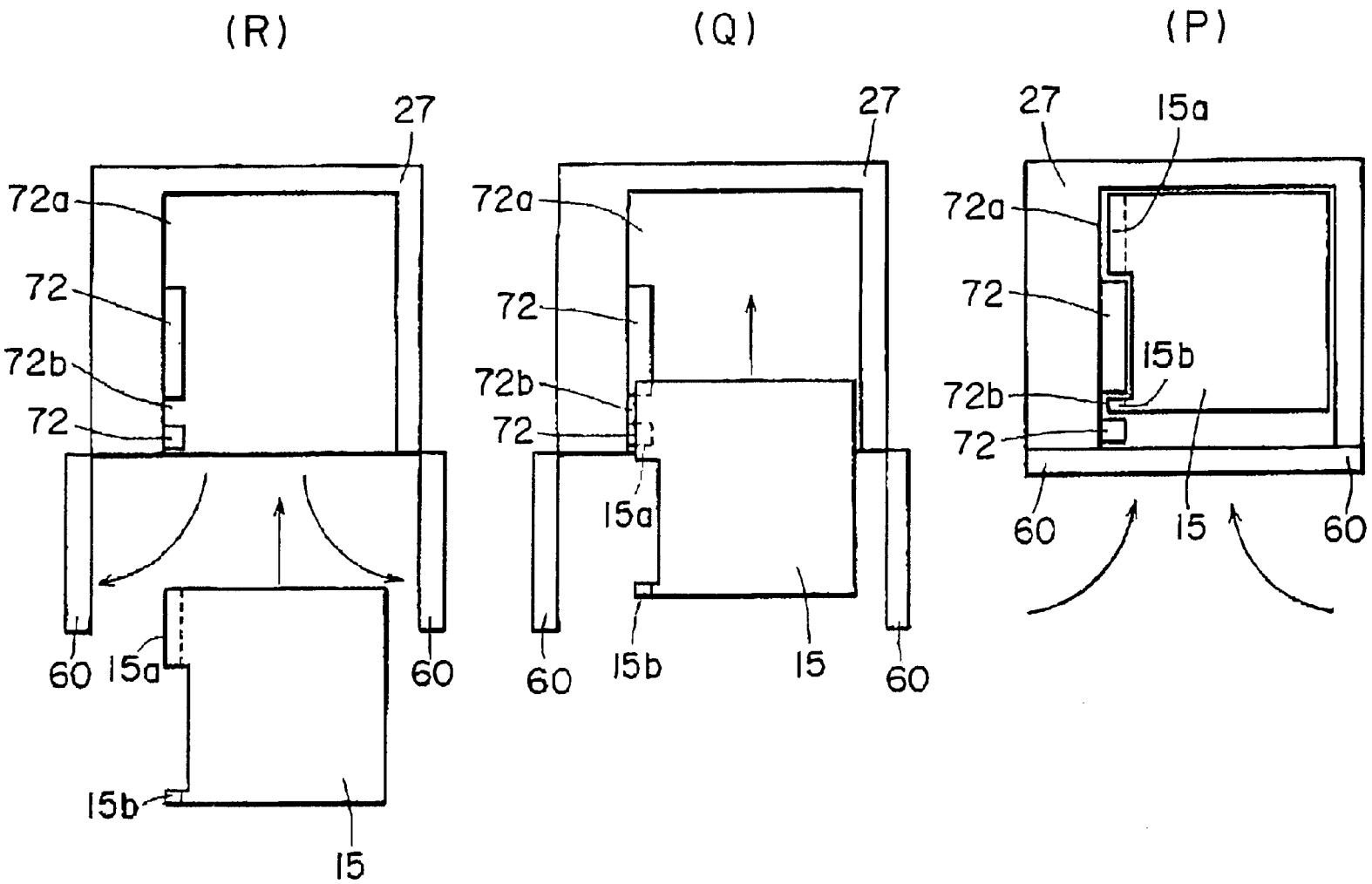
FIG. 44 is a plan view of the process-cartridge mounting space, and the process cartridge, which shows the stages (P), (Q) and (R) of the process in which the process cartridge is mounted into the main assembly of an image forming apparatus.

Regarding the guides of the apparatus main assembly 27 and process cartridge 15, the number of the gaps such as the aforementioned gap 72*a* may be plural. For example, FIG. 44 is a schematic drawing for depicting the insertion of the process cartridge into the apparatus main assembly, in another embodiment of the present invention. In FIG. 44, the guide 72 of the apparatus main assembly may be provided with a gap 72*b* as the passage for the guide 15*b* of the apparatus main assembly, or the trailing side guide of the apparatus main assembly as seen from the trailing side of the cartridge insertion direction. This gap 72*b* is positioned so that it aligns with the gap 72*b* when the first guide portion 15*a* aligns with the gap 72*a*.

Since the image forming apparatus and process cartridge are structured so that the process cartridge 15 is mounted into, or dismounted from, the image forming apparatus main assembly as described above, the projection 20*g*1 which is in contact with the cylindrical portion 53 of the image forming apparatus functions as a rotation controller for the process cartridge 15, when a sheet of paper as recording medium is passed through the image forming apparatus, in other words, when driving force is applied to the photosensitive drum 11 in the direction to rotate it in the clockwise direction. Therefore, the attitude of the process cartridge 15 is kept stable. In other words, the pivotal axis about which the process cartridge 15 pivots when it is mounted into or dismounted from the apparatus main assembly 27 doubles as the rotation controller during the passage of a sheet of recording medium. Moreover, the provision of the above described structural arrangement stabilizes the position of the pivotal axis for the process cartridge 15.

As an image forming apparatus increases in size, a process cartridge increases in size and weight. According to the embodiments of the present invention, however, all that is necessary to mount a process cartridge into an image forming apparatus is to operate a lever to move the process cartridge to a predetermined position after horizontally pushing the process cartridge into the image forming apparatus, regardless of the size and weight of the process cartridge. In other words, the operation which must be carried out by an operator by directly holding a process cartridge is only a portion of an overall cartridge mounting operation, in which the process cartridge is inserted straight into the apparatus main assembly, improving the operational efficiency in the mounting of a process cartridge.

Further, it is assured that a process cartridge is accurately positioned by a simple operation of a lever. Therefore, the operational efficiency is improved, and the accuracy in the positioning of a process cartridge is improved.

On the contrary, all that is necessary to remove a process cartridge from an image forming apparatus is to pull the cartridge toward an operator after operating a lever. Therefore, a process cartridge with an increased size is easy to handle during the removal.

Further, the first and second recesses of the guides for supporting a process cartridge from underneath are located at the opposing ends of the bottom portion of the developing means frame portion so that they are positioned a sufficient distance away from the photosensitive drum 11. Therefore, the axial line of the photosensitive drum 11 follows an almost vertical cylindrical plane. The lever for vertically moving a process cartridge is provided with a cam groove, in which the pin-shaped connecting member of a process cartridge is inserted. Therefore, the means for vertically moving a process cartridge is simple in structure. The process cartridge weight which falls on the means for vertically moving a process cartridge directly falls on a cartridge mounting lever (lever 77 of main assembly), without going through a linking mechanism. Therefore, the state or position of a process cartridge can be accurately detected through the lever, making it possible to lift or lower the process cartridge at a proper speed.

According to the embodiments described above, not only can component count be reduced to reduce cost, but also the accuracy with which the components essential to image formation are mounted is improved, improving an image forming apparatus in reliability in image formation.

Also according to the embodiments described above, a connecting member (groove 19*e*) for rotationally supporting a development roller is positioned adjacent to one end of the development roller in terms of the direction of the axial line of the development roller, and the positional relationship between a magnetic roll and the development roller is regulated by this connecting member. Further, the connecting member is provided with a roughly cylindrical projection, the axial line of which coincides with that of the development roller, and this projection is provided with a positioning portion for regulating the positional relationship between the development roller and photosensitive drum, and a surface by which the reactive force from the force for keeping the development roller pressed upon the electrophotographic photosensitive member is caught by this projection. Therefore, not only can be component count be reduced to reduce cost, but also the accuracy with which the components essential to image formation are mounted can be improved to reliably produce high quality images.

As is evident from the description given above, according to the present invention, it was possible to improve the accuracy in the relationship between the positions in which the development roller and magnetic roll are mounted.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, said process cartridge comprising:

an electrophotographic photosensitive drum;

a developing roller for developing an electrostatic latent image formed on said photosensitive drum;

a magnet disposed in said developing roller;

a drum frame supporting said photosensitive drum;

a developing device frame which is movable relative to said drum frame;

an engaging member for enabling an end of said developing roller and an end of said magnet to be supported on said developing device frame, said engaging member being mounted to one longitudinal end of said developing device frame in engagement with one end of said developing device frame and in engagement with one end of said developing roller and with one end of said magnet, wherein said engaging member is provided with a projected portion at an opposite end from the end where it is in engagement with one end of said developing roller and one end of said magnet; and an elastic member urging member urging said projected portion by its elastic force so as to urge said developing roller to said photosensitive drum.

2. A process cartridge claim 1, wherein said engaging member is provided with a first hole and a second hole behind said first hole at a side opposite from the side having the projected portion, wherein said first hole is engaged with one end of said developing roller through a bearing bush, and said second hole is engaged with one end of said magnet.

3. A process cartridge according to claim 1 or 2, wherein said projected portion is provided with a flat portion extending in the longitudinal direction, and said flat portion is urged by said elastic member.

4. A process cartridge according to claim 1 or 2, wherein said engaging member is provided with a plurality of screw bores, and said engaging member is mounted to said developing device frame by screws.

5. A process cartridge according to claim 1 or 2, wherein the other end of said developing roller and the other end of said magnet are mounted to the other longitudinal end of said developing device frame through a bearing.

6. A process cartridge according to any one of claim 1 and 2, wherein an end cover is provided at one longitudinal end of said developing device frame, and an inner surface of said end cover is provided with an elongated groove, wherein a free end of said projected portion enters the groove, and said elastic member which is in the groove urges the free end of said projected portion.

7. A process cartridge according to claim 1, wherein said elastic member is a coil spring.

8. A process cartridge according to any one of claim 1 and 2, wherein a tension spring is mounted to a metal plate of a developing blade mounted to developing device frame at the other longitudinal end of said developing device frame and one longitudinal end of said drum frame, wherein said developing roller is urged to said photosensitive drum by an elastic force of the tension spring and an elastic force of said elastic member.

9. A process cartridge according to any one of claim 1, wherein one and the other longitudinal ends of said developing roller are provided with spacer rollers through which said developing roller is urged to said photosensitive drum.

10. An engaging member to be used for mounting a developing roller to a developing device frame in a process cartridge comprising an electrophotographic photosensitive drum, the developing roller for developing an electrostatic latent image formed on the photosensitive drum and a magnet disposed in the developing roller, the process cartridge being detachably mountable to a main assembly of an electrophotographic image forming apparatus, said engaging member comprising:

an engaging portion for engagement with one end of said developing roller and one end of the magnet;

a projected portion projected at a side opposite from a side having said engaging portion; and an urging portion urged by an elastic member provided on said projected portion, wherein said engaging member is mounted on one longitudinal end of the developing device frame to support an end of the developing roller and one end of the magnet on the developing device frame.

11. An engaging member according to claim 10, wherein said engaging portion is provided with a first hole and a second hole behind said first hole, and wherein when said engaging member is mounted to the developing device frame, said first hole is engaged with one end of the developing roller through a bearing bush, and said second hole is engaged with one end of the magnet.

12. An engaging member according to claim 10, wherein said projected portion is provided with a flat portion extended in the longitudinal direction, and said flat portion is urged by the elastic member.

13. An engaging member according to claim 10 or 11, wherein said engaging member is provided with a plurality of screw bores, and said engaging member is mounted to said developing device frame by screws through the screw holes.

14. A mounting method for mounting a developing roller and a magnet to a developing device frame comprising the steps of:

providing an engaging member including an engaging portion for engagement with one end the developing roller and with one end of the magnet, a projected portion projected from a side opposite from a side having the engaging portion and an urging portion urged by an elastic member and provided on the projected portion;

engaging the engaging portion with the one end of the developing roller and the one end of the magnet; and then mounting the engaging member to a longitudinal end of the developing device frame, by which an end of the developing roller and end of the magnet are supported on the developing device frame through the engaging member.

15. A method according to claim 14, wherein the engaging member is demountably mounted to the developing device frame.

16. A process cartridge detachably mountable to a main assembly of an electrophotographic image forming apparatus, said process cartridge comprising:

an electrophotographic photosensitive drum;

a developing roller for developing an electrostatic latent image formed on said photosensitive drum;

a magnet disposed in said developing roller;

a drum frame supporting said photosensitive drum;

a developing device frame which is movable relative to said drum frame;

an engaging member for enabling an end of said developing roller and an end of said magnet to be supported on said developing device frame, said engaging member being mounted to one longitudinal end of said developing device frame in engagement with one end of said developing device frame and in engagement with one end of said developing roller and with one end of said magnet, wherein said engaging member is provided with a projected portion at an opposite end from the end where it is in engagement with one end of said developing roller and one end of said magnet; and an elastic member urging said projected portion by its elastic force so as to urge said developing roller to said photosensitive drum, wherein the other end of said developing roller and the other end of said magnet are mounted to the other longitudinal end of said developing device frame through a bearing, wherein an end cover is provided at one longitudinal end of said developing device frame, and an inner surface of said end cover is provided with an elongated groove, wherein a free end of said projected portion enters the groove, and said elastic member which is in the groove urges the free end of said projected portion, and wherein one and the other longitudinal ends of said developing roller are provided with spacer rollers through which said developing roller is urged to said photosensitive drum.

17. A process cartridge according to claim 16, wherein said projected portion is provided with a flat portion extending in the longitudinal direction, and said flat portion is urged by said elastic member.

18. A process cartridge according to claim 16, wherein a tension spring is mounted to a metal plate of a developing blade mounted to said developing device frame at the other longitudinal end of said developing device frame and one longitudinal end of said drum frame, wherein said developing roller is urged to said photosensitive drum by an elastic force of the tension spring and an elastic force of said elastic member.

19. An electrophotographic image forming apparatus for forming an image on a recording material, to which a process cartridge is detachably mountable, said apparatus comprising:

a mounting portion for detachably mounting the process cartridge, the process cartridge including:

an electrophotographic photosensitive drum;

a developing roller for developing an electrostatic latent image formed on the photosensitive drum;

a magnet disposed in the developing roller;

a drum frame supporting the photosensitive drum;

a developing device frame which is movable relative to the drum frame;

an engaging member for enabling an end of the developing roller and an end of the magnet to be supported on the developing device frame, the engaging member being mounted to one longitudinal end of the developing device frame in engagement with one end of the developing device frame and in engagement with one end of the developing roller and with one end of the magnet, wherein the engaging member is provided with a projected portion at an opposite end from the end where it is in engagement with one end of the developing roller and one end of the magnet; and an elastic member urging the projected portion by its elastic force so as to urge the developing roller to the photosensitive drum; and feeding means for feeding the recording material.

* * * * *

UNITED STATES PATENT AND TRADEMARK OFFICE

CERTIFICATE OF CORRECTION

PATENT NO. : 6,549,736 B2
DATED : April 15, 2003
INVENTOR(S) : Shigeo Miyabe et al.

It is certified that error appears in the above-identified patent and that said Letters Patent is hereby corrected as shown below:

Title page,
Item [57], ABSTRACT,
Line 6, "inn" should read -- in --.

Column 1,
Line 66, "provide:" should read -- to provide: --.

Column 2,
Lines 2, 3, 5 and 6, "magnet" should read -- the magnet --.
Line 12, "one" should read -- on --.
Line 16, "connected" should read -- connected to --.

Column 5,
Line 7, "mean" should read -- means --.

Column 6,
Line 58, "is" (first occurrence) should be deleted.
Line 66, "of," should read -- of --.

Column 7,
Lines 50 and 59, "correspondent" should read -- corresponding --.

Column 8,
Line 13, "drum 11; the flange 11b is fitted" should read -- drum 11. --.
Line 14, should be deleted.
Line 15, "11. Since" should read -- Since --.
Line 37, "or the positioning" should be deleted.
Line 38, "holes 19c and 19d," should be deleted.

Column 9,
Lines 29 and 32, "developer" should read -- the developer --.
Line 56, "he" should read -- the --.

Column 10,
Line 11, "above described" should read -- above-described --.
Line 25, "developer" should read -- the developer --.
Line 27, "bellows" should read -- a bellows --.
Line 28, "developer" should read -- the developer --.

UNITED STATES PATENT AND TRADEMARK OFFICE

CERTIFICATE OF CORRECTION

PATENT NO. : 6,549,736 B2
DATED : April 15, 2003
INVENTOR(S) : Shigeo Miyabe et al.

It is certified that error appears in the above-identified patent and that said Letters Patent is hereby corrected as shown below:

Column 11,
Line 21, "above described" should read -- above-described --.
Line 40, "allows" should read -- allows for --.

Column 12,
Line 56 "of" should read -- of a --.

Column 13,
Lines 10, 12 and 30, "above described" should read -- above-described --.

Column 15,
Line 37, "above described" should read -- above-described --.
Line 58, "double side" should read -- a double-sided --.

Column 16,
Line 18, "2b" should read -- 26b --.
Line 42, "development" should read -- the development --.

Column 17,
Line 66, "in" should be deleted.
Line 67, "surface the" should read -- surface. The --.

Column 18,
Line 8, "like more" should read -- like. More --.
Line 38, "impact resistance" should read -- impact-resistant --.
Line 59, "apparatus" should read -- apparatus, --.

Column 21,
Line 14, "elongated" should read -- an elongated --.

Column 22,
Line 4, "main" should read -- main- --.
Line 15, "assemble" should read -- assembly --.
Line 27, "triangle" should read -- triangular --.
Line 42, "correspondent" should read -- corresponding --.

UNITED STATES PATENT AND TRADEMARK OFFICE

CERTIFICATE OF CORRECTION

PATENT NO. : 6,549,736 B2
DATED : April 15, 2003
INVENTOR(S) : Shigeo Miyabe et al.

It is certified that error appears in the above-identified patent and that said Letters Patent is hereby corrected as shown below:

Column 23,
Lines 9 and 63, "above described" should read -- above-described --.

Column 24,
Line 14, "flange" should read -- flanges --.

Column 26,
Line 33, "taken" should read -- take --.

Column 27,
Line 6, "above described" should read -- above-described --.

Column 28,
Line 11, "side" should read -- side of --.
Line 13, "opment roller" should read -- opment-roller --.
Line 14, "roll 28" should read -- roll 23 --.

Column 29,
Line 66, "whatever." should read -- whatsoever. --.

Column 30,
Line 61, "end" should read -- ends --.

Column 31,
Line 1, "rings 18h" should read -- rings 18b --.

Column 32,
Line 7, "above" should read -- above- --.
Line 46, "to" should read -- to as an --.

Column 34,
Line 52, "integral" should read -- integrally --.
Line 62, "user's" should read -- the user's --.

Column 35,
Line 47, "lading" should read -- leading --.

UNITED STATES PATENT AND TRADEMARK OFFICE

CERTIFICATE OF CORRECTION

PATENT NO. : 6,549,736 B2
DATED : April 15, 2003
INVENTOR(S) : Shigeo Miyabe et al.

It is certified that error appears in the above-identified patent and that said Letters Patent is hereby corrected as shown below:

Column 36,
Line 13, "he" should read -- the --.
Line 36, "the" (2nd occurrence) should read -- of the --.

Column 37,
Line 1, "above described" should read -- above-described --.
Line 56, "carri" should read -- cam --.

Column 38,
Line 44, "guide" should read -- guides --.

Column 40,
Line 21, "be" (1st occurrence) should read -- the --.
Line 56, "member urging" (2nd occurrence) should be deleted.
Line 59, "claim 1," should read -- according to claim 1, --.

Column 41,
Lines 11 and 20, "claim" should read -- claims --.
Line 22, "to" should read -- to said --.
Line 28, "any one of" should be deleted.
Lines 41 and 65, "said" should read -- the --.
Line 66, "holes" should read -- bores. --.

Column 42,
Line 2, "end" should read -- end of --.
Line 14, "end" should read -- an end --.

Signed and Sealed this

Eighteenth Day of November, 2003

JAMES E. ROGAN
*Director of the United States Patent and Trademark Office*